US006644022B2

(12) United States Patent
Hirota et al.

(10) Patent No.: US 6,644,022 B2
(45) Date of Patent: Nov. 11, 2003

(54) EXHAUST GAS PURIFICATION DEVICE OF INTERNAL COMBUSTION ENGINE

(75) Inventors: Shinya Hirota, Susono (JP); Toshiaki Tanaka, Numazu (JP); Kazuhiro Itoh, Mishima (JP); Takamitsu Asanuma, Susono (JP); Koichiro Nakatani, Susono (JP); Koichi Kimura, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/979,064

(22) PCT Filed: Mar. 27, 2001

(86) PCT No.: PCT/JP01/02509

§ 371 (c)(1),
(2), (4) Date: Nov. 16, 2001

(87) PCT Pub. No.: WO01/73273

PCT Pub. Date: Oct. 4, 2001

(65) Prior Publication Data

US 2002/0157384 A1 Oct. 31, 2002

(30) Foreign Application Priority Data

Mar. 29, 2000 (JP) ..... 2000-092530
Jul. 24, 2000 (JP) ..... 2000-222828

(51) Int. Cl.[7] ..... F01N 3/00

(52) U.S. Cl. ..... 60/297; 60/288; 60/292; 60/296

(58) Field of Search ..... 60/274, 278, 286, 60/292, 296, 297, 301, 287, 288

(56) References Cited

U.S. PATENT DOCUMENTS 4,902,487 A 2/1990 Cooper et al.
5,100,632 A 3/1992 Dettling et al.
5,293,741 A * 3/1994 Kashiyama et al. ..... 60/292
5,404,719 A 4/1995 Araki et al.
5,746,989 A * 5/1998 Murachi et al. ..... 60/274
5,853,438 A * 12/1998 Igarashi ..... 60/296
5,884,474 A * 3/1999 Topsøe ..... 60/296
5,934,072 A * 8/1999 Hirota et al. ..... 60/292
6,167,696 B1 * 1/2001 Maaseidvaag et al. ..... 60/274
6,314,722 B1 * 11/2001 Matros et al. ..... 60/296
6,408,620 B2 * 6/2002 Boegner et al. ..... 60/292

FOREIGN PATENT DOCUMENTS

| | | |
|---|---|---|
| EP | 0 766 993 A2 | 4/1997 |
| EP | 0 884 457 A | 12/1998 |
| EP | 0 984 142 A | 3/2000 |
| JP | 03253712 | 11/1991 |
| JP | A 4-31614 | 2/1992 |
| JP | A 5-44436 | 2/1993 |
| JP | A 5-59931 | 3/1993 |
| JP | A 5-98932 | 4/1993 |
| JP | A 6-129235 | 5/1994 |
| JP | A 6-159037 | 6/1994 |
| JP | A 6-272541 | 9/1994 |
| JP | A 7-189656 | 7/1995 |
| JP | B2 7-106290 | 11/1995 |
| JP | A 8-338229 | 12/1996 |
| JP | A 9-94434 | 4/1997 |
| JP | A 10-306717 | 11/1998 |
| JP | A 11-300165 | 11/1999 |
| JP | B2 3012249 | 12/1999 |
| JP | A 2000-18026 | 1/2000 |

OTHER PUBLICATIONS

European Search Report, Aug. 20, 2002.

* cited by examiner

*Primary Examiner*—Thomas Denion
*Assistant Examiner*—Tu M. Nguyen
(74) *Attorney, Agent, or Firm*—Oliff & Berridge, PLC

(57) ABSTRACT

A particulate filter (22) is arranged in an exhaust passage of an engine, while an exhaust throttle valve (45) is arranged in the exhaust passage downstream of the particulate filter (22). The exhaust throttle valve (45) is fully closed once, then fully opened cyclically. At that time, the flow velocity of the exhaust gas is increased for just an instant in a pulse-like manner, whereby masses of particulate are separated from the particulate filter 22 and discharged.

30 Claims, 36 Drawing Sheets

EXHAUST GAS PURIFICATION DEVICE OF INTERNAL COMBUSTION ENGINE

TECHNICAL FIELD

The present invention relates to an exhaust gas purification device of an internal combustion engine.

BACKGROUND ART

In the past, in a diesel engine, particulate contained in the exhaust gas has been removed by arranging a particulate filter in the engine exhaust passage, using that particulate filter to trap the particulate in the exhaust gas, and igniting and burning the particulate trapped on the particulate filter to regenerate the particulate filter. The particulate trapped on the particulate filter, however, does not ignite unless the temperature becomes a high one of at least about 600° C. As opposed to this, the temperature of the exhaust gas of a diesel engine is normally considerably lower than 600° C. Therefore, it is difficult to use the heat of the exhaust gas to cause the particulate trapped on the particulate filter to ignite. To use the heat of the exhaust gas to cause the particulate trapped on the particulate filter to ignite, it is necessary to lower the ignition temperature of the particulate.

It has been known in the past, however, that the ignition temperature of particulate can be reduced if carrying a catalyst on the particulate filter. Therefore, known in the art are various particulate filters carrying catalysts for reducing the ignition temperature of the particulate.

For example, Japanese Examined Patent Publication (Kokoku) No. 7-106290 discloses a particulate filter comprising a particulate filter carrying a mixture of a platinum group metal and an alkali earth metal oxide. In this particulate filter, the particulate is ignited by a relatively low temperature of about 350° C. to 400° C., then is continuously burned.

In a diesel engine, when the load becomes high, the temperature of the exhaust gas reaches from 350° C. to 400° C., therefore with the above particulate filter, it would appear at first glance that the particulate could be made to ignite and burn by the heat of the exhaust gas when the engine load becomes high. In fact, however, even if the temperature of the exhaust gas reaches from 350° C. to 400° C., sometimes the particulate will not ignite. Further, even if the particulate ignites, only some of the particulate will burn and a large amount of the particulate will remain unburned.

That is, when the amount of the particulate contained in the exhaust gas is small, the amount of the particulate deposited on the particulate filter is small. At this time, if the temperature of the exhaust gas reaches from 350° C. to 400° C., the particulate on the particulate filter ignites and then is continuously burned.

If the amount of the particulate contained in the exhaust gas becomes larger, however, before the particulate deposited on the particulate filter completely burns, other particulate will deposit on that particulate. As a result, the particulate deposits in layers on the particulate filter. If the particulate deposits in layers on the particulate filter in this way, the part of the particulate easily contacting the oxygen will be burned, but the remaining particulate hard to contact the oxygen will not burn and therefore a large amount of particulate will remain unburned. Therefore, if the amount of particulate contained in the exhaust gas becomes larger, a large amount of particulate continues to deposit on the particulate filter.

On the other hand, if a large amount of particulate is deposited on the particulate filter, the deposited particulate gradually becomes harder to ignite and burn. It probably becomes harder to burn in this way because the carbon in the particulate changes to the hard-to-burn graphite etc. while depositing. In fact, if a large amount of particulate continues to deposit on the particulate filter, the deposited particulate will not ignite at a low temperature of 350° C. to 400° C. A high temperature of over 600° C. is required for causing ignition of the deposited particulate. In a diesel engine, however, the temperature of the exhaust gas usually never becomes a high temperature of over 600° C. Therefore, if a large amount of particulate continues to deposit on the particulate filter, it is difficult to cause ignition of the deposited particulate by the heat of the exhaust gas.

On the other hand, at this time, if it were possible to make the temperature of the exhaust gas a high temperature of over 600° C., the deposited particulate would be ignited, but another problem would occur in this case. That is, in this case, if the deposited particulate were made to ignite, it would burn while generating a luminous flame. At this time, the temperature of the particulate filter would be maintained at over 800° C. for a long time until the deposited particulate finished being burned. If the particulate filter is exposed to a high temperature of over 800° C. for a long time in this way, however, the particulate filter will deteriorate quickly and therefore the problem will arise of the particulate filter having to be replaced with a new filter early.

Once a large amount of particulate deposits in layers on the particulate filter in this way, a problem arises. Therefore, it is necessary to avoid the deposition of a large amount of particulate on the particulate filter. Even if avoiding the deposition of a large amount of particulate on the particulate filter in this way, however, the particulate remaining after burning will accumulate and form large masses. These masses cause the problem of clogging of the fine holes of the particulate filter. If the fine holes of the particulate filter clog in this way, the pressure loss of the flow of exhaust gas in the particulate filter gradually becomes larger. As a result, the engine output ends up falling.

DISCLOSURE OF THE INVENTION

An object of the present invention is to provide an exhaust gas purification device of an internal combustion engine able to separate masses of particulate causing clogging of a particulate filter from the particulate filter and discharge the same.

According to the present invention, there is provided an exhaust gas purification apparatus of an internal combustion engine in which a particulate filter for removing by oxidation particulate in an exhaust gas discharged from a combustion chamber is arranged in an engine exhaust passage and in which flow velocity instantaneous increasing means is provided for increasing the flow velocity of exhaust gas flowing through the particulate filter for just an instant in a pulse-like manner when the particulate deposited on the particulate filter should be separated from the particulate filter and discharged outside of the particulate filter.

BEST MODE FOR CARRYING OUT THE INVENTION

Figure 1:
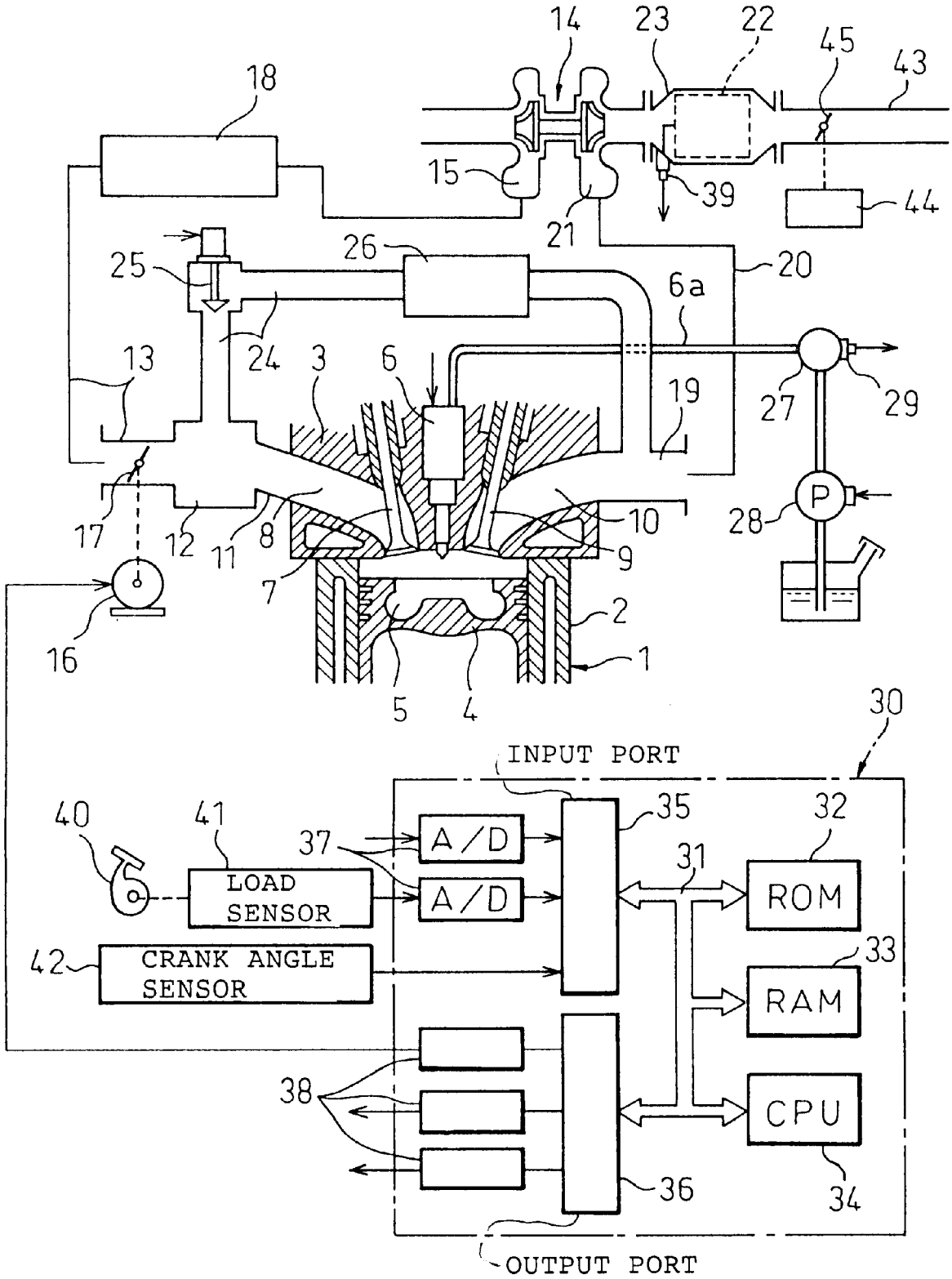
FIG. 1 is an overall view of an internal combustion engine.

FIG. 1 shows the case of application of the present invention to a compression ignition type internal combustion engine. Note that the present invention can also be applied to a spark ignition type internal combustion engine.

Referring to FIG. 1, 1 indicates an engine body, 2 a cylinder block, 3 a cylinder head, 4 a piston, 5 a combustion chamber, 6 an electrically controlled fuel injector, 7 an intake valve, 8 an intake port, 9 an exhaust valve, and 10 an exhaust port. The intake port 8 is connected to a surge tank 12 through a corresponding intake tube 11, while the surge tank 12 is connected to a compressor 15 of an exhaust turbocharger 14 through an intake duct 13. Inside the intake duct 13 is arranged a throttle valve 17 driven by a step motor 16. Further, a cooling device 18 is arranged around the intake duct 13 for cooling the intake air flowing through the intake duct 13. In the embodiment shown in FIG. 1, the engine coolant water is led inside the cooling device 18 and the intake air is cooled by the engine coolant water. On the other hand, the exhaust port 10 is connected to an exhaust turbine 21 of an exhaust turbocharger 14 through an exhaust manifold 19 and an exhaust pipe 20. The outlet of the exhaust turbine 21 is connected to a filter casing 23 housing a particulate filter 22.

The exhaust manifold 19 and the surge tank 12 are connected to each other through an exhaust gas recirculation (EGR) passage 24. Inside the EGR passage 24 is arranged an electrically controlled EGR control valve 25. A cooling device 26 is arranged around the EGR passage 24 to cool the EGR gas circulating inside the EGR passage 24. In the embodiment shown in FIG. 1, the engine coolant water is guided inside the cooling device 26 and the EGR gas is cooled by the engine coolant water. On the other hand, fuel injectors 6 are connected to a fuel reservoir, a so-called common rail 27, through fuel feed pipes 6*a*. Fuel is fed into the common rail 27 from an electrically controlled variable discharge fuel pump 28. The fuel fed into the common rail 27 is fed to the fuel injectors 6 through the fuel feed pipes 6*a*. The common rail 27 has a fuel pressure sensor 29 attached to it for detecting the fuel pressure in the common rail 27. The discharge of the fuel pump 28 is controlled based on the output signal of the fuel pressure sensor 29 so that the fuel pressure in the common rail 27 becomes a target fuel pressure.

An electronic control unit 30 is comprised of a digital computer provided with a ROM (read only memory) 32, RAM (random access memory) 33, CPU (microprocessor) 34, input port 35, and output port 36 connected to each other through a bidirectional bus 31. The output signal of the fuel pressure sensor 29 is input through a corresponding AD converter 37 to the input port 35. Further, the particulate filter 22 has attached to it a temperature sensor 39 for detecting the temperature of the particulate filter 22. The output signal of this temperature sensor 39 is input to the input port 35 through the corresponding AD converter 37. An accelerator pedal 40 has connected to it a load sensor 41 generating an output voltage proportional to the amount of depression L of the accelerator pedal 40. The output voltage of the load sensor 41 is input to the input port 35 through the corresponding AD converter 37. Further, the input port 35 has connected to it a crank angle sensor 42 generating an output pulse each time a crankshaft rotates by for example 30 degrees.

On the other hand, inside of the exhaust pipe 43 connected to the outlet of the filter casing 23 is arranged an exhaust throttle valve 45 driven by the actuator 44. The output port 36 is connected through a corresponding drive circuit 38 to the fuel injector 6, step motor 16 for driving the throttle valve, EGR control valve 25, fuel pump 28, and actuator 44.

Figure 2A:
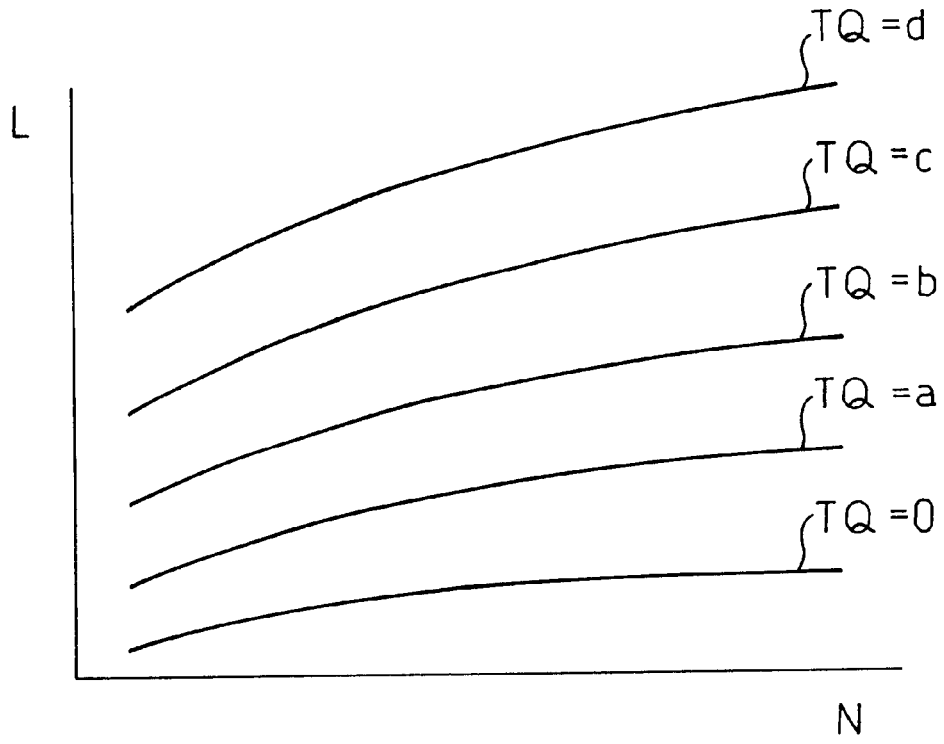
FIGS. 2A and 2B are views of a required torque of an engine.
Figure 2B:
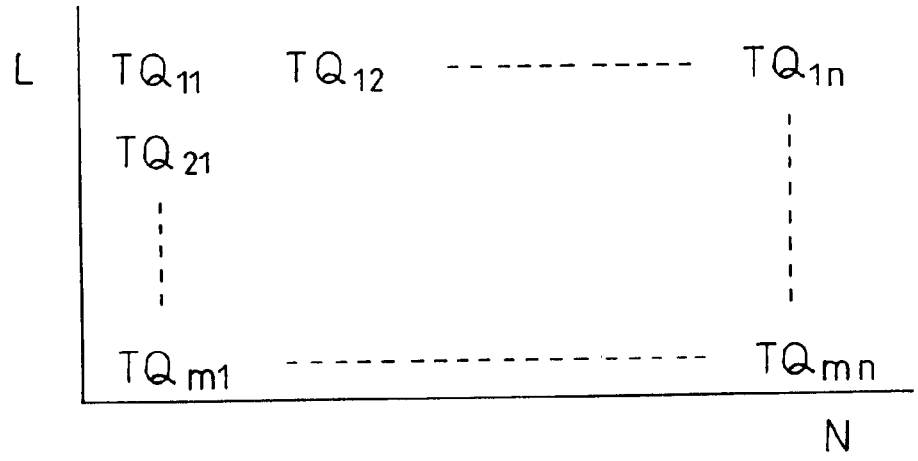

FIG. 2A shows the relationship between the required torque TQ, the amount of depression L of the accelerator pedal 40, and the engine speed N. Note that in FIG. 2A, the curves show the equivalent torque curves. The curve shown by TQ=0 shows the torque is zero, while the remaining curves show gradually increasing required torques in the order of TQ=a, TQ=b, TQ=c, and TQ=d. The required torque TQ shown in FIG. 2A, as shown in FIG. 2B, is stored in the ROM 32 in advance as a function of the amount of depression L of the accelerator pedal 40 and the engine speed N. In this embodiment of the present invention, the required torque TQ in accordance with the amount of depression L of the accelerator pedal 40 and the engine speed N is first calculated from the map shown in FIG. 2B, then the amount of fuel injection etc. are calculated based on the required torque TQ.

Figure 3A:
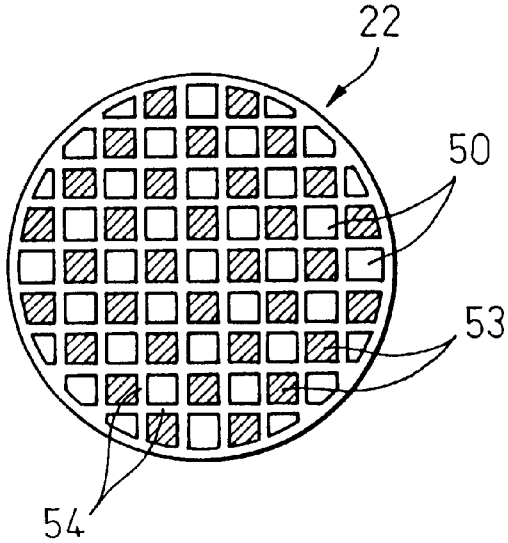
FIGS. 3A and 3B are views of a particulate filter.
Figure 3B:
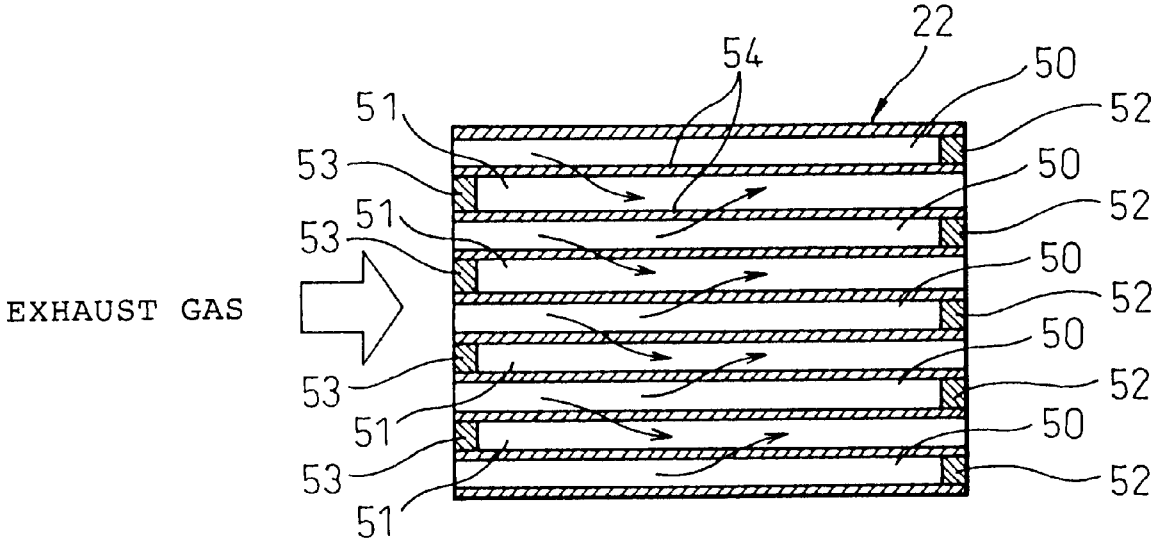

FIGS. 3A and 3B show the structure of the particulate filter 22. Note that FIG. 3A is a front view of the particulate filter 22, while FIG. 3B is a side sectional view of the particulate filter 22. As shown in FIGS. 3A and 3B, the particulate filter 22 forms a honeycomb structure and is provided with a plurality of exhaust passage 50, 51 extending in parallel with each other. These exhaust passage are comprised by exhaust gas inflow passages 50 with downstream ends sealed by plugs 52 and exhaust gas outflow passages 51 with upstream ends sealed by plugs 53. Note that the hatched portions in FIG. 3A show plugs 53. Therefore, the exhaust gas inflow passages 50 and the exhaust gas outflow passages 51 are arranged alternately through thin wall partitions 54. In other words, the exhaust gas inflow passages 50 and the exhaust gas outflow passages 51 are arranged so that each exhaust gas inflow passage 50 is surrounded by four exhaust gas outflow passages 51, and each exhaust gas outflow passage 51 is surrounded by four exhaust gas inflow passages 50.

The particulate filter 22 is formed from a porous material such as for example cordierite. Therefore, the exhaust gas flowing into the exhaust gas inflow passages 50 flows out into the adjoining exhaust gas outflow passages 51 through the surrounding partitions 54 as shown by the arrows in FIG. 3B.

In this embodiment of the present invention, a layer of a carrier comprised of for example alumina is formed on the peripheral surfaces of the exhaust gas inflow passages 50 and the exhaust gas outflow passages 51, that is, the two side surfaces of the partitions 54 and the inside walls of the fine holes in the partitions 54. On the carrier are carried a precious metal catalyst and an active oxygen release agent which takes in the oxygen and holds the oxygen if excess oxygen is present in the surroundings and releases the held oxygen in the form of active oxygen if the concentration of the oxygen in the surroundings falls.

In this case, in this embodiment according to the present invention, platinum Pt is used as the precious metal catalyst. As the active oxygen release agent, use is made of at least one of an alkali metal such as potassium K, sodium Na, lithium Li, cesium Cs, and rubidium Rb, an alkali earth metal such as barium Ba, calcium Ca, and strontium Sr, a rare earth such as lanthanum La, yttrium Y, and cerium Ce, and a transition metal such as tin Sn and iron Fe.

Note that in this case, as the active oxygen release agent, use is preferably made of an alkali metal or an alkali earth metal with a higher tendency of ionization than calcium Ca, that is, potassium K, lithium Li, cesium Cs, rubidium Rb, barium Ba, and strontium Sr or use is made of cerium Ce.

Next, the action of removal of the particulate in the exhaust gas by the particulate filter 22 will be explained taking as an example the case of carrying platinum Pt and potassium K on a carrier, but the same type of action for removal of particulate is performed even when using another precious metal, alkali metal, alkali earth metal, rare earth, and transition metal.

In a compression ignition type internal combustion engine such as shown in FIG. 1, combustion occurs under an excess of air. Therefore, the exhaust gas contains a large amount of excess air. That is, if the ratio of the air and fuel fed into the intake passage, combustion chamber 5, and exhaust passage is called the air-fuel ratio of the exhaust gas, then in a compression ignition type internal combustion engine such as shown in FIG. 1, the air-fuel ratio of the exhaust gas becomes lean. Further, in the combustion chamber 5, NO is generated, so the exhaust gas contains NO. Further, the fuel contains sulfur S. This sulfur S reacts with the oxygen in the combustion chamber 5 to become $SO_2$. Therefore, the exhaust gas contains $SO_2$. Accordingly, exhaust gas containing excess oxygen, NO, and $SO_2$ flows into the exhaust gas inflow passages 50 of the particulate filter 22.

Figure 4A:
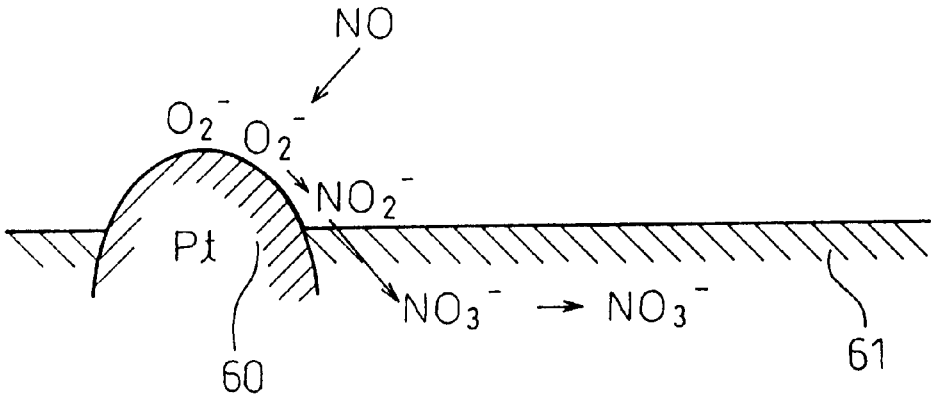
FIGS. 4A and 4B are views for explaining an action of oxidation of particulate.
Figure 4B:
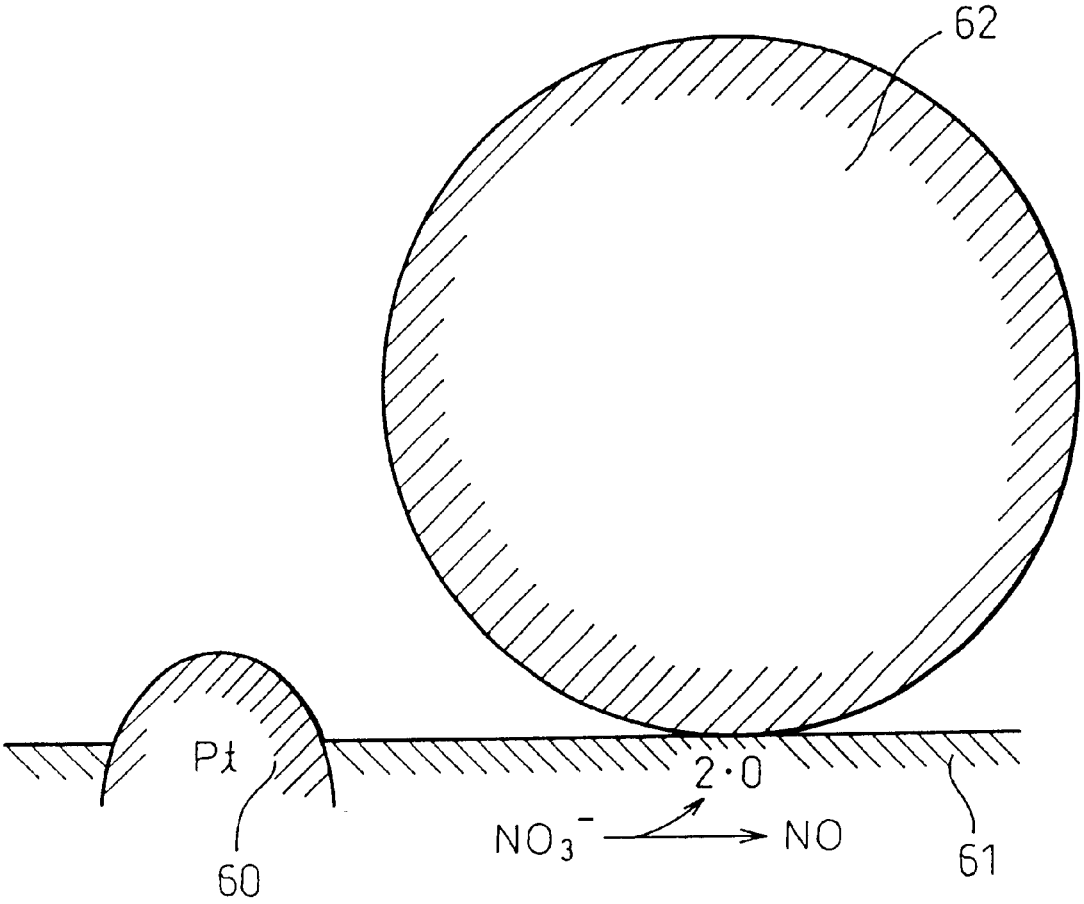

FIGS. 4A and 4B are enlarged views of the surface of the carrier layer formed on the inner circumferential surfaces of the exhaust gas inflow passages 50 and the inside walls of the fine holes in the partitions 54. Note that in FIGS. 4A and 4B, 60 indicates particles of platinum Pt, while 61 indicates the active oxygen release agent containing potassium K.

In this way, since a large amount of excess oxygen is contained in the exhaust gas, if the exhaust gas flows into the exhaust gas inflow passages 50 of the particulate filter 22, as shown in FIG. 4A, the oxygen $O^2$ adheres to the surface of the platinum Pt in the form of $O_2^-$ or $O^{2-}$. On the other hand, the NO in the exhaust gas reacts with the $O_2^-$ or $O^{2-}$ on the surface of the platinum Pt to become $NO_2$ ($2NO+O_2 \rightarrow 2NO_2$). Next, part of the $NO_2$ which is produced is absorbed in the active oxygen release agent 61 while being oxidized on the platinum Pt and diffuses in the active oxygen release agent 61 in the form of nitrate ions $NO_3^-$ as shown in FIG. 4A while bonding with the potassium K. Part of the nitrate ions $NO_3^-$ produces potassium nitrate $KNO_3$.

On the other hand, as explained above, the exhaust gas also contains $SO_2$. This $SO_2$ is absorbed in the active oxygen release agent 61 by a mechanism similar to that of NO. That is, in the above way, the oxygen $O_2$ adheres to the surface of the platinum Pt in the form of $O_2^-$ or $O^{2-}$. The $SO_2$ in the exhaust gas reacts with the $O_2^-$ or $O^{2-}$ on the surface of the platinum Pt to become $SO_3$. Next, part of the $SO_3$ which is produced is absorbed in the active oxygen release agent 61 while being oxidized on the platinum Pt and diffuses in the active oxygen release agent 61 in the form of sulfate ions $SO_4^{2-}$ while bonding with the potassium Pt to produce potassium sulfate $K_2SO_4$. In this way, potassium sulfate $KNO_3$ and potassium sulfate $K_2SO_4$ are produced in the active oxygen release agent 61.

On the other hand, particulate comprised of mainly carbon is produced in the combustion chamber 5. Therefore, the exhaust gas contains this particulate. The particulate contained in the exhaust gas contacts and adheres to the surface of the carrier layer, for example, the surface of the active oxygen release agent 61, as shown in FIG. 4B, when the exhaust gas is flowing through the exhaust gas inflow passages 50 of the particulate filter 22 or when heading from the exhaust gas inflow passages 50 to the exhaust gas outflow passages 51.

If the particulate 62 adheres to the surface of the active oxygen release agent 61 in this way, the concentration of oxygen at the contact surface of the particulate 62 and the active oxygen release agent 61 falls. If the concentration of oxygen falls, a difference in concentration occurs with the inside of the high oxygen concentration active oxygen release agent 61 and therefore the oxygen in the active oxygen release agent 61 moves toward the contact surface between the particulate 62 and the active oxygen release agent 61. As a result, the potassium sulfate $KNO_3$ formed in the active oxygen release agent 61 is broken down into potassium K, oxygen O, and NO. The oxygen O heads toward the contact surface between the particulate 62 and the active oxygen release agent 61, while the NO is released from the active oxygen release agent 61 to the outside. The NO released to the outside is oxidized on the downstream side platinum Pt and is again absorbed in the active oxygen release agent 61.

On the other hand, at this time, the potassium sulfate $K_2SO_4$ formed in the active oxygen release agent 61 is also broken down into potassium K, oxygen O, and $SO_2$ The oxygen O heads toward the contact surface between the particulate 62 and the active oxygen release agent 61, while the $SO_2$ is released from the active oxygen release agent 61 to the outside. The $SO_2$ released to the outside is oxidized on the downstream side platinum Pt and again absorbed in the active oxygen release agent 61.

On the other hand, the oxygen O heading toward the contact surface between the particulate 62 and the active oxygen release agent 61 is the oxygen broken down from compounds such as potassium sulfate $KNO_3$ or potassium sulfate $K_2SO_4$. The oxygen O broken down from these compounds has a high energy and has an extremely high activity. Therefore, the oxygen heading toward the contact surface between the particulate 62 and the active oxygen release agent 61 becomes active oxygen O. If this active oxygen O contacts the particulate 62, the oxidation action of the particulate 62 is promoted and the particulate 62 is oxidized without emitting a luminous flame for a short period of several minutes to several tens of minutes. While the particulate 62 is being oxidized in this way, other particulate is successively depositing on the particulate filter 22. Therefore, in practice, a certain amount of particulate is always depositing on the particulate filter 22. Part of this depositing particulate is removed by oxidation. In this way, the particulate 62 deposited on the particulate filter 22 is continuously burned without emitting luminous flame.

Note that the $NO_x$ is considered to diffuse in the active oxygen release agent 61 in the form of nitrate ions $NO_3^-$ while repeatedly bonding with and separating from the oxygen atoms. Active oxygen is produced during this time as well. The particulate 62 is also oxidized by this active oxygen. Further, the particulate 62 deposited on the particulate filter 22 is oxidized by the active oxygen O, but the particulate 62 is also oxidized by the oxygen in the exhaust gas.

When the particulate deposited in layers on the particulate filter 22 is burned, the particulate filter 22 becomes red hot and burns along with a flame. This burning along with a flame does not continue unless the temperature is high. Therefore, to continue burning along with such flame, the temperature of the particulate filter 22 must be maintained at a high temperature.

As opposed to this, in the present invention, the particulate 62 is oxidized without emitting a luminous flame as explained above. At this time, the surface of the particulate filter 22 does not become red hot. That is, in other words, in the present invention, the particulate 62 is removed by oxidation by a considerably low temperature. Accordingly, the action of removal of the particulate 62 by oxidation without emitting a luminous flame according to the present invention is completely different from the action of removal of particulate by burning accompanied with a flame.

The platinum Pt and the active oxygen release agent 61 become more active the higher the temperature of the particulate filter 22, so the amount of the active oxygen O able to be released by the active oxygen release agent 61 per unit time increases the higher the temperature of the particulate filter 22. Further, only naturally, the particulate is more easily removed by oxidation the higher the temperature of the particulate itself. Therefore, the amount of the particulate removable by oxidation on the particulate filter 22 per unit time without emitting a luminous flame increases the higher the temperature of the particulate filter 22.

Figure 6:
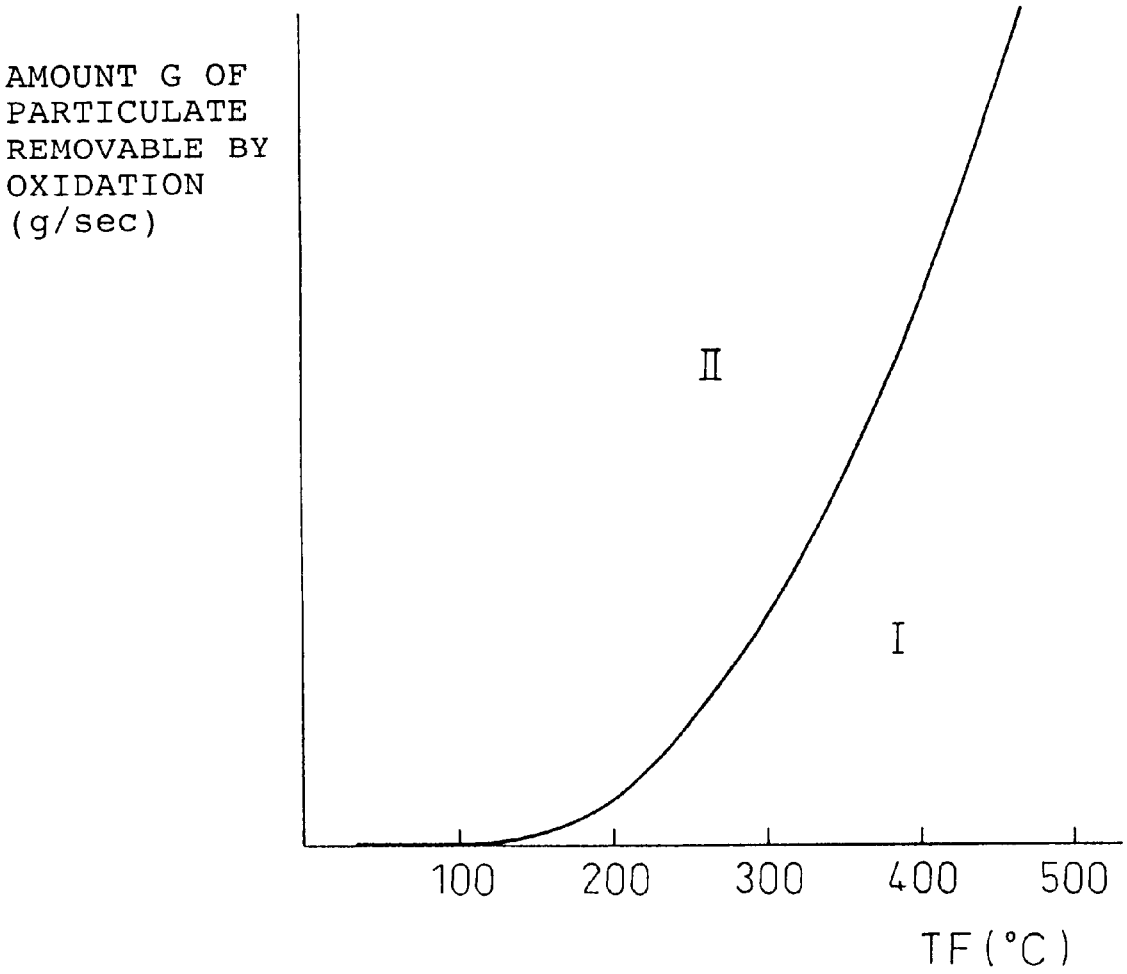
FIG. 6 is a view of the relationship between the amount of particulate removable by oxidation and the temperature of the particulate filter.

The solid line in FIG. 6 shows the amount G of the particulate removable by oxidation per unit time without emitting a luminous flame. The abscissa of FIG. 6 shows the temperature TF of the particulate filter 22. Note that FIG. 6 shows the amount G of particulate removable by oxidation in the case where the unit time is 1 second, that is, per second, but 1 minute, 10 minutes, or any other time may also be employed as the unit time. For example, when using 10 minutes as the unit time, the amount G of particulate removable by oxidation per unit time expresses the amount G of particulate removable by oxidation per 10 minutes. In this case as well, the amount G of particulate removable by oxidation on the particulate filter 22 per unit time without emitting a luminous flame, as shown in FIG. 6, increases the higher the temperature of the particulate filter 22.

Now, if the amount of the particulate discharged from the combustion chamber 5 per unit time is called the amount M of discharged particulate, when the amount M of discharged particulate is smaller than the amount G of particulate removable by oxidation for the same unit time, for example when the amount M of particulate discharged per second is less than the amount G of particulate removable by oxidation per second, or when the amount M of discharged particulate per 10 minutes is smaller than the amount G of particulate removable by oxidation per 10 minutes, that is, in the region I of FIG. 6, all of the particulate discharged from the combustion chamber 5 is removed by oxidation successively in a short time on the particulate filter 22 without emitting a luminous flame.

Figure 5A:
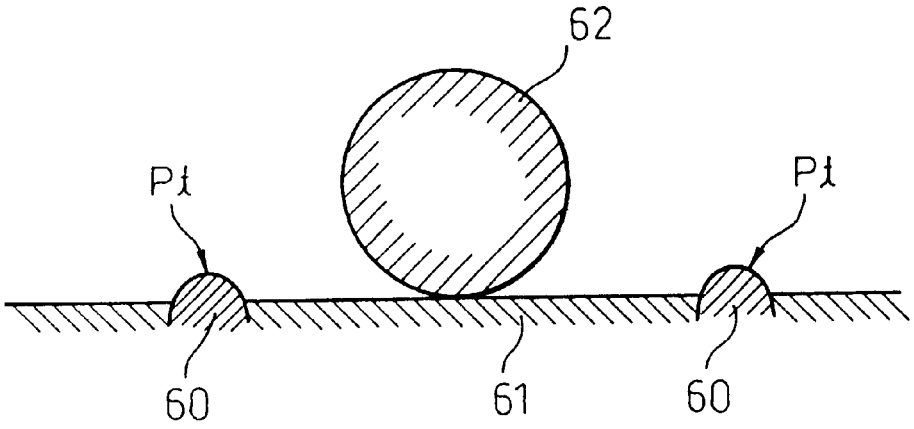
FIGS. 5A, 5B, and 5C are views for explaining an action of deposition of particulate.
Figure 5B:
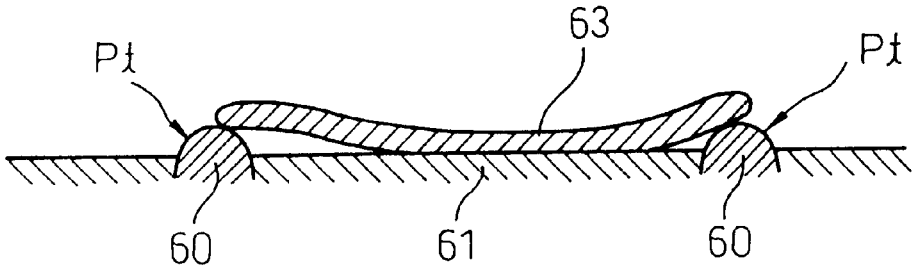
Figure 5C:
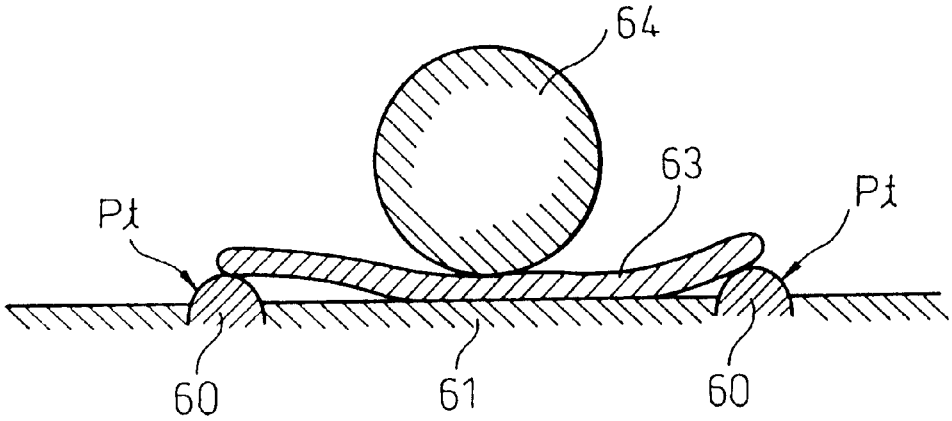

As opposed to this, when the amount M of discharged particulate is larger than the amount G of particulate removable by oxidation, that is, in the region II of FIG. 6, the amount of active oxygen is not sufficient for successive oxidation of all of the particulate. FIGS. 5A to 5C show the state of oxidation of particulate in this case.

That is, when the amount of active oxygen is not sufficient for successive oxidation of all of the particulate, if particulate 62 adheres on the active oxygen release agent 61 as shown in FIG. 5A, only part of the particulate 62 is oxidized. The portion of the particulate not sufficiently oxidized remains on the carrier layer. Next, if the state of insufficient amount, of active oxygen continues, the portions of the particulate not oxidized successively are left on the carrier layer. As a result, as shown in FIG. 5B, the surface of the carrier layer is covered by the residual particulate portion 63.

This residual particulate portion 63 covering the surface of the carrier layer gradually changes to hard-to-oxidize carbon and therefore the residual particulate portion 63 easily remains as it is. Further, if the surface of the carrier layer is covered by the residual particulate portion 63, the action of oxidation of the NO and $SO_2$ by the platinum Pt and the action of release of the active oxygen from the active oxygen release agent 61 are suppressed. As a result, as shown in FIG. 5C, other particulate 64 successively deposits on the residual particulate portion 63. That is, the particulate deposits in layers. If the particulate deposits in layers in this way, the particulate is separated in distance from the platinum Pt or the active oxygen release agent 61, so even if easily oxidizable particulate, it will not be oxidized by active oxygen O. Therefore, other particulate successively deposits on the particulate 64. That is, if the state of the amount M of discharged particulate being larger than the amount G of particulate removable by oxidation continues, particulate deposits in layers on the particulate filter 22 and therefore unless the temperature of the exhaust gas is made higher or the temperature of the particulate filter 22 is made higher, it is no longer possible to cause the deposited particulate to ignite and burn.

In this way, in the region I of FIG. 6, the particulate is burned in a short time on the particulate filter 22 without emitting a luminous flame. In the region II of FIG. 6, the particulate deposits in layers on the particulate filter 22. Therefore, to prevent the particulate from depositing in layers on the particulate filter 22, the amount M of discharged particulate has to be kept smaller than the amount G of the particulate removable by oxidation at all times.

As will be understood from FIG. 6, with the particulate filter 22 used in this embodiment of the present invention, the particulate can be oxidized even if the temperature TF of the particulate filter 22 is considerably low. Therefore, in a compression ignition type internal combustion engine shown in FIG. 1, it is possible to maintain the amount X of the discharged particulate and the temperature TF of the particulate filter 22 so that the amount M of discharged particulate normally becomes smaller than the amount G of the particulate removable by oxidation. Therefore, in this embodiment of the present invention, the amount M of discharged particulate and the temperature TF of the particulate filter 22 are maintained so that the amount M of discharged particulate usually becomes smaller than the amount G of the particulate removable by oxidation.

If the amount M of discharged particulate is maintained to be usually smaller than the amount G of particulate removable by oxidation in this way, the particulate no longer deposits in layers on the particulate filter 22. As a result, the pressure loss of the flow of exhaust gas in the particulate filter 22 is maintained at a substantially constant minimum pressure loss to the extent of being able to be said to not change much at all. Therefore, it is possible to maintain the drop in output of the engine at a minimum.

Further, the action of removal of particulate by oxidation of the particulate takes place even at a considerably low temperature. Therefore, the temperature of the particulate filter 22 does not rise that much at all and consequently there is almost no risk of deterioration of the particulate filter 22.

On the other hand, if particulate deposits on the particulate filter 22, the ash coagulates and as a result there is the danger of the particulate filter 22 clogging. In this case, the clogging occurs mainly due to the calcium sulfate $CaSO_4$. That is, fuel or lubrication oil contains calcium Ca. Therefore, the exhaust gas contains calcium Ca. This calcium Ca produces calcium sulfate $CaSO_4$ in the presence of $SO_3$. This calcium sulfate $CaSO_4$ is a solid and will not break down by heat even at a high temperature. Therefore, if calcium sulfate $CaSO_4$ is produced and the fine holes of the particulate filter 22 are clogged by this calcium sulfate $CaSO_4$, clogging occurs.

In this case, however, if an alkali metal or an alkali earth metal having a higher tendency toward ionization than calcium Ca, for example potassium K, is used as the active oxygen release agent 61, the $SO_3$ diffused in the active oxygen release agent 61 bonds with the potassium K to form potassium sulfate $K_2SO_4$. The calcium Ca passes through the partitions 54 of the particulate filter 22 and flows out into the exhaust gas outflow passage 51 without bonding with the $SO_3$. Therefore, there is no longer any clogging of fine holes of the particulate filter 22. Accordingly, as described above, it is preferable to use an alkali metal or an alkali earth metal having a higher tendency toward ionization than calcium Ca, that is, potassium K, lithium Li, cesium Cs, rubidium Rb, barium Ba, and strontium Sr, as the active oxygen release agent 61.

Now, in this embodiment of the present invention, the intention is basically to maintain the amount M of the discharged particulate smaller than the amount G of the particulate removable by oxidation in all operating states. In practice, however, it is almost impossible to reduce the amount M of discharged particulate from than the amount G of the particulate removable by oxidation in all operating states. For example, at the time of engine startup, the temperature of the particulate filter 22 is normally low and therefore at this time the amount M of discharged particulate becomes larger than the amount G of the particulate removable by oxidation. Therefore, in this embodiment of the present invention, except in special cases such as right after engine startup, in engine operating conditions where the amount M of discharged particulate can be made smaller than the amount G of the particulate removable by oxidation, the amount M of discharged particulate is made smaller than the amount G of the particulate removable by oxidation.

Even if the apparatus is designed so that the amount M of discharged particulate becomes smaller than the amount G of particulate removable by oxidation in this way, however, the particulate remaining after burning collects on the particulate filter 22 and forms large masses. The masses of particulate end up causing the fine holes of the particulate filter 22 to clog. If the fine holes of the particulate filter 22 clog, the pressure loss of the flow of exhaust gas at the particulate filter 22 becomes larger and as a result the engine output ends up falling. Therefore, it is necessary to prevent the fine holes of the particulate filter 22 from clogging as much as possible. If the fine holes of the particulate filter 22 clog, it is necessary to separate the masses of the particulate causing the clogging from the particulate filter 22 and discharge them to the outside.

Therefore, the present inventors engaged in repeated research and as a result learned that if the flow velocity of the exhaust gas flowing through the inside of the particulate filter 22 is increased for just an instant in a pulse-like manner, the masses of the particulate causing the clogging can be separated from the particulate filter 22 and discharged to the outside. That is, they learned that with just a fast flow velocity of exhaust gas flowing through the inside of the particulate filter 22, the masses of particulate will not separate much at all from the particulate filter 22, that, further, even if the flow velocity of the exhaust gas is reduced for an instant, the masses of the particulate will not separate from the particulate filter 22, and that to separate the masses of the particulate from the particulate filter 22 and discharge them to the outside, it is necessary to increase the flow velocity of the exhaust gas for just an instant in a pulse-like manner.

That is, if the flow velocity of the exhaust gas is increased for just an instant in a pulse-like manner, the high density exhaust gas becomes a pressure wave which flows through the inside of the particulate filter 22. It is believed that the pressure wave gives an impact force to the masses of the particulate for an instant and thereby causes the masses of the particulate to separate from the particulate filter 22 and be discharged to the outside.

At the time of engine acceleration operations the flow velocity of the exhaust gas increases in an instant. At this time, however, the flow velocity of the exhaust gas continues increasing. Therefore, at this time, the flow velocity of the exhaust gas is not increased for just an instant in a pulse-like manner. This being said, at the time of engine acceleration operation, the flow velocity of the exhaust gas is increased for an instant, so masses of the particulate will separate from the particulate filter 22, though in a small amount, and be discharged to the outside.

In this case, to separate a large amount of masses of particulate from the particulate filter 22 and discharge it to the outside, it is necessary to cause an instantaneous increase in the flow velocity of the exhaust gas larger than the instantaneous increase in the flow velocity of the exhaust gas at the time of acceleration. Therefore, it is preferable to store the exhaust energy and cause an increase in the flow velocity of the exhaust gas for just an instant in a pulse-like manner.

Therefore, in this embodiment of the present invention, an exhaust throttle valve 45 is used as one means for storing the exhaust energy and causing an increase in the flow velocity of the exhaust gas for just an instant in a pulse-like manner. That is, if the exhaust throttle valve 45 is closed, the back pressure inside the exhaust passage upstream of the exhaust throttle valve 45 becomes higher. Next, if the exhaust throttle valve 45 is fully opened, the flow velocity of the exhaust gas is increased for just an instant in a pulse-like manner and therefore the masses of particulate deposited on the surface of the partition walls 54 (FIG. 3) of the particulate filter 22 and inside the fine holes of the particulate filter 22 are pulled off from the surface of the partition walls 54 or inside wall surfaces of the fine holes. That is, the masses of the particulate are separated from the particulate filter 22. Next, the masses of the particulate separated are discharged to the outside of the particulate filter 22.

In this case, once the exhaust throttle valve 45 is fully closed, the back pressure inside the exhaust passage upstream of the exhaust throttle valve 45 becomes extremely high and therefore the increase in the flow velocity of the exhaust gas when the exhaust throttle valve 45 is fully opened becomes extremely large. As a result, an extremely powerful pressure wave is created and therefore the large amount of masses of particulate is separated from the particulate filter 22 and discharged.

Further, if an exhaust throttle valve 45 is arranged downstream of the particulate filter 22 as shown in FIG. 1, when the exhaust throttle valve 45 is fully closed, a high back pressure acts on the particulate filter 22. If a high back pressure acts on the particulate filter 22, a high pressure acts on the masses of particulate, so the masses of the particulate deform and part of the masses of particulate, in some cases all, is separated from the surface deposited on the particulate filter 22. As a result, when the exhaust throttle valve 45 is fully opened, the masses of particulate are separated from the particulate filter 22 more and discharged.

In this embodiment of the present invention, the exhaust throttle valve 45 is controlled by a predetermined control timing. In the embodiment shown in FIGS. 7A and 7B, the exhaust throttle valve 45 is fully closed temporarily from the fully opened state, then fully opened in an instant from the fully closed state cyclically every constant time interval or every time the distance traveled by the vehicle reaches a predetermined constant distance. Note that when the exhaust throttle valve 45 is fully closed from the fully opened state, in the example shown in FIG. 7A, the exhaust throttle valve 45 is fully closed in an instant, while in the example shown in FIG. 7B, the exhaust throttle valve 45 is gradually closed.

Further, if the exhaust throttle valve 45 is fully closed, the engine output falls. Therefore, in the example shown in FIGS. 7A and 7B, when the exhaust throttle valve 45 is closed, the amount of injection of fuel is increased so that the output of the engine does not fall.

Figure 8:
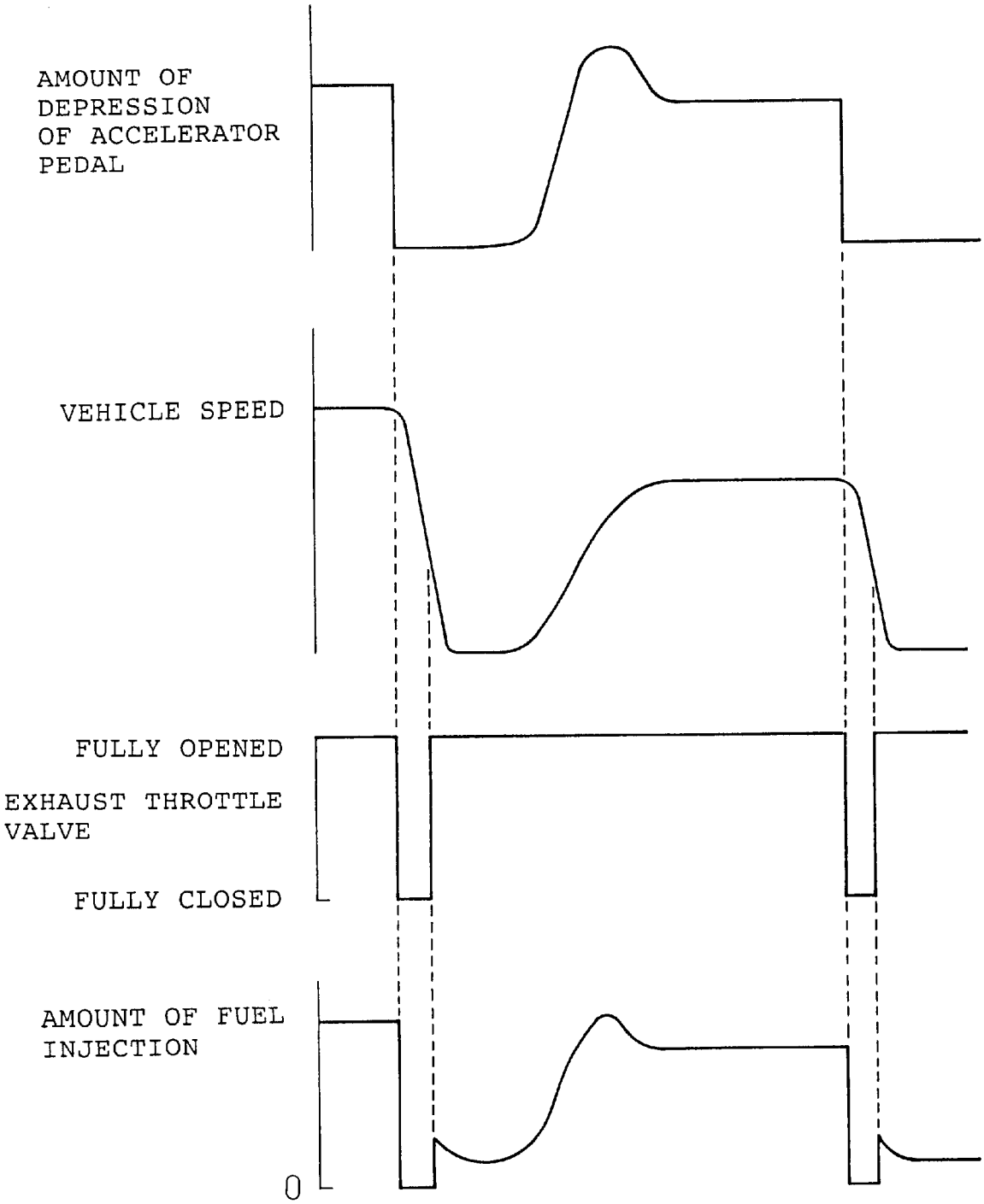
FIG. 8 is a time chart of the change of the opening degree of the exhaust throttle valve.

In the embodiment shown in FIG. 8, at the time of deceleration operation of a vehicle, the exhaust throttle valve 45 is fully closed temporarily from the fully opened state, then is again fully opened instantaneously during engine deceleration operation. In this embodiment, the exhaust throttle valve 45 also plays the role of causing an engine braking action. That is, if the exhaust throttle valve 45 is fully closed at the time of deceleration operation, an engine braking force is generated since the engine acts as a pump increasing the back pressure. Next, when the exhaust throttle valve 45 is fully opened, the masses of the particles are separated from the particulate filter 22 and discharged. Note that in the example shown in FIG. 8, when deceleration operation is started, the injection of fuel is stopped. While the injection of fuel is stopped, the exhaust throttle valve 45 is fully closed.

Figure 7A:
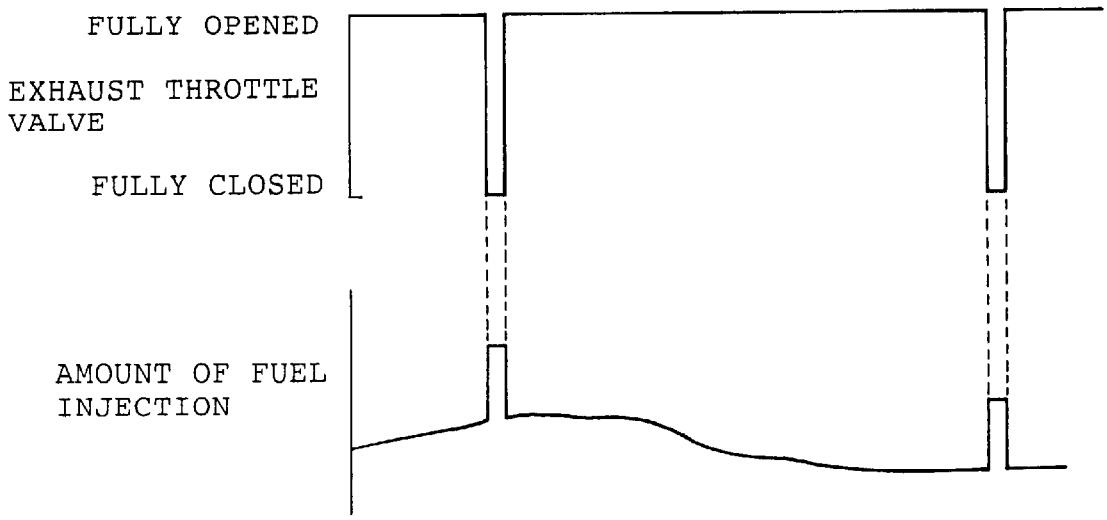
FIGS. 7A and 7B are time charts of the change of the opening degree of the exhaust throttle valve etc.
Figure 7B:
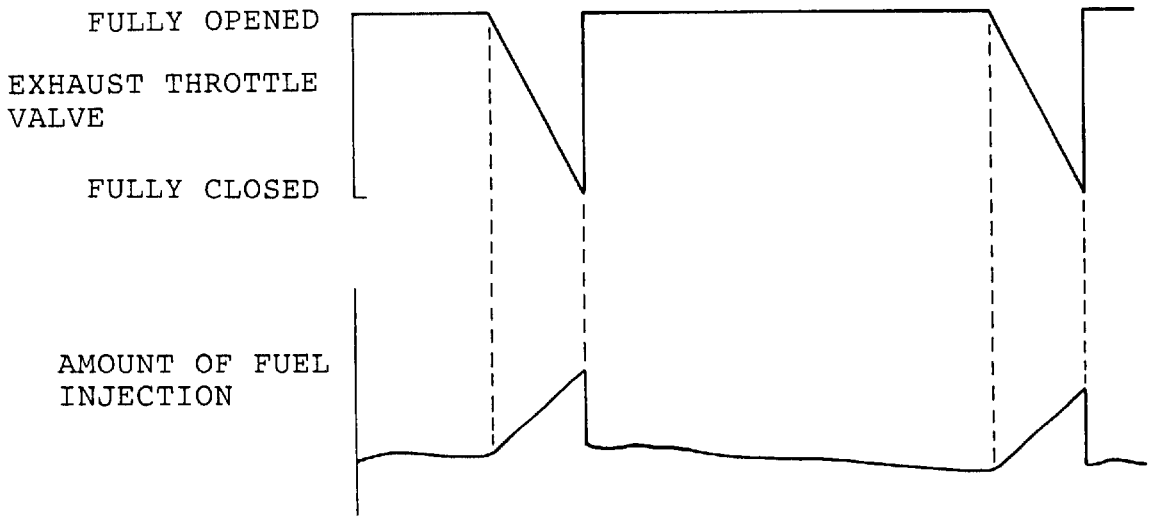
Figure 9:
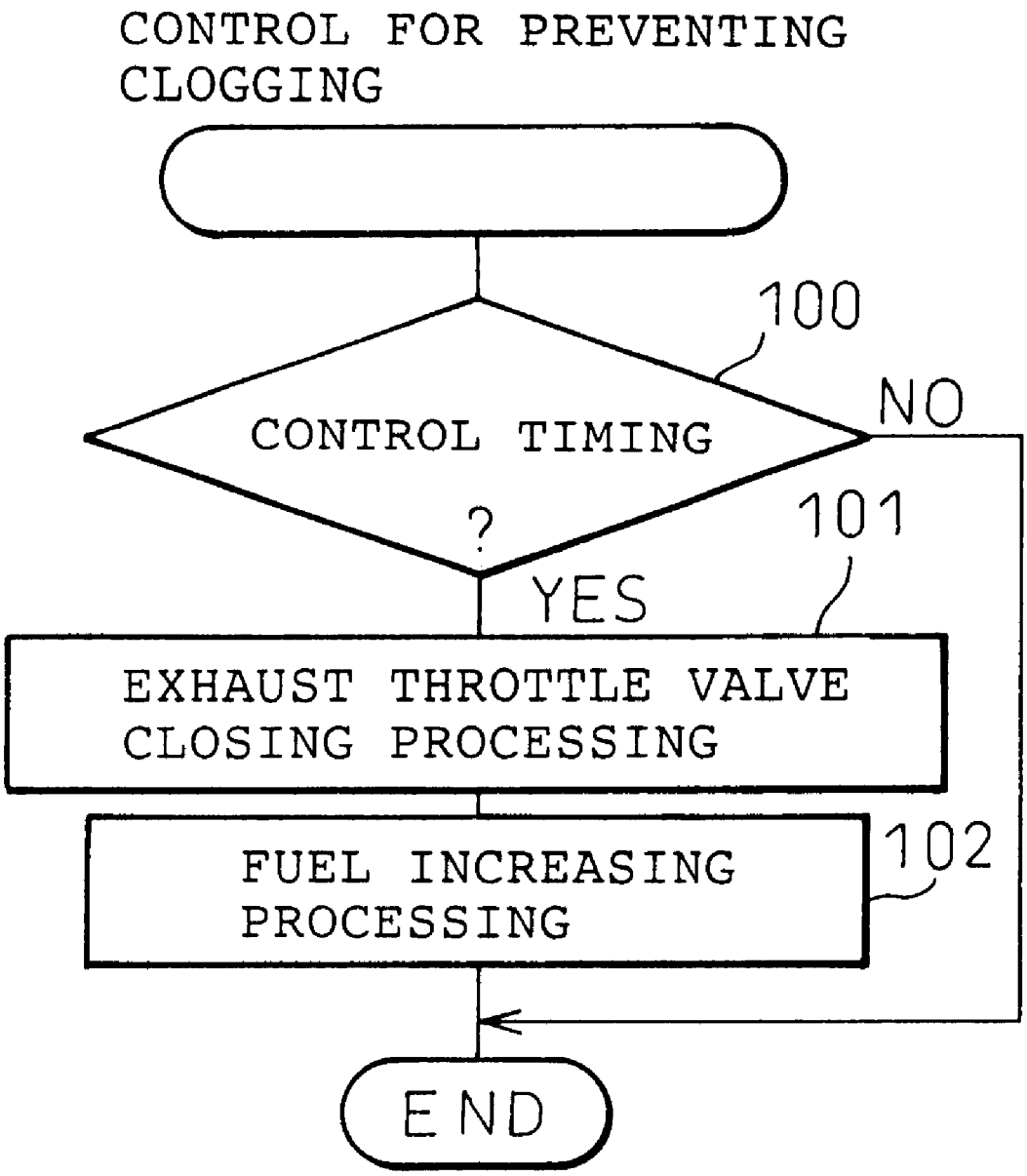
FIG. 9 is a flow chart for control for prevention of clogging.

FIG. 9 shows a routine for executing the control for preventing clogging shown in FIGS. 7A and 7B and FIG. 8.

Referring to FIG. 9, first, at step 100, it is judged if the timing is that for control for preventing clogging. In the embodiment shown in FIGS. 7A and 7B, it is judged that the timing is that for control for preventing clogging every constant time interval or every constant distance of travel, while in the embodiment shown in FIG. 8, it is judged that the timing is that for control for preventing clogging when the engine is in deceleration operation. When the timing is that for control for preventing clogging, the routine proceeds to step 101, where the exhaust throttle valve 45 is temporarily closed, then at step 102, the amount of injected fuel is increased while the exhaust throttle valve 45 is closed.

Figure 10:
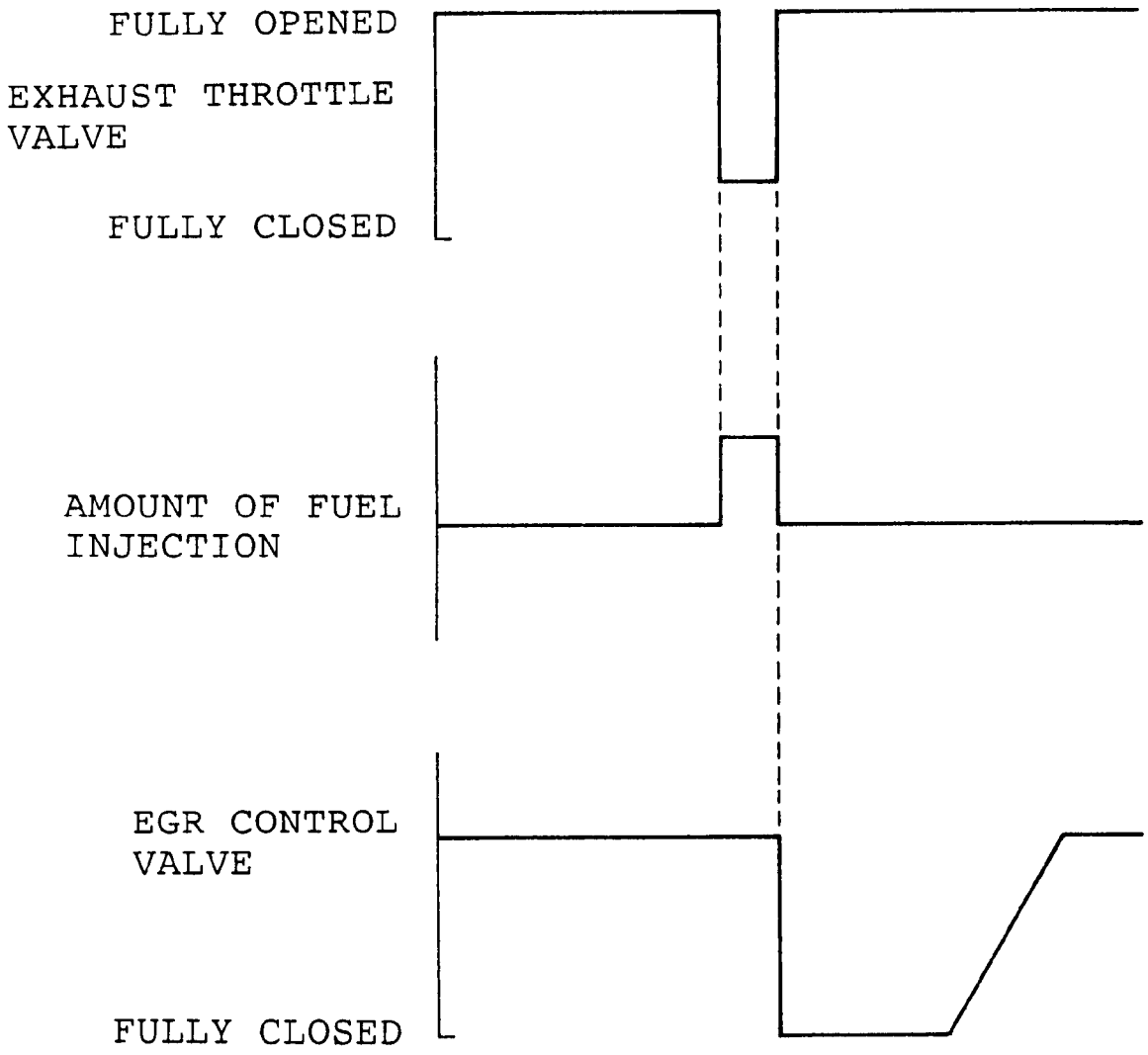
FIG. 10 is a time chart of the change of the opening degree of the exhaust throttle valve.

In the embodiment shown in FIG. 10, when the timing reaches that for control for preventing clogging, the exhaust throttle valve 45 is temporarily closed, then the exhaust throttle valve 45 is instantaneously opened. At this time, the EGR control valve 25 is instantaneously fully closed. If the EGR control valve 25 is fully closed, the exhaust gas sent from the exhaust passage to the inside of the intake passage becomes zero, so the back pressure rises. Further, the amount of intake air increases and the amount of exhaust gas increases, so the back pressure further rises. Therefore, the amount of instantaneous increase of the flow velocity of the exhaust gas when the exhaust throttle valve 45 is fully opened is increased much more. Next, the EGR control valve 25 is gradually opened. Note that when closing the exhaust throttle valve 45, it is also possible to fully close the exhaust throttle valve 45.

Figure 11:
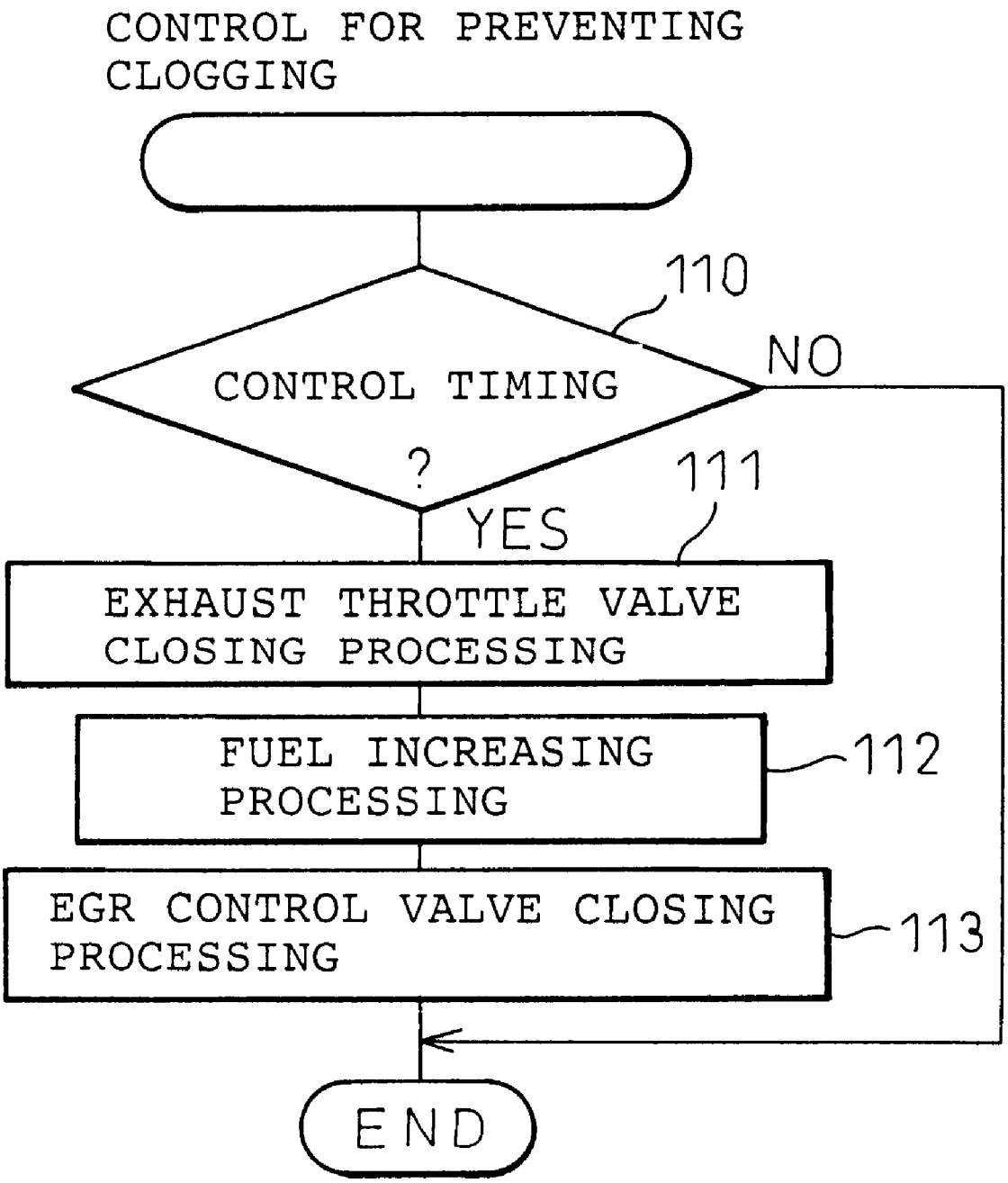
FIG. 11 is a flow chart for control for prevention of clogging.

FIG. 11 shows the routine for executing the control for preventing clogging shown in FIG. 10.

Referring to FIG. 11, first, at step 110, it is judged if the timing is that for control for preventing clogging. When the timing is that for control for preventing clogging, the routine proceeds to step 111, where the exhaust throttle valve 45 is temporarily closed, then at step 112, the amount of injected fuel is increased while the exhaust throttle valve 45 is closed. Next, at step 113, processing is performed for temporarily fully closing the EGR control valve 25.

Figure 12:
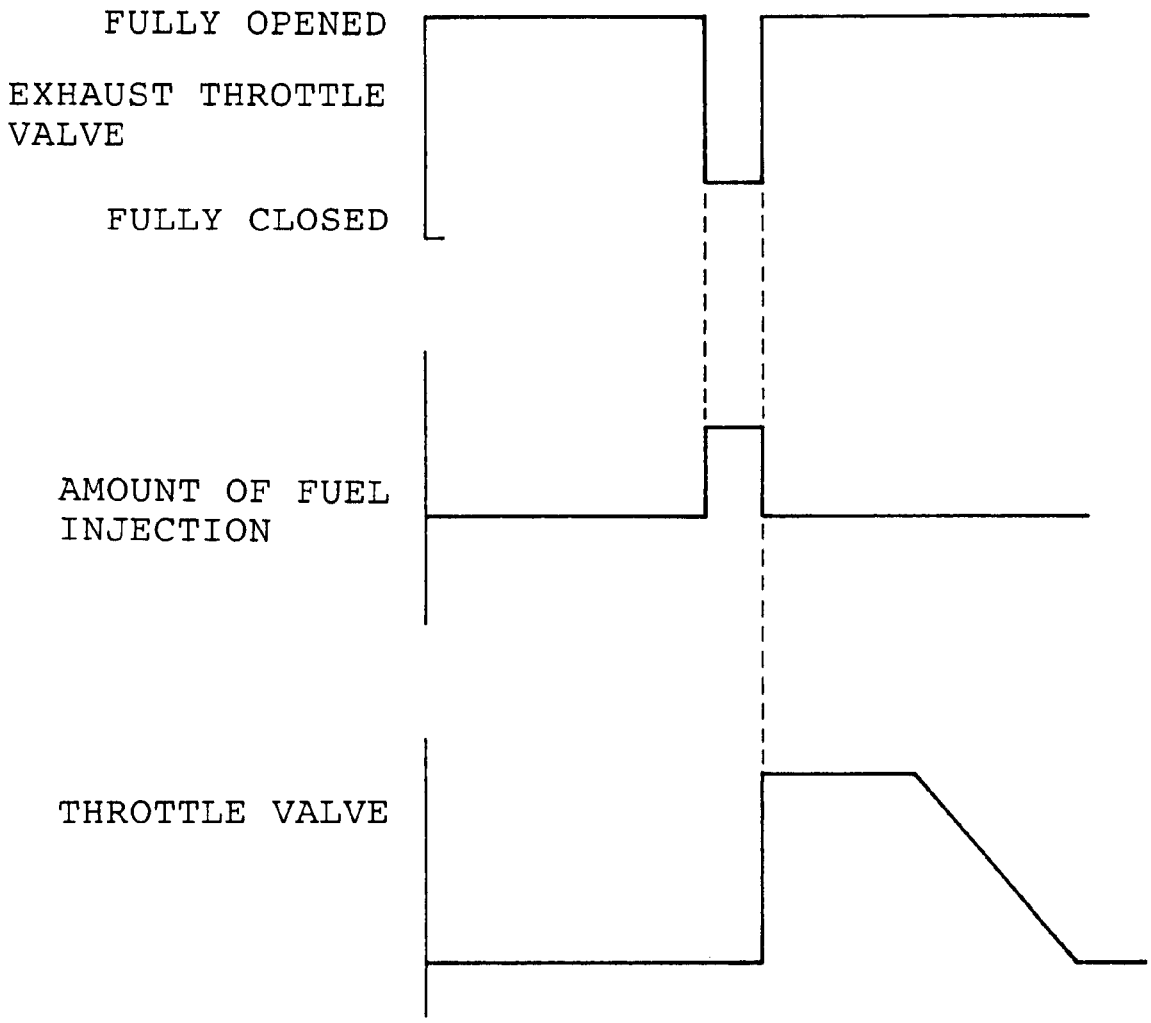
FIG. 12 is a time chart of the change of the opening degree of the exhaust throttle valve.

In the embodiment shown in FIG. 12, when the timing reaches that for control for preventing clogging, the exhaust throttle valve 45 is temporarily closed, then the exhaust throttle valve 45 is instantaneously opened. At this time, the throttle valve 17 is instantaneously fully opened. If the throttle valve 17 is opened, the amount of intake air increases and the amount of exhaust gas increases, so the back pressure further rises. Therefore, the amount of instantaneous increase of the flow velocity of the exhaust gas when the exhaust throttle valve 45 is fully opened is increased much more. Next, the throttle valve 17 is gradually closed. Note that when closing the exhaust throttle valve 45, it is also possible to fully close the exhaust throttle valve 45.

Figure 13:
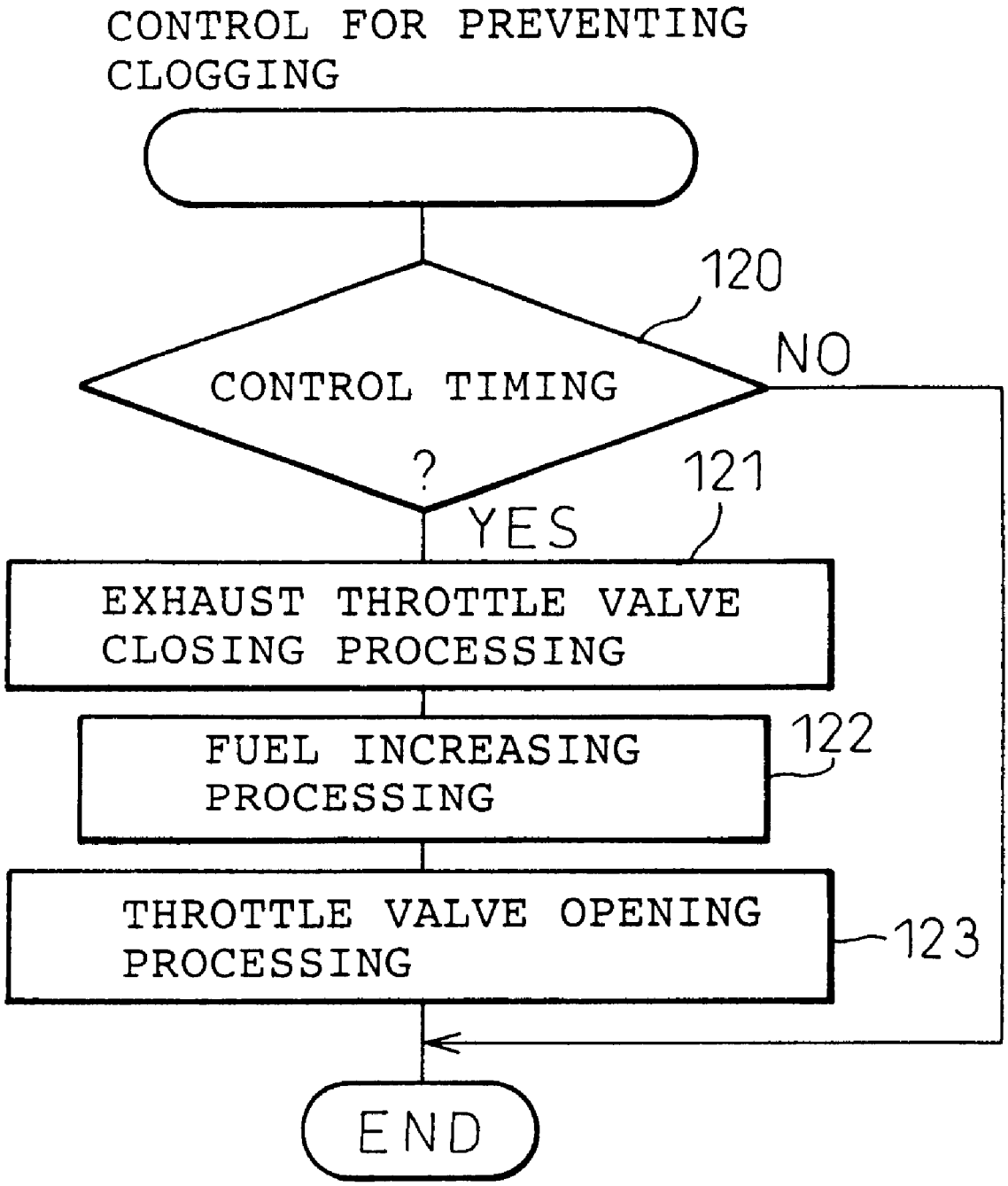
FIG. 13 is a flow chart for control for prevention of clogging.

FIG. 13 shows the routine for executing the control for preventing clogging shown in FIG. 12.

Referring to FIG. 13, first, at step 120, it is judged if the timing is that for control for preventing clogging. When the timing is that for control for preventing clogging, the routine proceeds to step 121, where the exhaust throttle valve 45 is temporarily closed, then at step 122, the amount of injected fuel is increased while the exhaust throttle valve 45 is closed. Next, at step 123, processing is performed for temporarily fully opening the throttle valve 17.

Next, an embodiment in which the amount of particulate deposited on the particulate filter 22 is estimated and when the amount of particulate estimated exceeds a predetermined limit value, the exhaust throttle valve 45 is temporarily fully closed from the fully open state, then is again instantaneously fully opened will be explained.

Figure 14A:
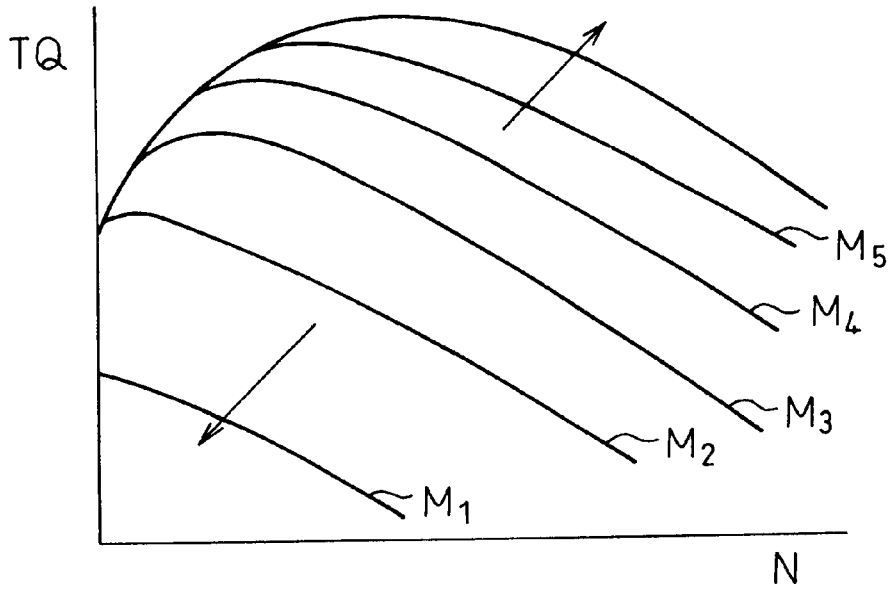
FIGS. 14A and 14B are views of the amount of particulate discharged.

Therefore, first, the method of estimating the amount of particulate deposited on the particulate filter 22 will be explained. In this embodiment, the deposited particulate is estimated using the amount M of deposited particulate discharged from the combustion chamber 5 per unit time and the amount G of particulate removable by oxidation shown in FIG. 6. That is, the amount M of deposited particulate changes according to the type of the engine, but when the engine type is determined, the amount M becomes a function of the required torque TQ and the engine speed N. FIG. 14A shows the amount M of discharged particulate of an internal combustion engine shown in FIG. 1. The curves $M_1$, $M_2$, $M_3$, $M_4$, and $M_5$ show equivalent amounts of discharged particulate ($M_1<M_2<M_3<M_4<M_5$). In the example shown in FIG. 14A, the higher the required torque TQ, the greater the amount M of discharged particulate. Note that the amount M of discharged particulate shown in FIG. 14A is stored in advance in the ROM 32 in the form of a map as a function of the required torque TQ and the engine speed N.

Figure 14B:
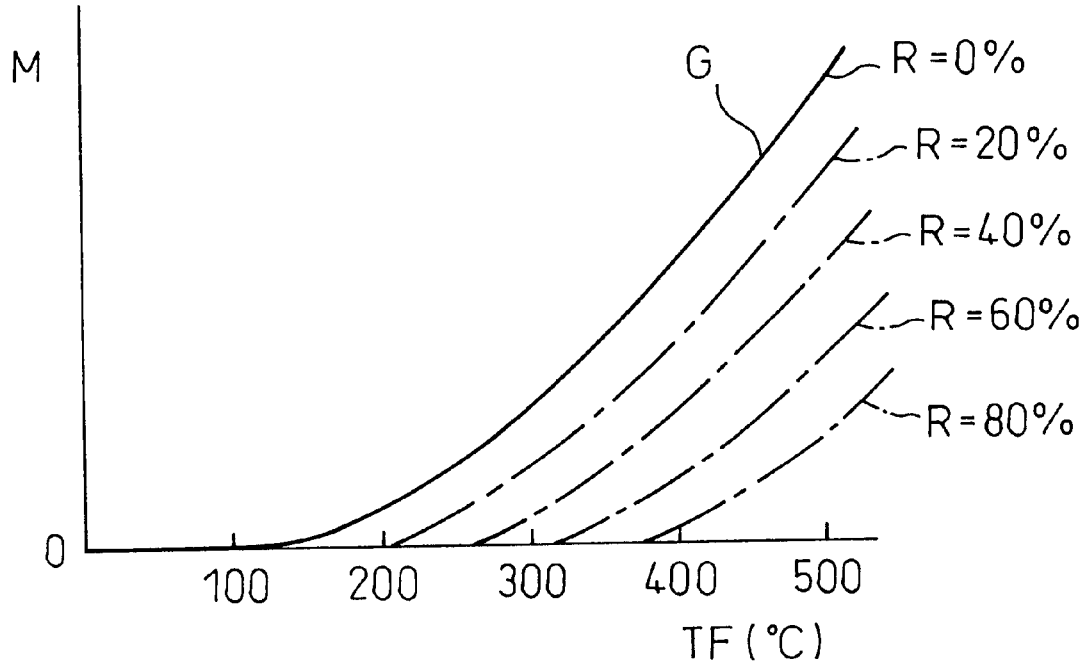

Considering the amount per unit time, during this time, the amount $\Delta G$ of particulate deposited on the particulate filter 22 can be expressed by the difference (M−G) of the amount M of discharged particulate and amount G of particulate removable by oxidation. Therefore, by cumulatively adding the amount $\Delta G$ of particulate deposited, the total amount $\Sigma\Delta G$ of particulate deposited is obtained. On the other hand, when M<G, the depositing particulate is gradually removed by oxidation, but at this time, the ratio of the amount of deposited particulate removable by oxidation becomes greater the smaller the amount M of discharged particulate as shown by R in FIG. 14B and becomes greater the higher the temperature TF of the particulate filter 22. That is, the amount of deposited particulate removable by oxidation when M<G becomes $R\cdot\Sigma\Delta G$. Therefore, when M<G, the amount of deposited particulate remaining can be estimated as $\Sigma\Delta G-R\cdot\Sigma\Delta G$.

In this embodiment, the exhaust throttle valve 45 is controlled when the estimated amount of deposited particulate ($\Sigma\Delta G-R\cdot\Sigma\Delta G$) exceeds a limit value $G_0$.

Figure 15:
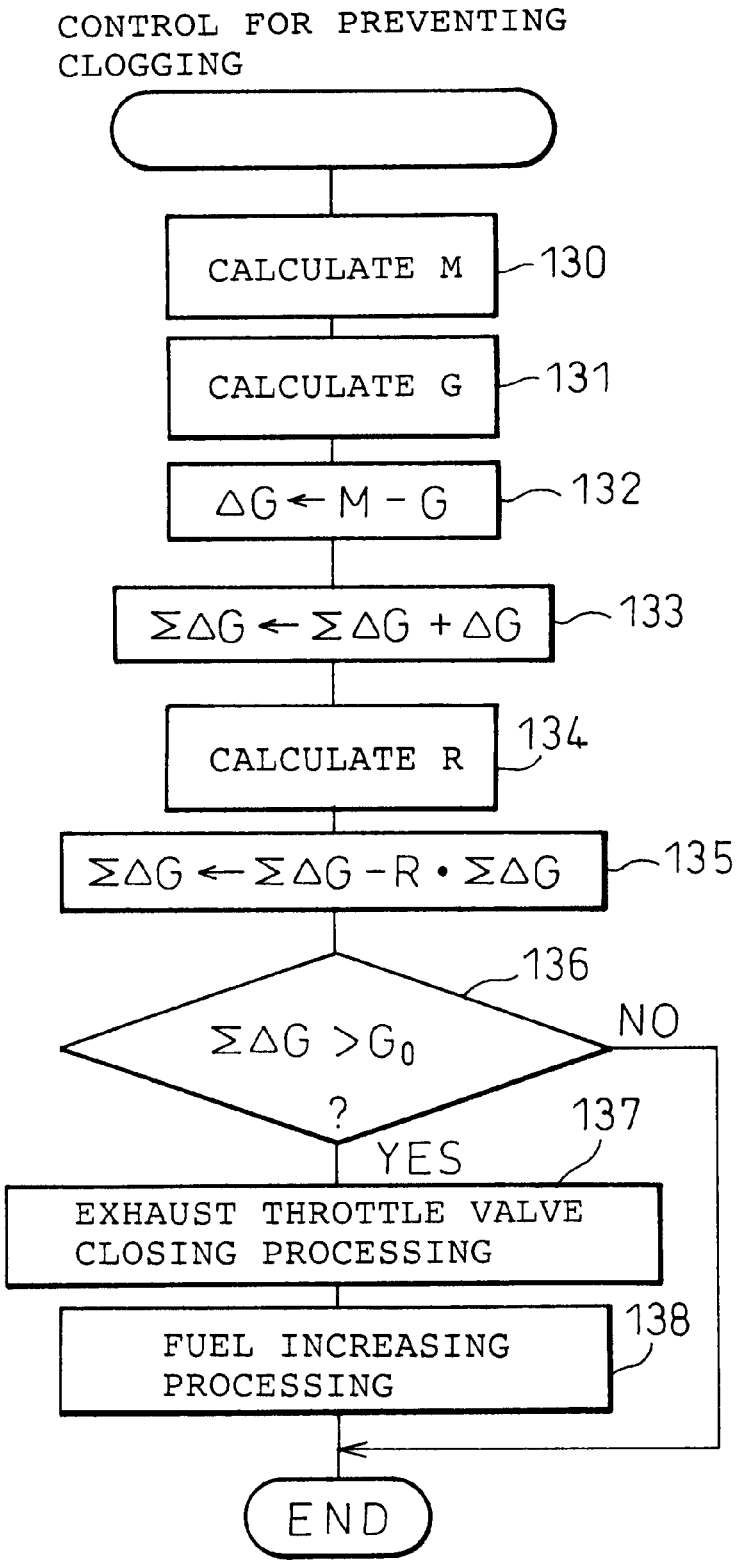
FIG. 15 is a flow chart for control for prevention of clogging.

FIG. 15 shows a routine for control for preventing clogging for working this embodiment.

Referring to FIG. 15, first, at step 130, the amount M of deposited particulate is calculated from the relationship shown in FIG. 14A. Next, at step 131, the amount G of particulate removable by oxidation is calculated from the relation shown in FIG. 6. Next, at step 132, the amount $\Delta G$ of deposited particulate per unit time (=M−G) is calculated, then at step 133, the total amount $\Sigma\Delta G$ ($=\Sigma\Delta G+\Delta G$) of the deposited particulate is calculated. Next, at step 134, the ratio R of removal by oxidation of the deposited particulate is calculated from the relationship shown in FIG. 14B. Next, at step 135, the amount $\Sigma\Delta G$ of deposited particulate remaining ($=\Sigma\Delta G-R\cdot\Sigma\Delta G$) is calculated.

Next, at step 136, it is determined if the amount $\Sigma\Delta G$ of deposited particulate remaining is larger than the limit value $G_0$. When $\Sigma\Delta G>G_0$, the routine proceeds to step 137, where the exhaust throttle valve 45 is temporarily closed, then at step 138 the amount of injected fuel is increased while the exhaust throttle valve 45 is closed.

Figure 16:
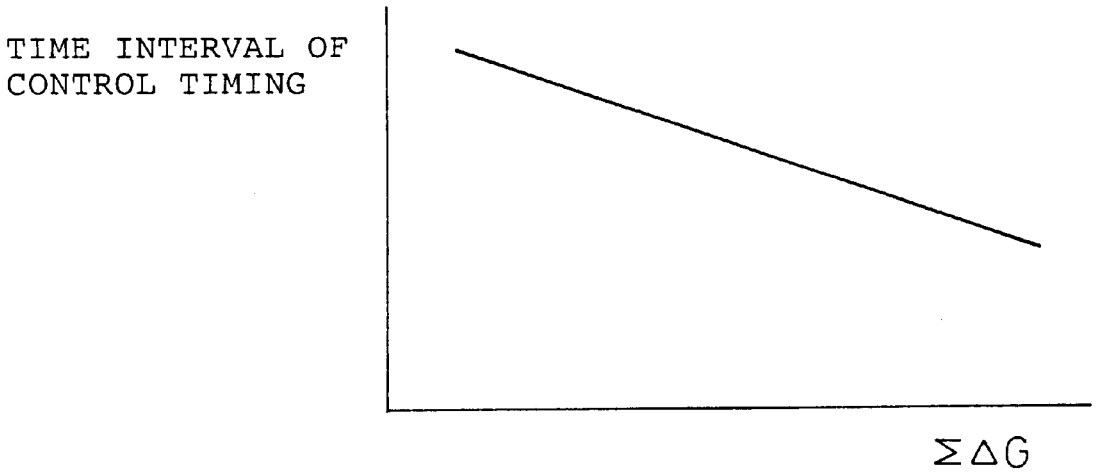
FIG. 16 is a view of the control timing.

FIG. 16 shows another embodiment. It is believed that the greater the amount $\Sigma\Delta G$ of deposited particulate remaining on the particulate filter 22, the greater the amount of masses of particulate on the particulate filter 22. Therefore, it can be said to be preferably to separate and discharge the masses of particulate from the particulate filter 22 at time intervals which are shorter the greater the amount $\Sigma\Delta G$ of deposited particulate. Therefore, in this embodiment, as shown in FIG. 16, the greater the amount $\Sigma\Delta G$ of deposited particulate, the shorter the time interval in the timing of control for preventing clogging.

Figure 17:
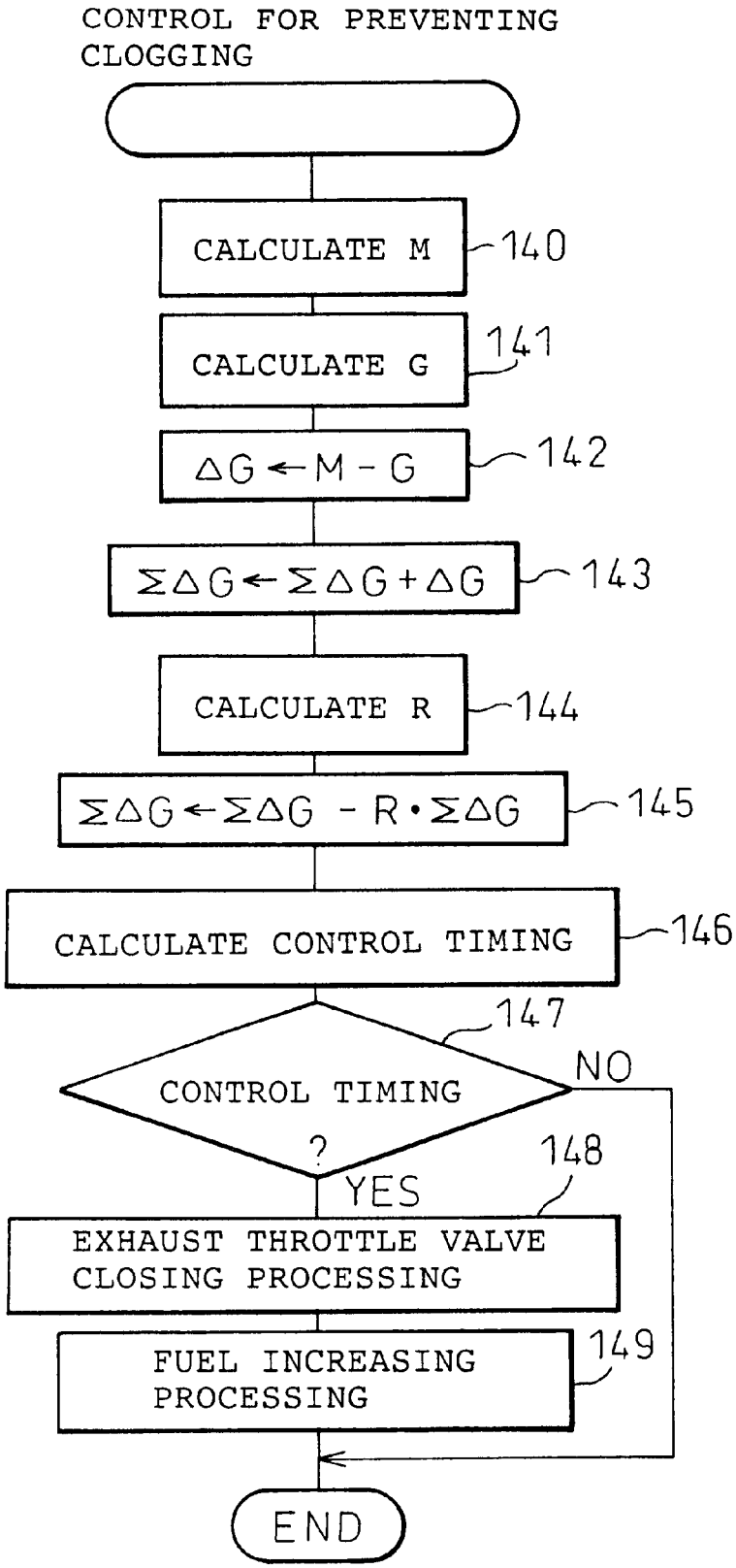
FIG. 17 is a flow chart for control for prevention of clogging.

FIG. 17 shows the routine for control for preventing clogging for working this embodiment.

Referring to FIG. 17, first, at step 140, the amount M of deposited particulate is calculated from the relationship shown in FIG. 14A. Next, at step 141, the amount G of particulate removable by oxidation is calculated from the relation shown in FIG. 6. Next, at step 142, the amount $\Delta G$ of deposited particulate per unit time (=M−G) is calculated, then at step 143, the total amount $\Sigma\Delta G$ ($=\Sigma\Delta G+\Delta G$) of the deposited particulate is calculated. Next, at step 144, the ratio R of removal by oxidation of the deposited particulate is calculated from the relationship shown in FIG. 14B. Next, at step 145, the amount $\Sigma\Delta G$ of deposited particulate remaining ($=\Sigma\Delta G-R\cdot\Sigma\Delta G$) is calculated. Next, at step 146, the timing for control for preventing clogging is determined from the relationship shown in FIG. 16.

Next, at step 147, it is determined if the timing is that for control for preventing clogging. When the timing is that for control for preventing clogging, the routine proceeds to step 148, where the exhaust throttle valve 45 is temporarily closed, then at step 149, the amount of injected fuel is increased while the exhaust throttle valve 45 is closed.

Figure 18A:
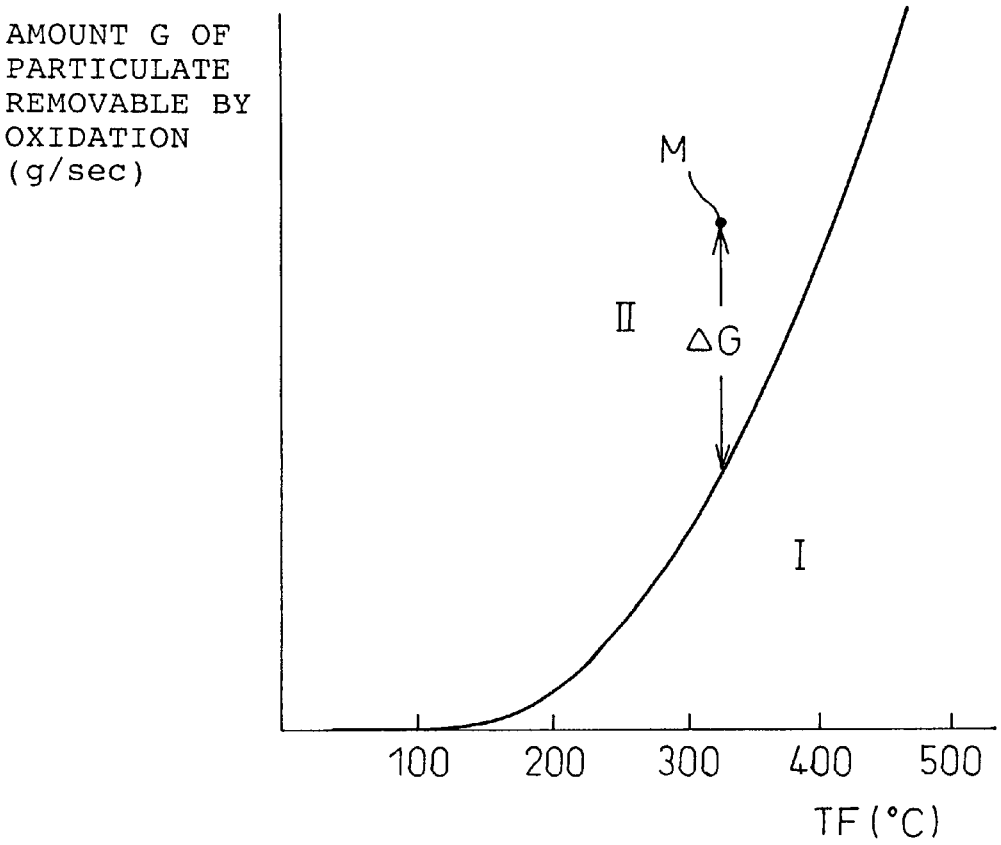
FIGS. 18A and 18B are views of the amount of particulate removable by oxidation.
Figure 18B:
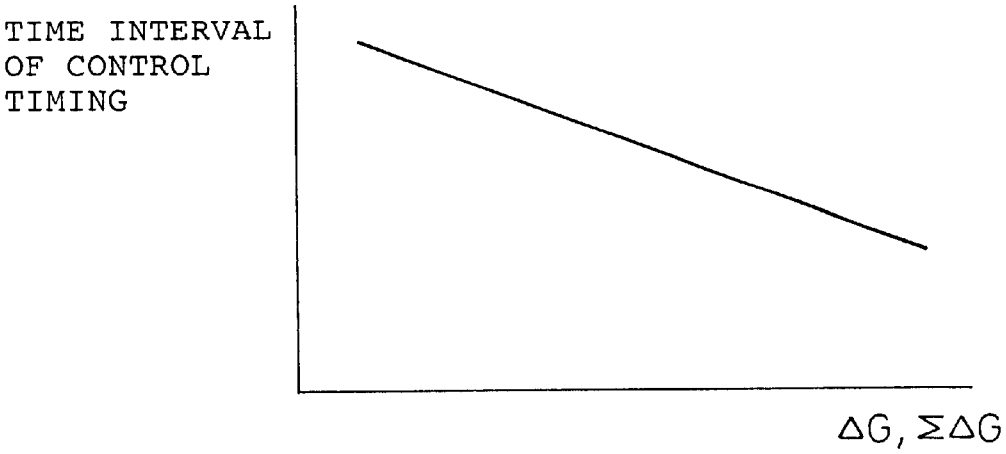

FIGS. 18A and 18B show another embodiment. If the difference $\Delta G$ of the amount M of deposited particulate and amount G of particulate removable by oxidation shown in FIG. 18A becomes larger or the total amount $\Sigma\Delta G$ of deposited particulate becomes greater, the possibility rises that a large amount of masses of particulate will deposit in the future. Therefore, in this embodiment, as shown in FIG. 18B, the time interval of the timing for control for preventing clogging is shortened the greater the difference the difference $\Delta G$ or total amount $\Sigma\Delta G$.

Figure 19:
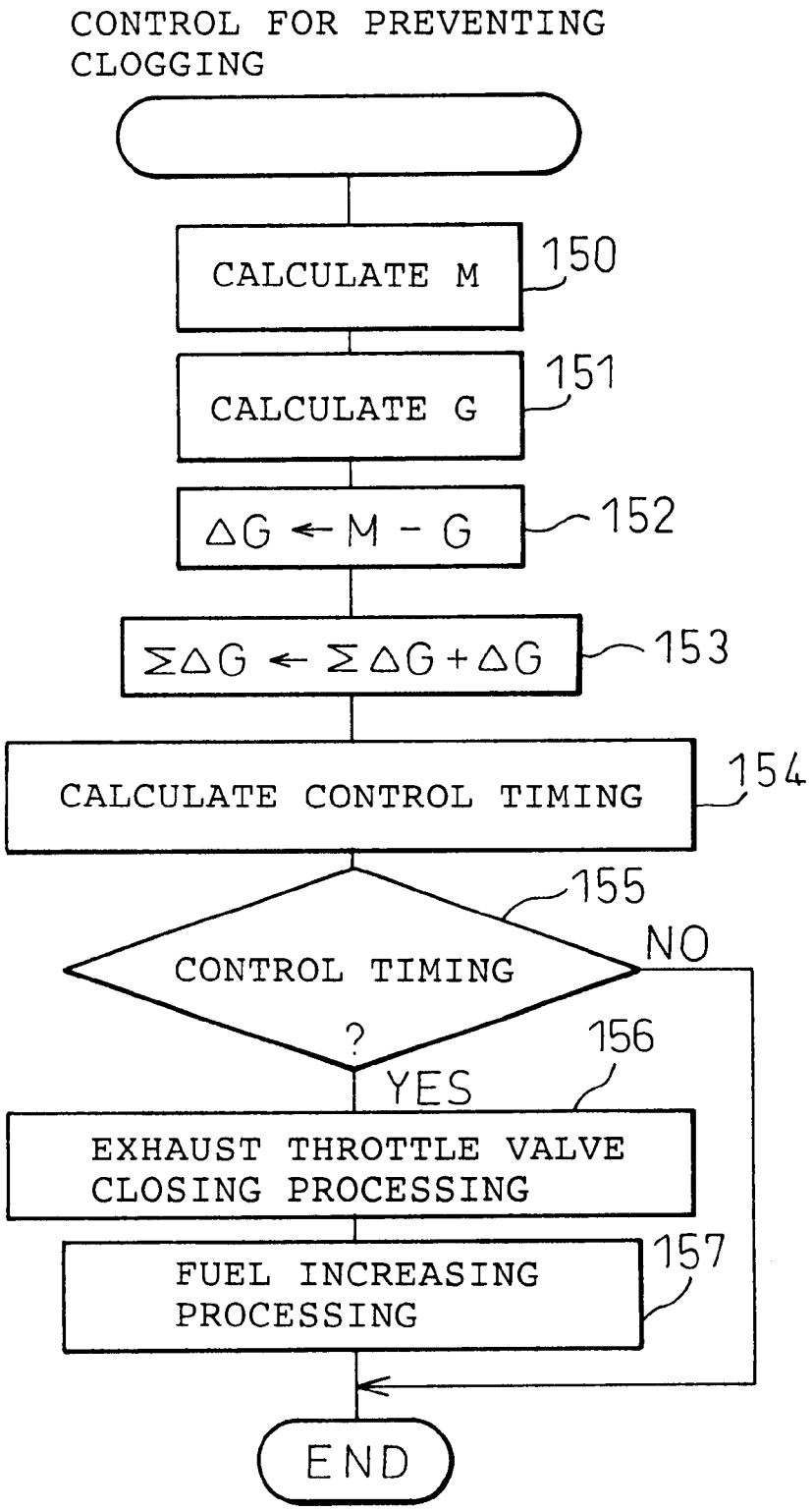
FIG. 19 is a flow chart for control for prevention of clogging.

FIG. 19 shows the routine for control for preventing clogging wherein the time interval of the timing for control for preventing clogging is shortened the greater the total amount $\Sigma\Delta G$.

Referring to FIG. 19, first, at step 150, the amount M of deposited particulate is calculated from the relationship shown in FIG. 14A. Next, at step 151, the amount G of particulate removable by oxidation is calculated from the relation shown in FIG. 6. Next, at step 152, the amount $\Delta G$ of deposited particulate per unit time (=M−G) is calculated, then at step 153, the total amount $\Sigma\Delta G$ (=$\Sigma\Delta G+\Delta G$) of the deposited particulate is calculated. Next, at step 154, the timing for control for preventing clogging is determined from the relationship shown in FIG. 18B.

Next, at step 155, it is determined if the timing is that for control for preventing clogging. When the timing is that for control for preventing clogging, the routine proceeds to step 156, where the exhaust throttle valve 45 is temporarily closed, then at step 157, the amount of injected fuel is increased while the exhaust throttle valve 45 is closed.

Note that in the embodiments explained above, a layer of a carrier comprised of alumina is for example formed on the two side surfaces of the partitions 54 of the particulate filter 22 and the inside walls of the fine holes in the partitions 54. A precious metal catalyst and active oxygen release agent are carried on this carrier. Further, the carrier may carry an $NO_x$ absorbent which absorbs the $NO_x$ contained in the exhaust gas when the air-fuel ratio of the exhaust gas flowing into the particulate filter 22 is lean and releases the absorbed $NO_x$ when the air-fuel ratio of the exhaust gas flowing into the particulate filter 22 becomes the stoichiometric air-fuel ratio or rich.

In this case, as explained above, according to the present invention, platinum Pt is used as the precious metal catalyst. As the $NO_x$ absorbent, use is made of at least one of an alkali metal such as potassium K, sodium Na, lithium Li, cesium Cs, and rubidium Rb, an alkali earth metal such as barium Ba, calcium Ca, and strontium Sr, and a rare earth such as lanthanum La and yttrium Y. Note that as will be understood by a comparison with the metal comprising the above active oxygen release agent, the metal comprising the $NO_x$ absorbent and the metal comprising the active oxygen release agent match in large part.

In this case, it is possible to use different metals or to use the same metal as the $NO_x$ absorbent and the active oxygen release agent. When using the same metal as the $NO_x$ absorbent and the active oxygen release agent, the function as a $NO_x$ absorbent and the function of an active oxygen release agent are simultaneously exhibited.

Next, an explanation will be given of the action of absorption and release of $NO_x$ taking as an example the case of use of platinum Pt as the precious metal catalyst and use of potassium K as the $NO_x$ absorbent.

First, considering the action of absorption of $NO_x$, the $NO_x$ is absorbed in the $NO_x$, absorbent by the same mechanism as the mechanism shown in FIG. 4A. However, in this case, in FIG. 4A, reference numeral 61 indicates the $NO_x$ absorbent.

That is, when the air-fuel ratio of the exhaust gas flowing into the particulate filter 22 is lean, since a large amount of excess oxygen is contained in the exhaust gas, if the exhaust gas flows into the exhaust gas inflow passages 50 of the particulate filter 22, as shown in FIG. 4A, the oxygen $O_2$ adheres to the surface of the platinum Pt in the form of $O_2^-$ or $O^{2-}$. on the other hand, the NO in the exhaust gas reacts with the $O_2^-$ or $O_2^{--}$ on the surface of the platinum Pt to become $NO_2$ ($2NO+O_2 \rightarrow 2NO_2$). Next, part of the $NO_2$ which is produced is absorbed in the $NO_x$ absorbent 61 while being oxidized on the platinum Pt and diffuses in the NO, absorbent 61 in the form of nitrate ions $NO_3^-$ as shown in FIG. 4A while bonding with the potassium K. Part of the nitrate ions $NO_3^-$ produces potassium nitrate $KNO_3$. In this way, NO is absorbed in the $NO_x$ absorbent 61.

On the other hand, when the exhaust gas flowing into the particulate filter 22 becomes rich, the nitrate ions $NO_3^-$ are broken down into oxygen O and NO and then NO is successively released from the $NO_x$ absorbent 61. Therefore, when the air-fuel ratio of the exhaust gas flowing into the particulate filter 22 becomes rich, the NO is released from the NO, absorbent 61 in a short time. Further, the released NO is reduced, so NO is not discharged into the atmosphere.

Note that in this case, even if the air-fuel ratio of the exhaust gas flowing into the particulate filter 22 is the stoichiometric air-fuel ratio, NO is released from the $NO_x$ absorbent 61. In this case, however, since the NO is only released gradually from the $NO_x$ absorbent 61, it takes a somewhat long time for all of the $NO_x$ absorbed in the $NO_x$ absorbent 61 to be released.

As explained above, however, it is possible to use different metals for the $NO_x$ absorbent and the active oxygen release agent or possible to use the same metal for the $NO_x$ absorbent and the active oxygen release agent. If the same metal is used for the NO, absorbent and the active oxygen release agent, as explained earlier, the function of the $NO_x$ absorbent and the function of the active oxygen release agent are performed simultaneously. An agent which performs these two functions simultaneously will be called an active oxygen release agent/$NO_x$ absorbent from here on. In this case, reference numeral 61 in FIG. 4A shows an active oxygen release agent/$NO_x$ absorbent.

When using such an active oxygen release agent/$NO_x$ absorbent 61, when the air-fuel ratio of the exhaust gas flowing into the particulate filter 22 is lean, the NO contained in the exhaust gas is absorbed in the active oxygen release agent/$NO_x$ absorbent 61. If the particulate contained in the exhaust gas adheres to the active oxygen release agent/$NO_x$ absorbent 61, the particulate is removed by oxidation in a short time by the active oxygen contained in the exhaust gas and the active oxygen released from the active oxygen release agent/$NO_x$ absorbent 61. Therefore, at this time, it is possible to prevent the discharge of both the particulate and $NO_x$ in the exhaust gas into the atmosphere.

On the other hand, when the air-fuel ratio of the exhaust gas flowing into the particulate filter 22 becomes rich, NO is released from the active oxygen release agent/$NO_x$ absorbent 61. This NO is reduced by the unburned hydrocarbons and CO and therefore no NO is discharged into the atmosphere at this time as well. Further, when the particulate is deposited on the particulate filter 22, it is removed by oxidation by the active oxygen released from the active oxygen release agent/$NO_x$ absorbent 61.

Note that when an $NO_x$ absorbent or active oxygen release agent/$NO_x$ absorbent is used, the air-fuel ratio of the exhaust gas flowing into the particulate filter 22 is made temporarily rich so as to release the $NO_x$ from the $NO_x$ absorbent or the active oxygen release agent/$NO_x$ absorbent before the absorption ability of the $NO_x$ absorbent or the active oxygen release agent/NO absorbent becomes saturated. That is, when combustion is performed under a lean air-fuel ratio, the air-fuel ratio is sometimes temporarily made rich. That is, the air-fuel ratio is sometimes temporarily made rich when combustion is performed under a lean air-fuel ratio.

If the air-fuel ratio is maintained lean, however, the surface of the platinum Pt is covered by oxygen and so-called oxygen poisoning of the platinum Pt occurs. If such oxygen poisoning occurs, the oxidation action on the $NO_x$ falls, so the efficiency of absorption of $NO_x$ falls and therefore the amount of release of active oxygen from the active oxygen release agent or the active oxygen release agent/$NO_x$ absorbent falls. If the air-fuel ratio is made rich, however, the oxygen on the surface of the platinum Pt is consumed, so the oxygen poisoning is eliminated. Therefore, if the air-fuel ratio is switched from rich to lean, the oxidation action on the $NO_x$ is strengthened, so the efficiency of absorption of $NO_x$ rises and therefore the amount of active oxygen released from the active oxygen release agent or the active oxygen release agent/$NO_x$ absorbent rises.

Therefore, if the air-fuel ratio is occasionally switched from lean to rich when the air-fuel ratio is maintained lean, the oxygen poisoning of the platinum Pt is eliminated, so the amount of release of active oxygen when the air-fuel ratio is lean is increased and therefore the oxidation action of the particulate on the particulate filter 22 is promoted.

Further, cerium Ce has the function of taking in oxygen when the air-fuel ratio is lean ($2Ce_2O_3+O2 \rightarrow 4CeO_2$) and releasing the active oxygen when the air-fuel ratio becomes rich ($4CeO_2 \rightarrow 2Ce_2\ O_3+O_2$). Therefore, if cerium Ce is used as the active oxygen release agent or active oxygen release agent/$NO_x$ absorbent, when the air-fuel ratio is lean, if particulate deposits on the particulate filter 22, the particulate will be oxidized by the active oxygen released from the active oxygen release agent or active oxygen release agent/$NO_x$ absorbent, while if the air-fuel ratio becomes rich, a large amount of active oxygen will be released from the active oxygen release agent or active oxygen release agent/$NO_x$ absorbent, so the particulate will be oxidized. Therefore, even if cerium Ce is used as the active oxygen release agent or active oxygen release agent/$NO_x$ absorbent, if the air-fuel ratio is occasionally switched from lean to rich, the oxidation action of the particulate on the particulate filter 22 can be promoted.

Next, the case of low temperature combustion for making the air-fuel ratio of the exhaust gas temporarily rich will be explained.

Figure 20:
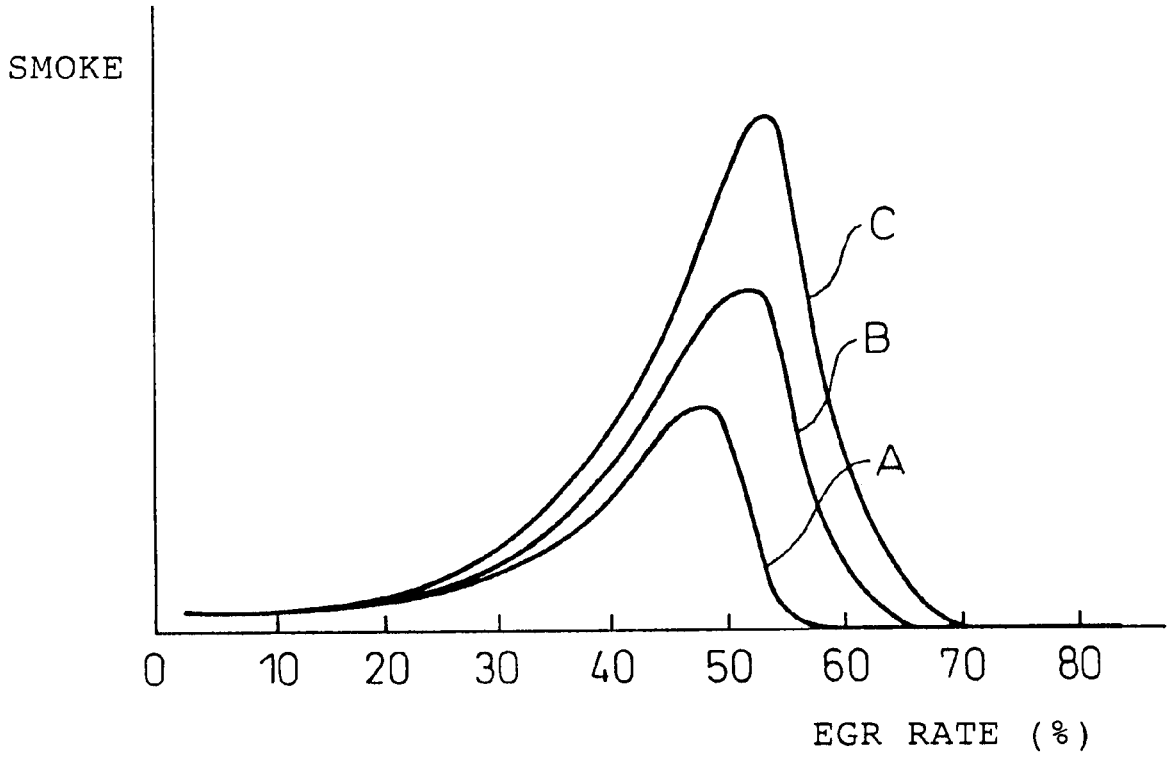
FIG. 20 is a view of the amount of generation of smoke.

In the internal combustion engine shown in FIG. 1, if the EGR rate (amount of EGR gas/(amount of EGR gas+amount of intake air)) is increased, the amount of generation of smoke gradually increases and then reaches a peak. If the EGR rate is further raised, the amount of generation of smoke then conversely rapidly falls. This will be explained with reference to FIG. 20 showing the relationship between the EGR rate and smoke when changing the degree of cooling of the EGR gas. Note that in FIG. 20, the curve A shows the case where the EGR gas is powerfully cooled to maintain the EGR gas temperature at about 90° C., the curve B shows the case of using a small-sized cooling device to cool the EGR gas, and the curve C shows the case where the EGR gas is not force-cooled.

When powerfully cooling the EGR gas such as shown by the curve A of FIG. 20, the amount of generation of smoke peaks when the EGR rate is a bit lower than 50 percent. In this case, if the EGR rate is made at least 55 percent or so, almost no smoke will be generated any longer. On the other hand, as shown by the curve B of FIG. 20, when slightly cooling the EGR gas, the amount of generation of smoke will peak when the EGR rate is slightly higher than 50 percent. In this case, if the EGR rate is made at least 65 percent or so, almost no smoke will be generated any longer. Further, as shown by the curve C of FIG. 20, when not force-cooling the EGR gas, the amount of generation of smoke peaks at near 55 percent. In this case, if the EGR rate is made at least 70 percent or so, almost no smoke will be generated any longer.

The reason why no smoke is generated any longer if making the EGR gas rate at least 55 percent in this way is that the temperature of the fuel and the surrounding gas at the time of combustion will not become that high due to the heat absorbing action of the EGR gas, that is, low temperature combustion is performed and as a result the hydrocarbons do not grow into soot.

This low temperature combustion is characterized in that it is possible to reduce the amount of generation of $NO_x$ while suppressing the generation of smoke regardless of the air-fuel ratio. That is, if the air-fuel ratio is made rich, the fuel becomes in excess, but since the combustion temperature is kept to a low temperature, the excess fuel does not grow into soot and therefore no smoke is generated. Further, only a very small amount of $NO_x$ is generated at this time. On the other hand, when the mean air-fuel ratio is lean or when the air-fuel ratio is the stoichiometric air-fuel ratio, if the combustion temperature becomes high, a small amount of soot is produced, but under low temperature combustion, the combustion temperature is kept to a low temperature, so no smoke at all is produced and only a very small amount of $NO_x$ is produced as well.

Figure 21:
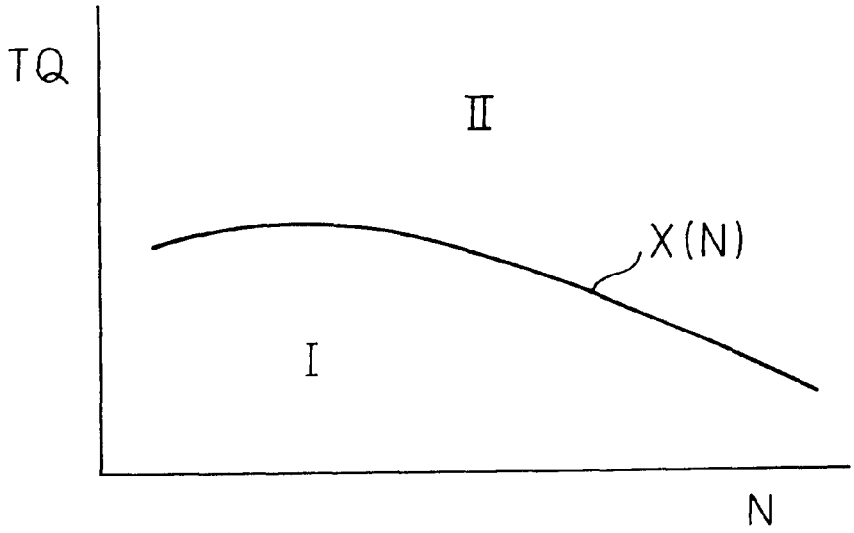
FIG. 21 is a view of a first operating region and a second operating region.

If the required torque TQ of the engine becomes high, however, that is, if the amount of injected fuel becomes greater, the temperature of the fuel and surrounding gas at the time of combustion becomes high, so low temperature combustion becomes difficult. That is, low temperature combustion is limited to the time of engine medium and low load operation when the amount of heat generated by the combustion is relatively small. In FIG. 21, the region I shows an operating region where first combustion where the amount of inert gas of the combustion chamber 5 is greater than the amount of inert gas where the amount of generation of soot peaks, that is, low temperature combustion, can be performed, while the region II shows an operating region where only second combustion where the amount of inert gas in the combustion chamber 5 is smaller than the amount of inert gas where the amount of generation of soot peaks, that is, normal combustion, can be performed.

Figure 22:
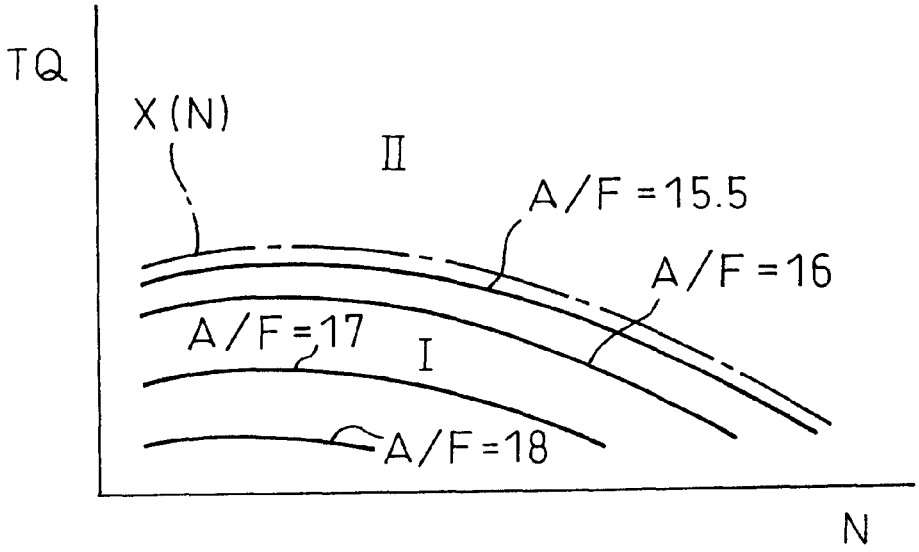
FIG. 22 is a view of the air-fuel ratio.
Figure 23:
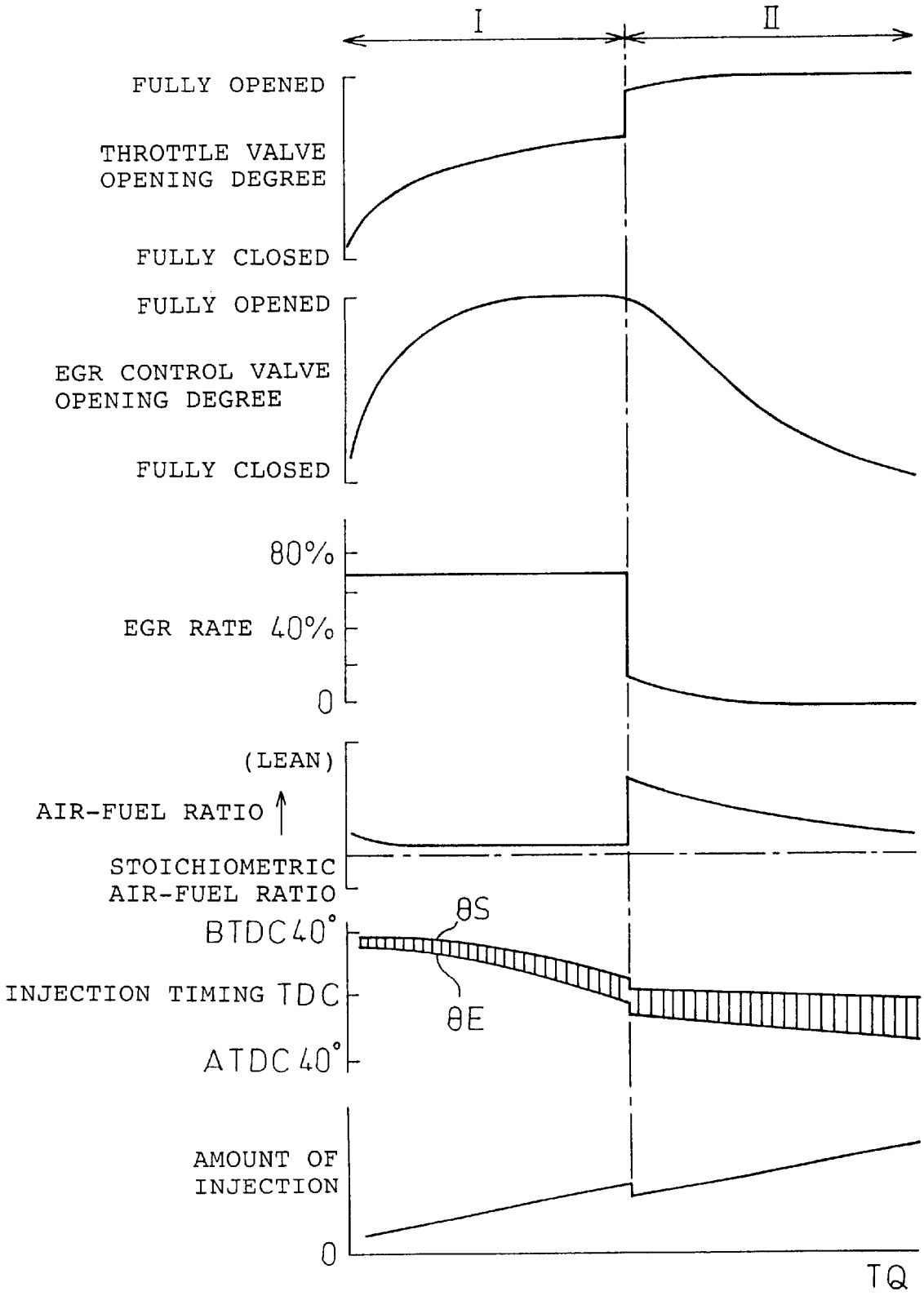
FIG. 23 is a view of the change of the opening degree of the throttle valve.

FIG. 22 shows the target air-fuel ratio A/F in the case of low temperature combustion in the operating region I, while FIG. 23 shows the opening degree of the throttle valve 17, opening degree of the EGR control valve 25, EGR rate, air-fuel ratio, injection start timing θS, injection end timing θE, and amount of injection corresponding to the required torque TQ. Note that FIG. 23 also shows the opening degree of the throttle valve etc. at the time of normal combustion performed at the operating region II. From FIG. 22 and FIG. 23, when low temperature combustion is performed at the operating region I, the EGR rate is made at least 55 percent and the air-fuel ratio A/F is made a lean air-fuel ratio of about 15.5 to 18.

Now, if an $NO_x$ absorbent or active oxygen release agent/$NO_x$ absorbent is carried on the particulate filter 22, it is necessary to make the air-fuel ratio temporarily rich to release the absorbed $NO_x$. As explained earlier, however, when performing low temperature combustion at the operating region I, almost no smoke will be produced even if the air-fuel ratio is made rich. Therefore, when carrying an $NO_x$ absorbent or active oxygen release agent/$NO_x$ absorbent on the particulate filter 22, to separate and discharge the masses of particulate from the particulate filter 22, the air-fuel ratio is made rich under low temperature combustion when the exhaust throttle valve 45 is temporarily closed and thereby the $NO_x$ is released.

Figure 24:
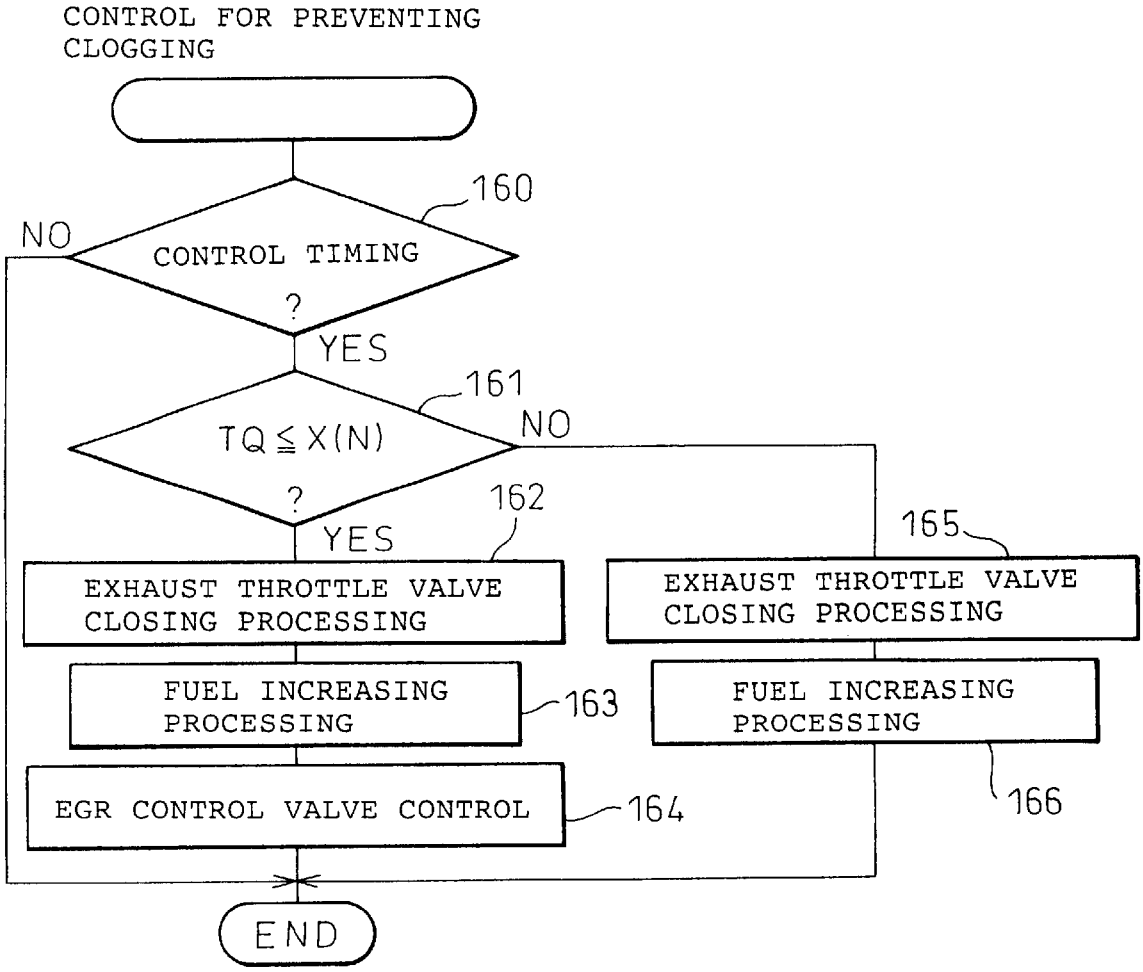
FIG. 24 is a flow chart for control for prevention of clogging.

FIG. 24 shows the routine for working the control for preventing clogging.

Referring to FIG. 24, first, at step 160, it is determined if the timing is that for control for preventing clogging. If the timing is that for control for preventing clogging, the routine proceeds to step 161, where it is determined if the required torque TQ is larger than a boundary X(N) shown in FIG. 21. When TQ≦X(N), that is, when the engine operating region is the first operating region I and low temperature combustion is performed, the routine proceeds to step 162, where the exhaust throttle valve 45 is temporarily closed, then at step 163, the amount of injected fuel is increased while the exhaust throttle valve 45 is closed so that the air-fuel ratio becomes rich. Next, at step 164, the opening degree of the EGR control valve 25 is controlled so that the air-fuel ratio does not become too rich due to the unburned fuel in the EGR gas.

On the other hand, when it is determined at step 161 that TQ>X(N), that is, when the engine operating state is the second operating region II, the routine proceeds to step 165, where the exhaust throttle valve 45 is temporarily closed, then at step 166, the amount of injected fuel is increased while the exhaust throttle valve 45 is closed. At this time, however, the air-fuel ratio is not made rich.

Figure 25:
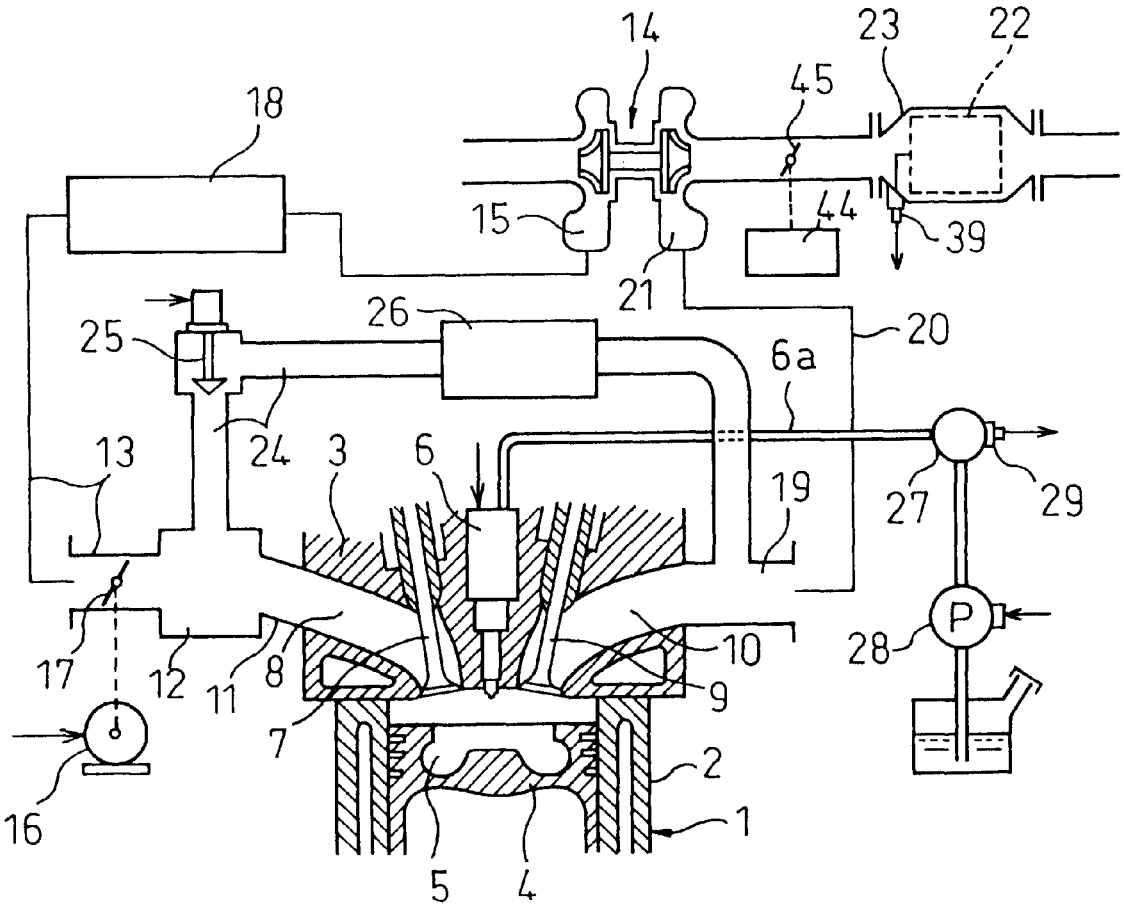
FIG. 25 is an overall view of still another embodiment of an internal combustion engine.

FIG. 25 shows a modification of the position of attachment of the exhaust throttle valve 45. As shown in this modification, the exhaust throttle valve 45 can also be arranged in the exhaust passage upstream of the particulate filter 22.

Figure 26:
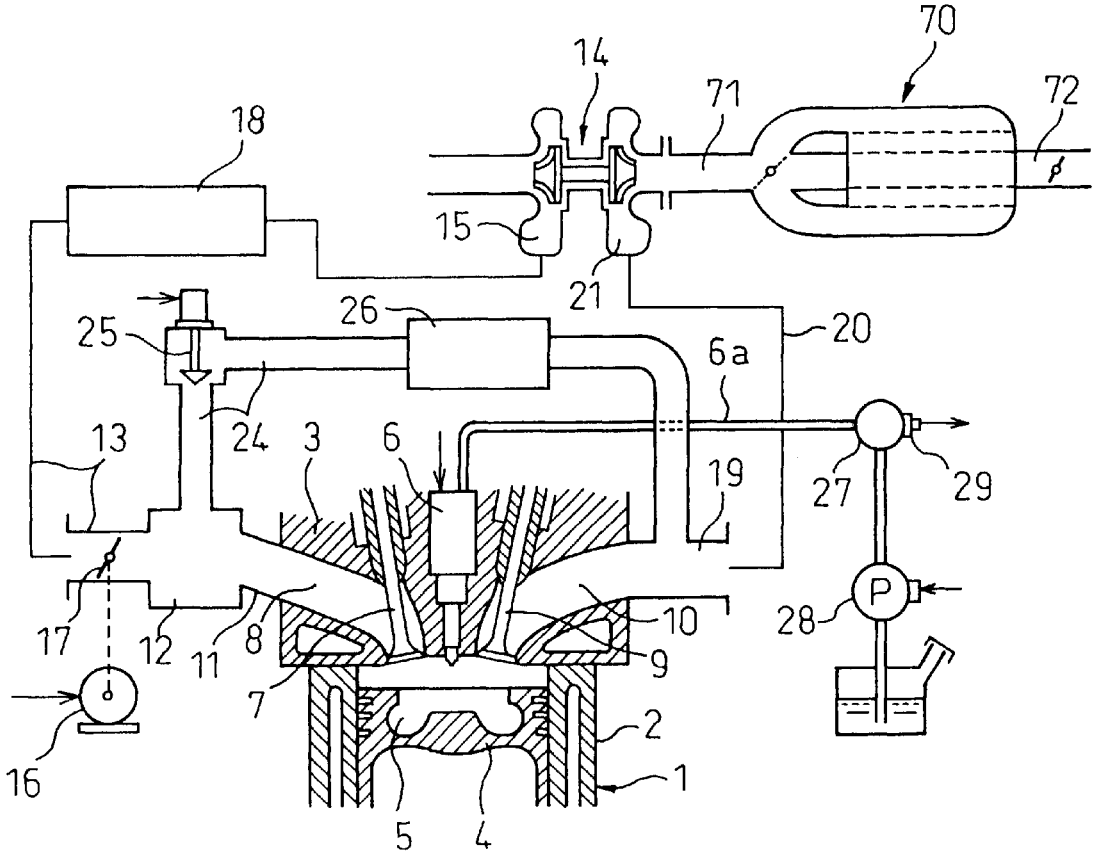
FIG. 26 is an overall view of still another embodiment of an internal combustion engine.

FIG. 26 shows the case of application of the present invention to a particulate processing device able to switch the direction of flow of the exhaust gas flowing through the inside of the particulate filter 22 to the reverse direction. This particulate processing device 70, as shown in FIG. 26, is connected to the outlet of an exhaust turbine 21. A plan view and partial sectional side view of this particulate processing device 70 are shown in FIG. 27A and FIG. 27B, respectively.

Figure 27A:
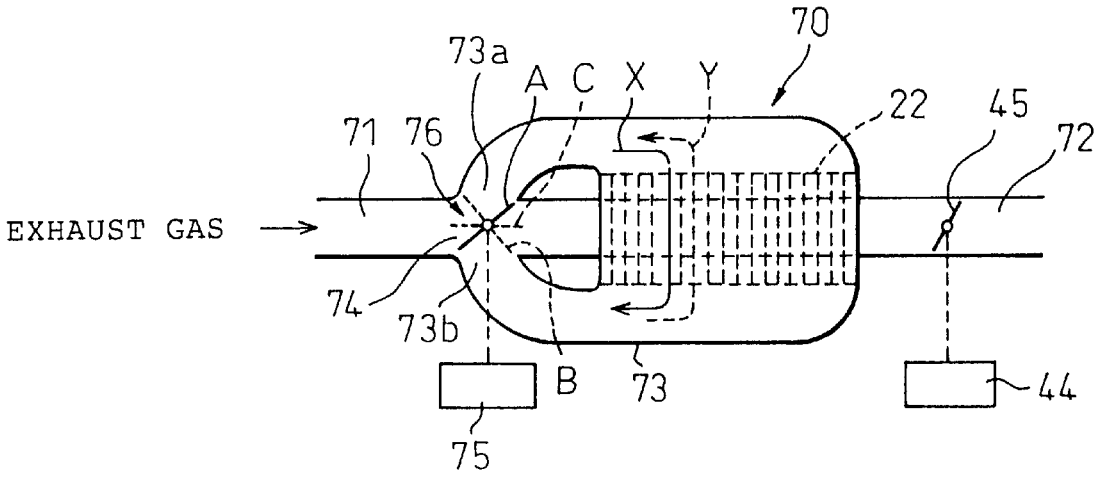
FIGS. 27A and 27B are views of a particulate processing device.
Figure 27B:
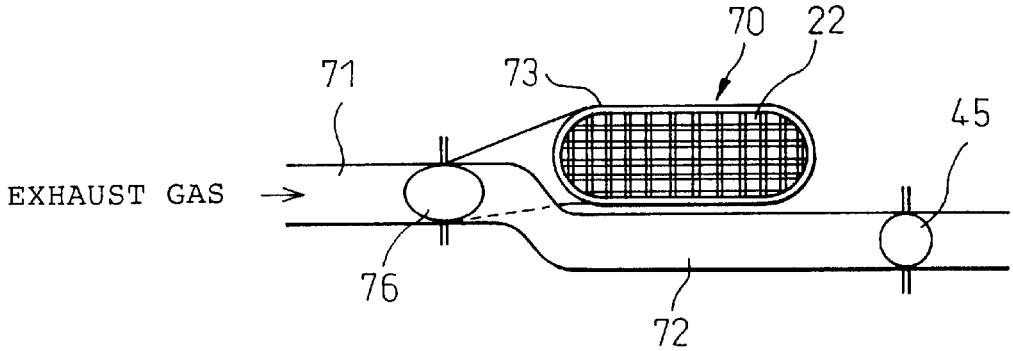

Referring to FIGS. 27A and 27B, the particulate processing device 70 is provided with an upstream side exhaust pipe 71 connected to the outlet of the exhaust turbine 21, a downstream side exhaust pipe 72, and an exhaust two-way passage pipe 73 having a first open end 73*a* and second open end 73*b* at the two ends. The outlet of the upstream side exhaust pipe 71, the inlet of the downstream side exhaust pipe 72, and the first open end 73*a* and second open end 73*b* of the exhaust two-way passage pipe 73 open inside the same collection chamber 74. The particulate filter 22 is arranged inside the exhaust two-way passage pipe 73. The sectional contour shape of the particulate filter 22 slightly differs from the particulate filter shown in FIGS. 3A and 3B, but is substantially the same as the structure shown in FIGS. 3A and 3B on other points.

A flow path switching valve 76 driven by an actuator 75 is arranged inside the collection chamber 74 of the particulate processing device 70. This actuator 75 is controlled by an output signal of the electronic control unit 30. This flow path switching valve 76 is controlled by the actuator 75 to any of a first position A for connecting the outlet of the upstream side exhaust pipe 71 to the first open end 73*a* by the actuator 75 and connecting the second open end 73*b* to the inlet of the downstream side exhaust pipe 72, a second position B for connecting the outlet of the upstream side exhaust pipe 71 to the second open end 73*b* and the first open end 73*a* to the inlet of the downstream side exhaust pipe 72, and a third position C for connecting the outlet of the upstream side exhaust pipe 71 to the inlet of the downstream side exhaust pipe 72.

When the flow path switching valve 76 is positioned at the first position A, the exhaust gas flowing out from the outlet of the upstream side exhaust pipe 71 flows from the first open end 73*a* to the inside of the exhaust two-way passage pipe 73, then flows through the particulate filter 22 in the arrow X-direction, then flows from the second open end 73*b* to the inlet of the downstream side exhaust pipe 72.

As opposed to this, when the flow path switching valve 76 is positioned at the second position B, the exhaust gas flowing out from the outlet of the upstream side exhaust pipe 71 flows from the second open end 73*b* to the inside of the exhaust two-way passage pipe 73, then flows through the particulate filter 22 in the arrow Y-direction, then flows from the first open end 73*a* to the inlet of the downstream side exhaust pipe 72. Therefore, by switching the flow path switching valve 76 from the first position A to the second position B or from the second position B to the first position A, the direction of flow of the exhaust gas flowing through the particulate filter 22 is switched in the reverse direction from what it was up to then.

On the other hand, when the flow path switching valve 76 is positioned at the third position C, the exhaust gas flowing out from the outlet of the upstream side exhaust pipe 71 flows directly to the inlet of the downstream side exhaust pipe 72 without flowing into the exhaust two-way passage pipe 73 much at all. For example, when the temperature of the particulate filter 22 is low such as immediately after engine startup, the flow path switching valve 76 is made the third position C so as to prevent a large amount of particulate from depositing on the particulate filter 22.

Figure 28:
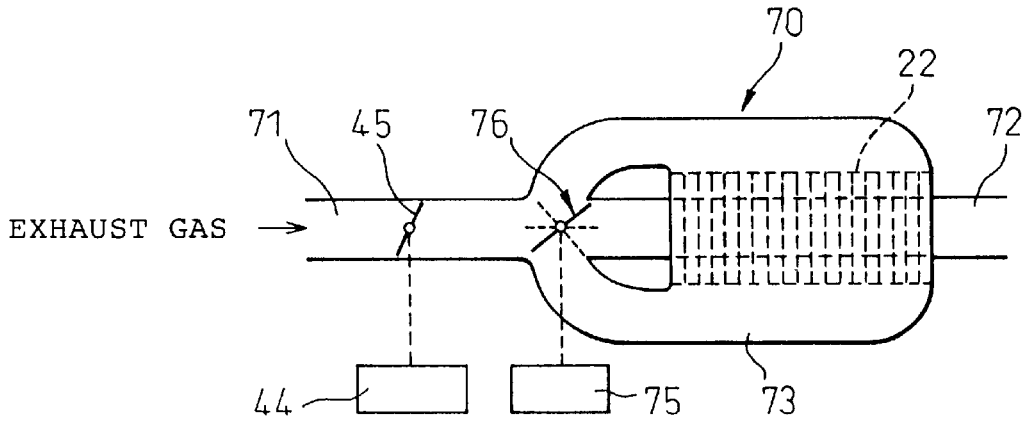
FIG. 28 is a view of another embodiment of a particulate processing device.

As shown in FIGS. 27A and 27B, the exhaust throttle valve 45 is arranged inside the downstream side exhaust pipe 72. The exhaust throttle valve 45, however, can also be arranged inside the upstream side exhaust pipe 71 as shown in FIG. 28.

When the exhaust gas is flowing through the inside the particulate filter 22 in the arrow direction, particulate mainly deposits on the surface of the partition walls 54 at the side where the exhaust gas flows in and masses of particulate mainly attach to the surfaces at the side where the exhaust gas flows in and inside the fine holes. In this embodiment, the direction of flow of the exhaust gas flowing through the inside of the particulate filter 22 is switched to the reverse direction so as to oxidize the particulate deposited and to separate and discharge the masses of particulate from the particulate filter 22.

That is, if the direction of flow of the exhaust gas flowing through the inside of the particulate filter 22 is switched to the reverse direction, no other particulate deposits on the deposited particulate, so the deposited particulate is gradually removed by oxidation. Further, if the direction of flow of the exhaust gas flowing through the inside of the particulate filter 22 is switched to the reverse direction, the attached masses of particulate will be positioned on the wall surface at the side where the exhaust gas flows out and inside the fine holes and therefore the masses of particulate can be easily separated and discharged.

In practice, however, the masses of particulate are not sufficiently separated and discharged by just switching the flow of exhaust gas flowing through the inside of the particulate filter 22 to the reverse direction. Therefore, even when using the particulate processing device 70 such as shown in FIGS. 27A and 27B, the exhaust throttle valve 45 is temporarily closed, then fully opened when separating and discharging the masses of particulate from the particulate filter 22.

Figure 29:
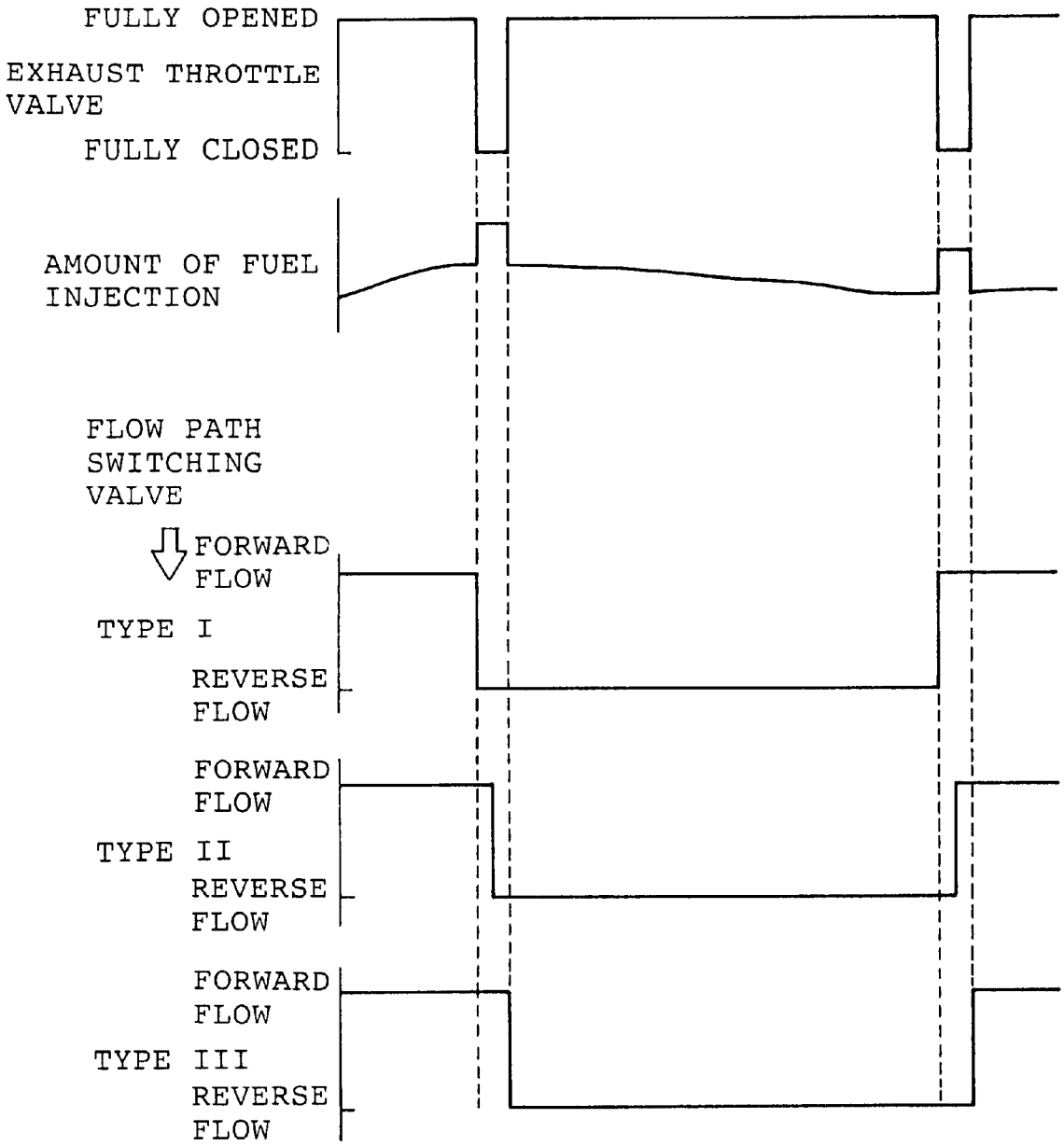
FIG. 29 is a time chart of the change of the opening degree of the exhaust throttle valve.

Next, the timing of control of the exhaust throttle valve 45 and the timing of switching of the flow path switching valve 76 will be explained. FIG. 29 shows the case where the exhaust throttle valve 45 is temporarily fully closed from the fully opened state and then again fully opened cyclically every constant time interval or every constant distance of travel. In this case as well, the amount of fuel injection is increased while the exhaust throttle valve 45 is fully closed so that the engine output does not fall when the exhaust throttle valve 45 is fully closed.

On the other hand, as shown in FIG. 29, the flow path switching valve 76 is switched between forward flow and reverse flow linked with the control of operation of the exhaust throttle valve 45. Here, the "forward flow" means the flow of the exhaust gas in the arrow X direction in FIG. 27, while the "reverse flow" means the flow of the exhaust gas in the arrow Y direction in FIG. 27. Therefore, when the flow should be made the forward flow, the flow path switching valve 76 is made the first position A, while when it should be made the reverse flow, the flow path switching valve 76 is made the second position B.

As shown in FIG. 29, there are three types of switching timings of the first position A and second position B of the flow path switching valve 76, that is, Type I, Type II, and Type III. Type I is the type where the forward flow is switched to the reverse flow or the reverse flow to the forward flow when the exhaust throttle valve 45 is fully closed from the fully opened state, Type II is the type where the forward flow is switched to the reverse flow or the reverse flow to the forward flow when the exhaust throttle valve 45 is maintained at the fully closed state, and Type III is the type where the forward flow is switched to the reverse flow or the reverse flow to the forward flow when the exhaust throttle valve 45 is fully opened from the fully closed state.

In each of Types I, II, and III, the flow path switching action of the flow path switching valve 76 is performed in the interval from when the exhaust throttle valve 45 is fully closed to when it is fully opened, in other words, when the exhaust throttle valve 45 is being fully opened or immediately before it is fully opened. The flow path switching action of the flow path switching valve 76 is performed in the interval from when the exhaust throttle valve 45 is fully closed to when it is fully opened for the following reasons:

That is, to keep the pressure loss in the particulate filter 22 low, it is necessary to separate and discharge the masses of particulate from the particulate filter 22 as fast as possible. In this case, the masses of particulate can easily separate when the surfaces of the partition walls 54 to which they are attached become the outflow side of the exhaust gas. Therefore, to separate and discharge the masses of particulate from the particulate filter 22 as fast as possible, it is preferable to separate and discharge the masses of particulate when the surfaces of the partition walls 54 where the particulate is deposited become the outflow side of the exhaust gas, that is, when the reverse flow is switched to the forward flow. That is, in other words, when the exhaust throttle valve 45 is fully opened from the closed state or immediately before being fully opened, it is preferable to switch from the forward flow to the reverse flow or from the reverse flow to the forward flow.

Figure 30:
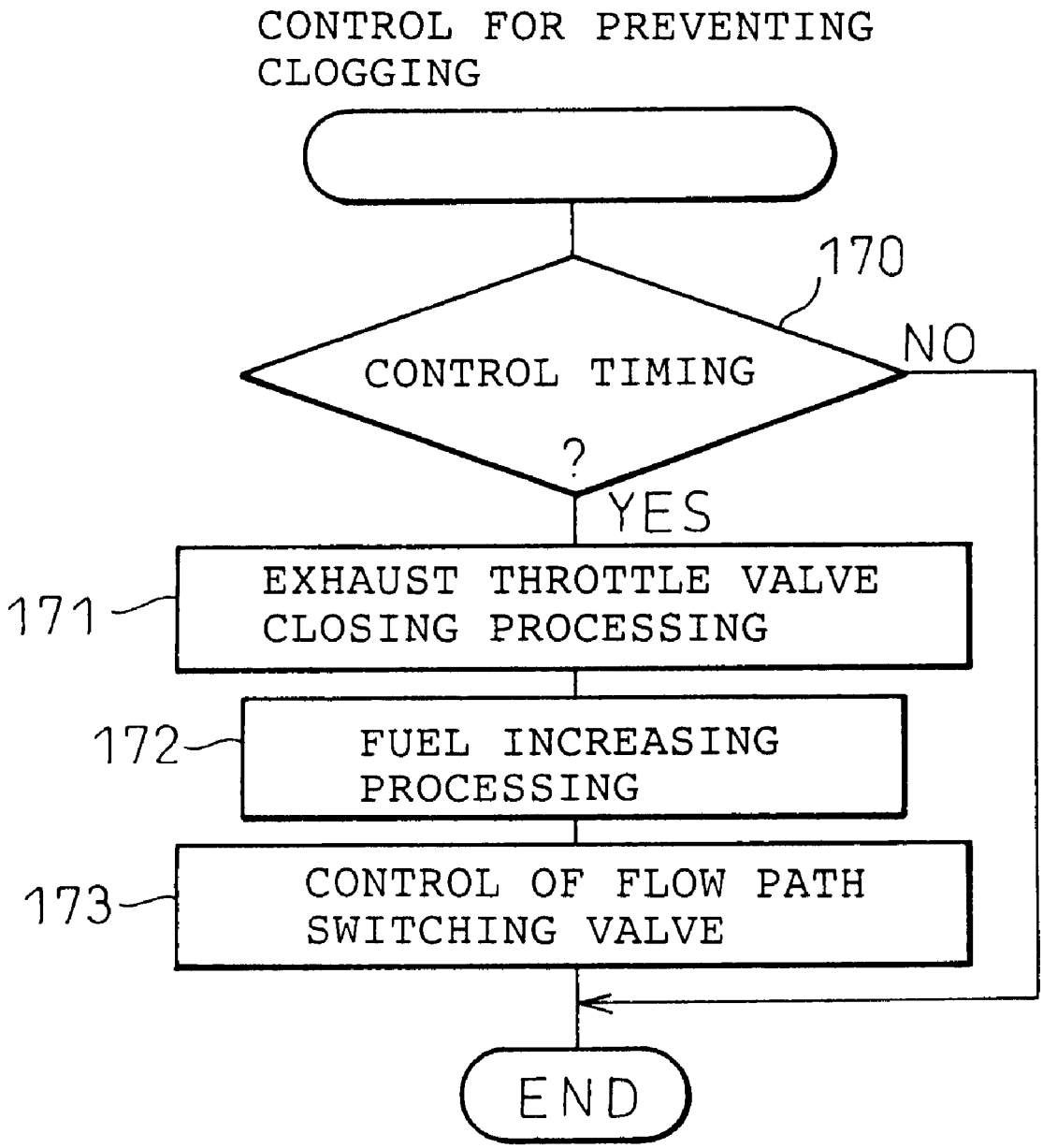
FIG. 30 is a flow chart for control for prevention of clogging.

FIG. 30 shows the routine for working the control for preventing clogging shown in FIG. 29.

Referring to FIG. 30, first, at step 170, it is determined if the timing is that for control for preventing clogging. In the embodiment shown in FIG. 29, it is judged that the timing is that for control for preventing clogging every constant time interval or every constant travel distance. When the timing is that for control for preventing clogging, the routine proceeds to step 171, where the exhaust throttle valve 45 is temporarily closed, then at step 172, the amount of injected fuel is increased while the exhaust throttle valve 45 is closed. Next, at step 173, the flow path switching action is performed by the flow path switching valve 76 by any of Types I, II, and III.

Figure 31:
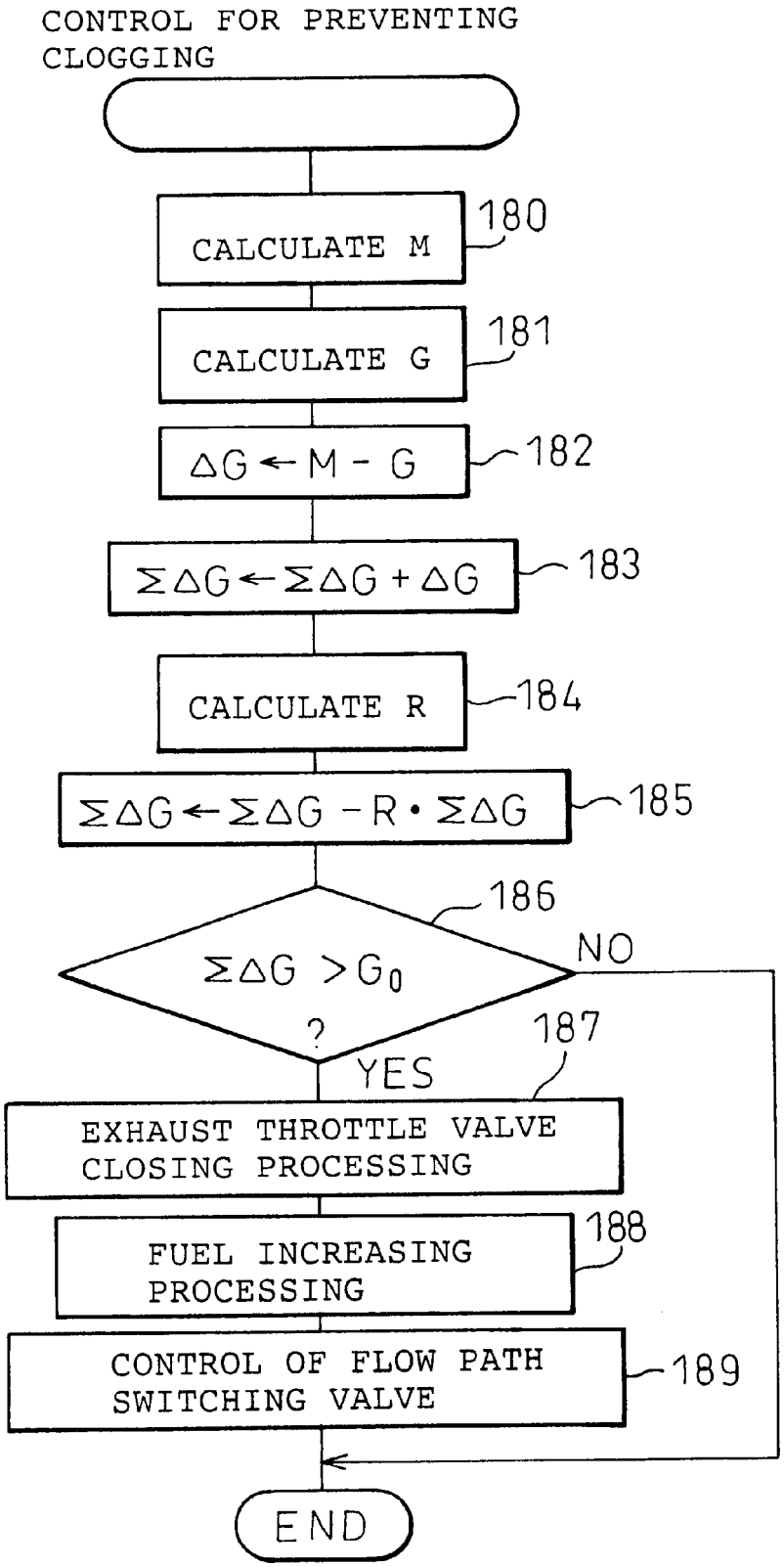
FIG. 31 is a flow chart for control for prevention of clogging.

FIG. 31 shows a routine for control for preventing clogging which estimates the amount of deposited particulate remaining on the particulate filter 22 and controls the exhaust throttle valve 45 and the flow path switching valve 76 when the amount of deposited particulate remaining exceeds a limit value.

Referring to FIG. 31, first, at step 180, the amount M of discharged particulate is calculated from the relation shown in FIG. 14A. Next, at step 181, the amount G of particulate removable by oxidation is calculated from the relation shown in FIG. 6. Next, at step 182, the amount $\Delta G$ of particulate deposited per unit time ($=M-G$) is calculated, then at step 183, the total amount $\Sigma\Delta G$ of the deposited particulate ($=\Sigma\Delta G+\Delta G$) is calculated. Next, at step 184, the ratio R of removal by oxidation of deposited particulate is calculated from the relation shown in FIG. 14B. Next, at step 185, the amount $\Sigma\Delta G$ of deposited particulate remaining ($=\Sigma\Delta G-R\cdot\Sigma\Delta G$) is calculated. Next, at step 186, it is determined if the amount $\Sigma\Delta G$ of deposited particulate remaining is larger than the limit value $G_0$.

When $\Sigma\Delta G>G_0$, the routine proceeds to step 187, where the exhaust throttle valve 45 is temporarily closed, then at step 188, the amount of injected fuel is increased while the exhaust throttle valve 45 is closed. Next, at step 189, a flow path switching action is performed by the flow path switching valve 76 by one of Types I, II, and III shown in FIG. 29.

Figure 32:
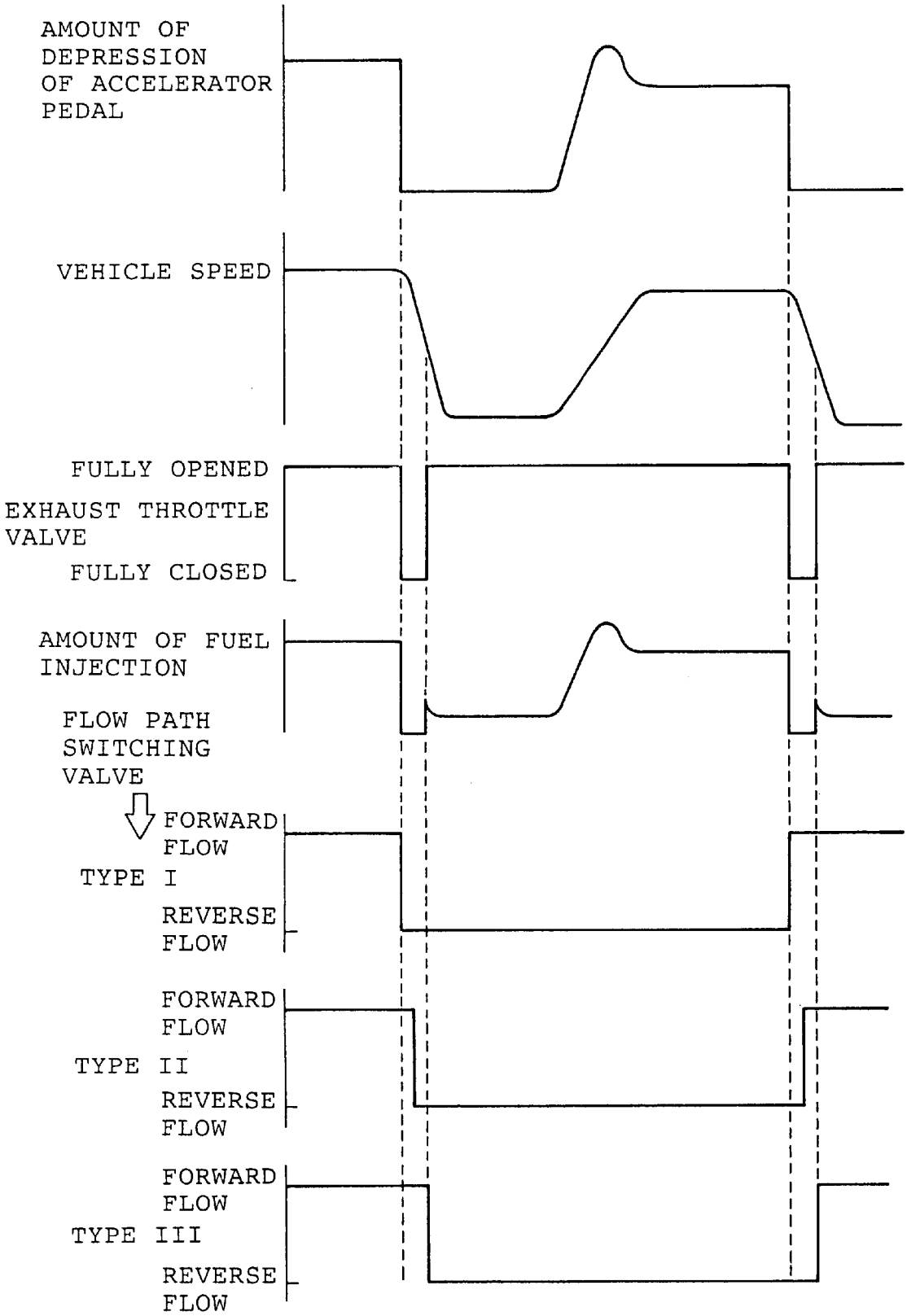
FIG. 32 is a time chart of the change of the opening degree of the exhaust throttle valve.

FIG. 32 shows the case where the exhaust throttle valve 45 is temporarily fully closed for an engine braking action at the time of vehicle deceleration and where a flow path switching action is performed by the flow path switching valve 76 at that time. In this case as well, in the same way as FIG. 29, there are three types, I, II, and III, of flow path switching methods. One of Types I, II, and III is used. Note that in the example shown in FIG. 32, when the amount of depression of the accelerator pedal 40 becomes zero, the fuel injection is stopped and the exhaust throttle valve 45 is fully closed. When the fuel injection is started, the exhaust throttle valve 45 is fully opened.

Figure 33:
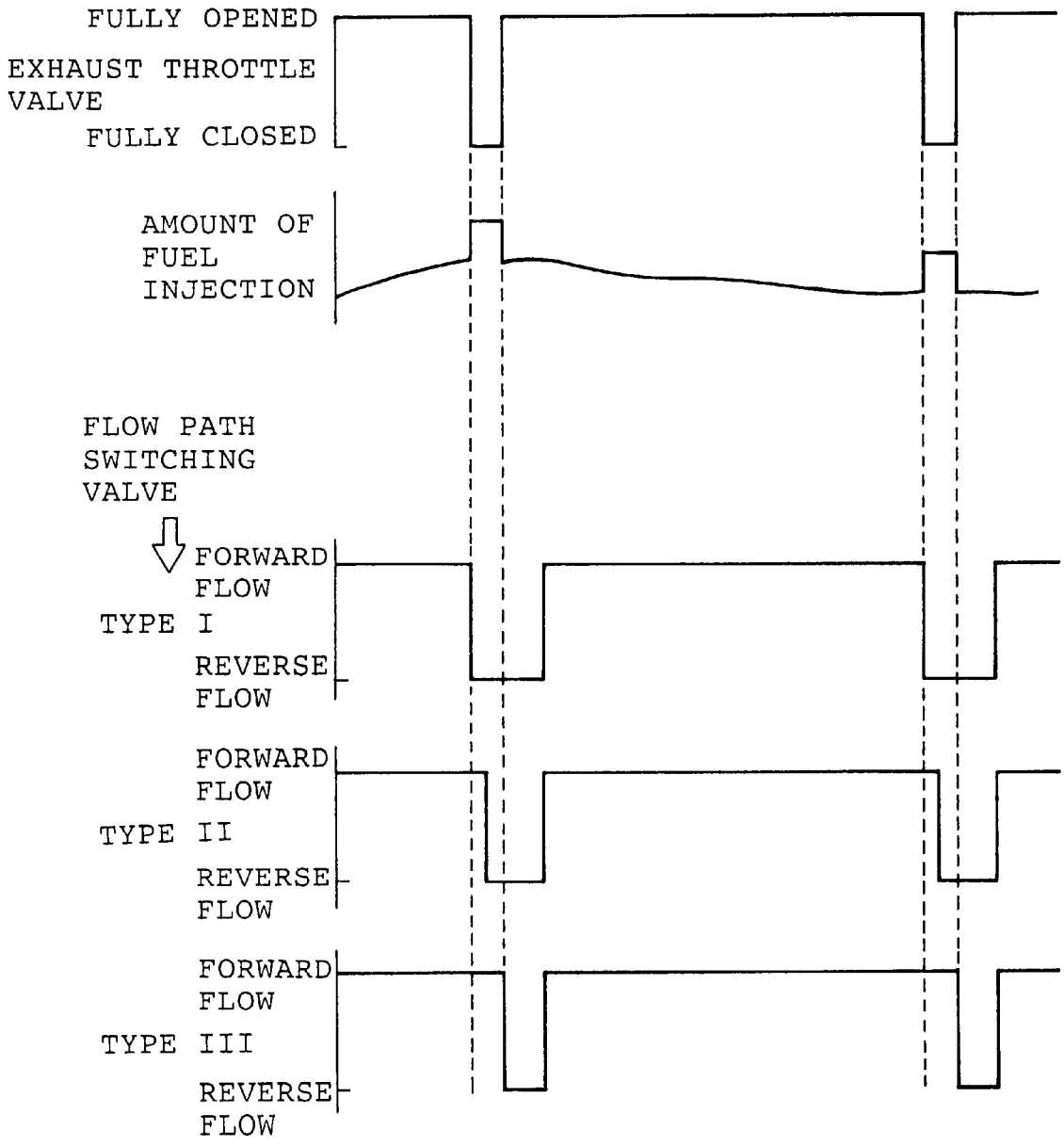
FIG. 33 is a time chart of the change of the opening degree of the exhaust throttle valve.

In the embodiment shown in FIG. 33, the exhaust throttle valve 45 is temporarily fully closed every constant time interval, every constant travel distance, or when the amount $\Sigma\Delta G$ of the deposited particulate remaining on the particulate filter exceeds the limit value $G_0$. The amount of fuel injection is increased while the exhaust throttle valve 45 is fully closed. In this case as well, in the same way as FIG. 29, there are three types, I, II, and III, of flow path switching methods. One of Types I, II, and III is used. In this embodiment, however, usually the flow is made forward.

The forward flow is switched to the reverse flow once when the exhaust throttle valve 45 is closed, but when the exhaust throttle valve 45 is again fully opened, the forward flow is switched to again after a while.

Figure 34:
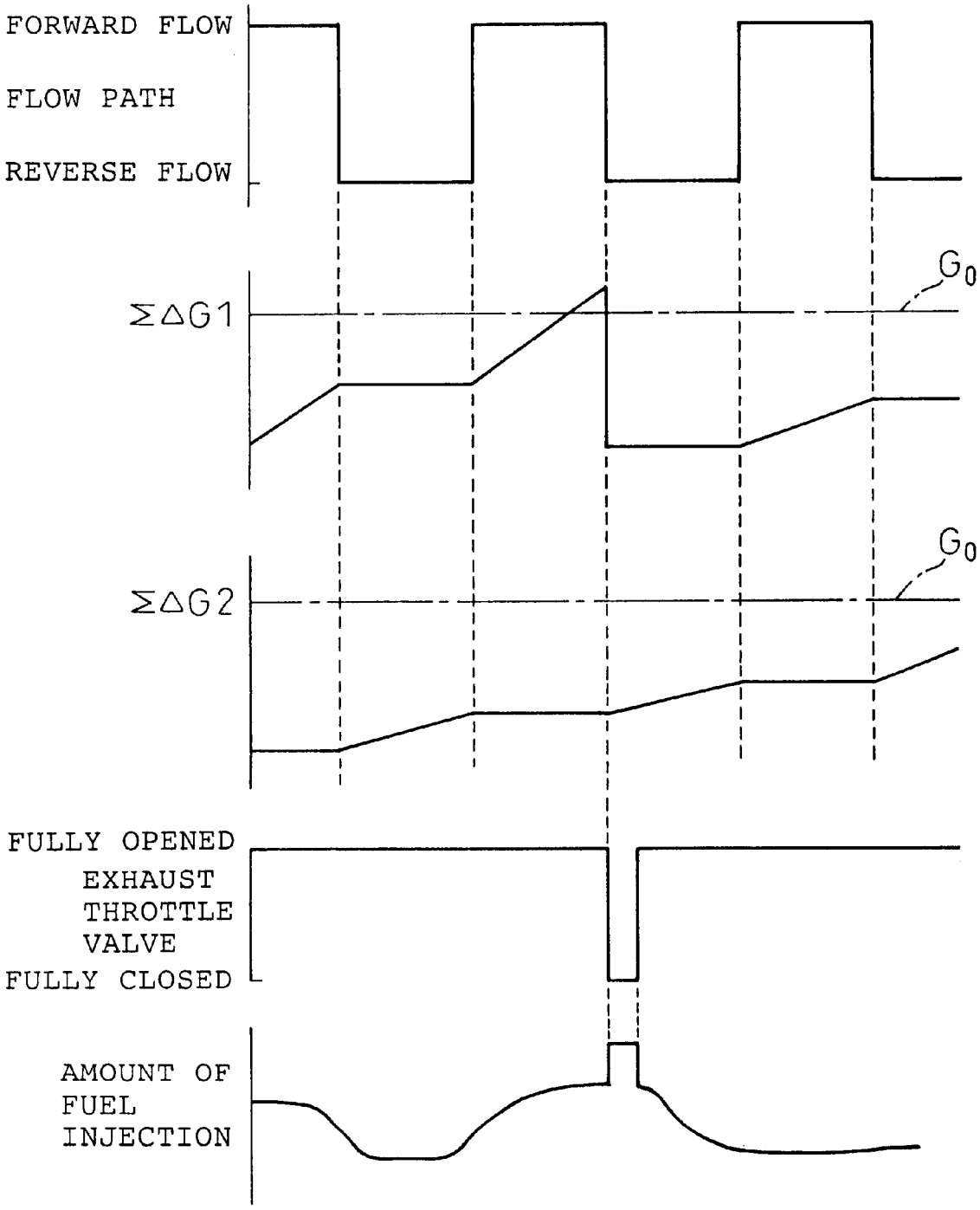
FIG. 34 is a time chart of the change of the opening degree of the exhaust throttle valve.

FIG. 34 shows still another embodiment. In this embodiment, the forward flow is alternately switched to the reverse flow or the reverse flow to the forward flow at a predetermined control timing. On the other hand, the amount $\Sigma\Delta G1$ of the deposited particulate remaining on the surface of the partition walls 54 at the side where the exhaust gas flows in and inside the fine holes at the time of forward flow and the amount $\Sigma\Delta G2$ of the deposited particulate remaining on the surfaces of the partition walls 54 at the side where the exhaust gas flows in and inside the fine holes at the time of a reverse flow are separately calculated. For example, as shown in FIG. 34, when the amount $\Sigma\Delta G1$ of the deposited particulate at the time of forward flow exceeds the limit value $G_0$, the exhaust throttle valve 45 is temporarily fully closed when the forward flow is switched to the reverse flow and the amount of fuel injection is increased while the exhaust throttle valve 45 is fully closed.

That is, in this embodiment, using general expressions, when the particulate estimated as having deposited at either side of the partition walls 54 of the particulate filter 22 exceeds a predetermined limit value and when the one side of the partition walls 54 where the particulate exceeding the limit value is the outflow side of the exhaust gas or becomes the outflow side of the exhaust gas, the exhaust throttle valve 45 is instantaneously opened and the flow velocity of the exhaust gas flowing through the inside of the particulate filter 22 is increased for just an instant in a pulse-like manner.

Figure 35:
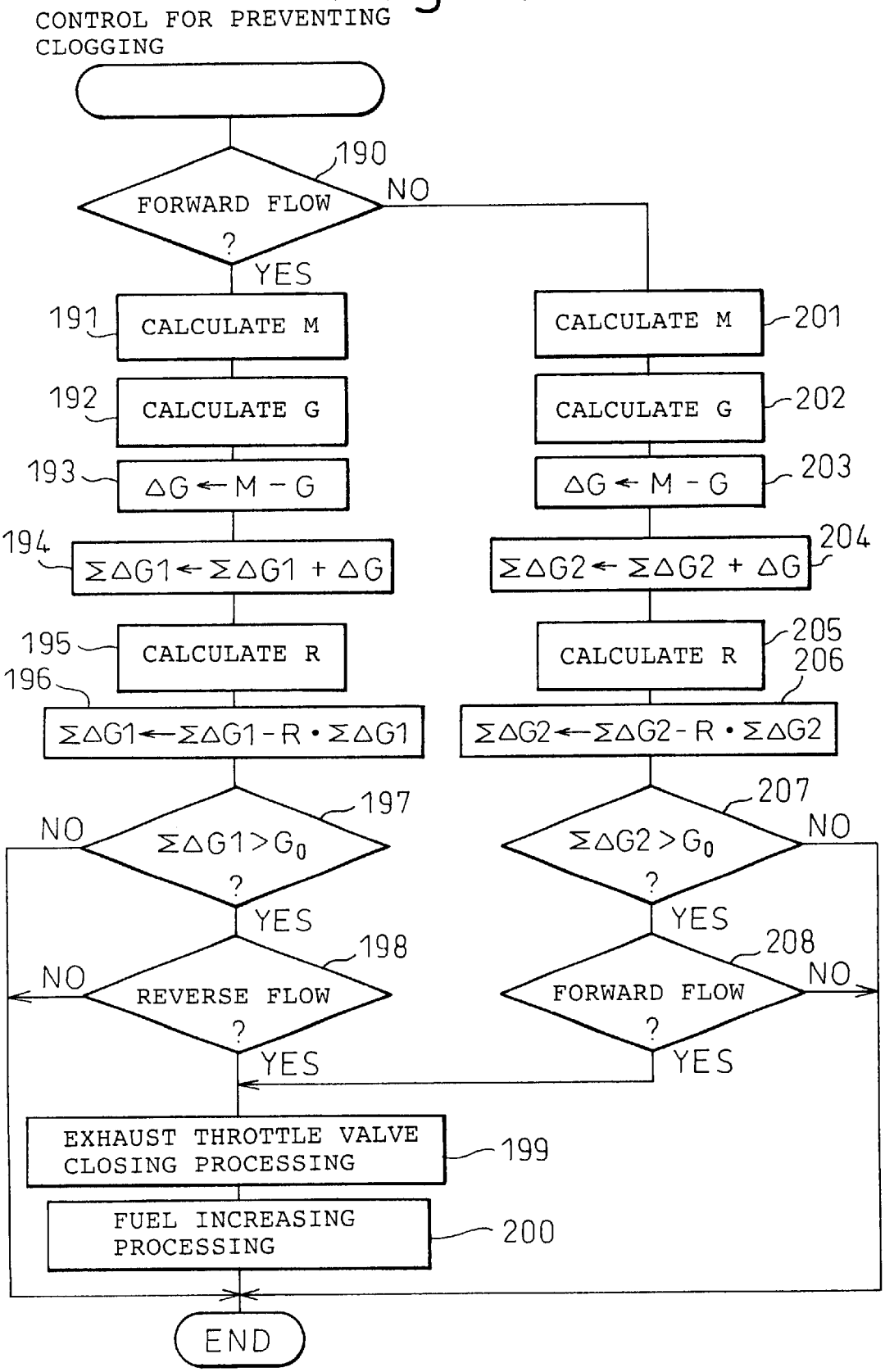
FIG. 35 is a flow chart for control for prevention of clogging.

FIG. 35 shows a routine for control for preventing clogging for working this embodiment.

Referring to FIG. 35, first, at step 190, it is judged if the flow is currently the forward flow. When it is the forward flow, the routine proceeds to step 191, where the amount M of discharged particulate is calculated from the relation shown in FIG. 14A. Next, at step 192, the amount G of particulate removable by oxidation is calculated from the relation shown in FIG. 6. Next, at step 193, the amount $\Delta G$ of the particulate deposited per unit time at the time of forward flow ($=M-G$) is calculated, then at step 194, the total amount $\Sigma\Delta G1$ of the forward flow deposited particulate ($=\Sigma\Delta G1+\Delta G$) is calculated. Next, at step 195, the ratio R of the removal by oxidation of the deposited particulate is calculated from the relation shown in FIG. 14B. Next, at step 196, the amount $\Sigma\Delta G1$ of the forward flow deposited particulate remaining ($=\Sigma\Delta G1-R\cdot\Sigma\Delta G1$) is calculated.

Next, at step 197, it is determined if the amount $\Sigma\Delta G1$ of forward flow deposited particulate remaining has become greater than the limit value $G_0$. When $\Sigma\Delta G1>G_0$, the routine proceeds to step 198, where it is determined if the flow is currently a reverse one. When currently a reverse flow, the routine proceeds to step 199, where the exhaust throttle valve 45 is temporarily fully closed, then at step 200, the amount of fuel injection is increased while the exhaust throttle valve 45 is fully closed.

On the other hand, when it is judged at step 190 that the flow is not currently the forward flow, that is, when it is the reverse flow, the routine proceeds to step 201, where the amount M of discharged particulate is calculated from the relation shown in FIG. 14A. Next, at step 202, the amount G of particulate removable by oxidation is calculated from the relation shown in FIG. 6. Next, at step 203, the amount $\Delta G$ of the particulate deposited per unit time at the time of reverse flow ($=M-G$) is calculated, then at step 204, the total amount $\Sigma\Delta G2$ of the reverse flow deposited particulate ($=\Sigma\Delta G2+\Delta G$) is calculated. Next, at step 205, the ratio R of the removal by oxidation of the deposited particulate is calculated from the relation shown in FIG. 14B. Next, at step 206, the amount $\Sigma\Delta G2$ of the reverse flow deposited particulate remaining ($=\Sigma\Delta G2-R\cdot\Sigma\Delta G2$) is calculated.

Next, at step 207, it is determined if the amount $\Sigma\Delta G2$ of reverse flow deposited particulate remaining has become greater than the limit value $G_0$. When $\Sigma\Delta G2>G_0$, the routine proceeds to step 208, where it is determined if the flow is currently a forward one. When currently a forward flow, the routine proceeds to step 199, where the exhaust throttle valve 45 is temporarily fully closed, then at step 200, the amount of fuel injection is increased while the exhaust throttle valve 45 is fully closed.

Figure 36:
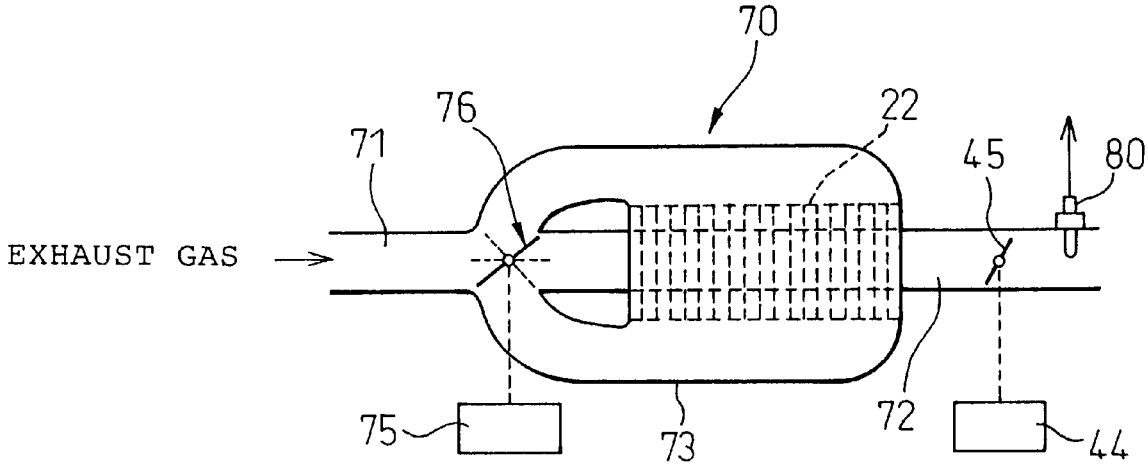
FIG. 36 is a view of still another embodiment of a particulate processing device.

FIG. 36 shows still another embodiment. In this embodiment, as shown in FIG. 36, a smoke concentration sensor 80 for detecting the concentration of smoke in the exhaust gas is arranged inside the downstream side exhaust passage 72 downstream of the exhaust throttle valve 45.

Figure 37:
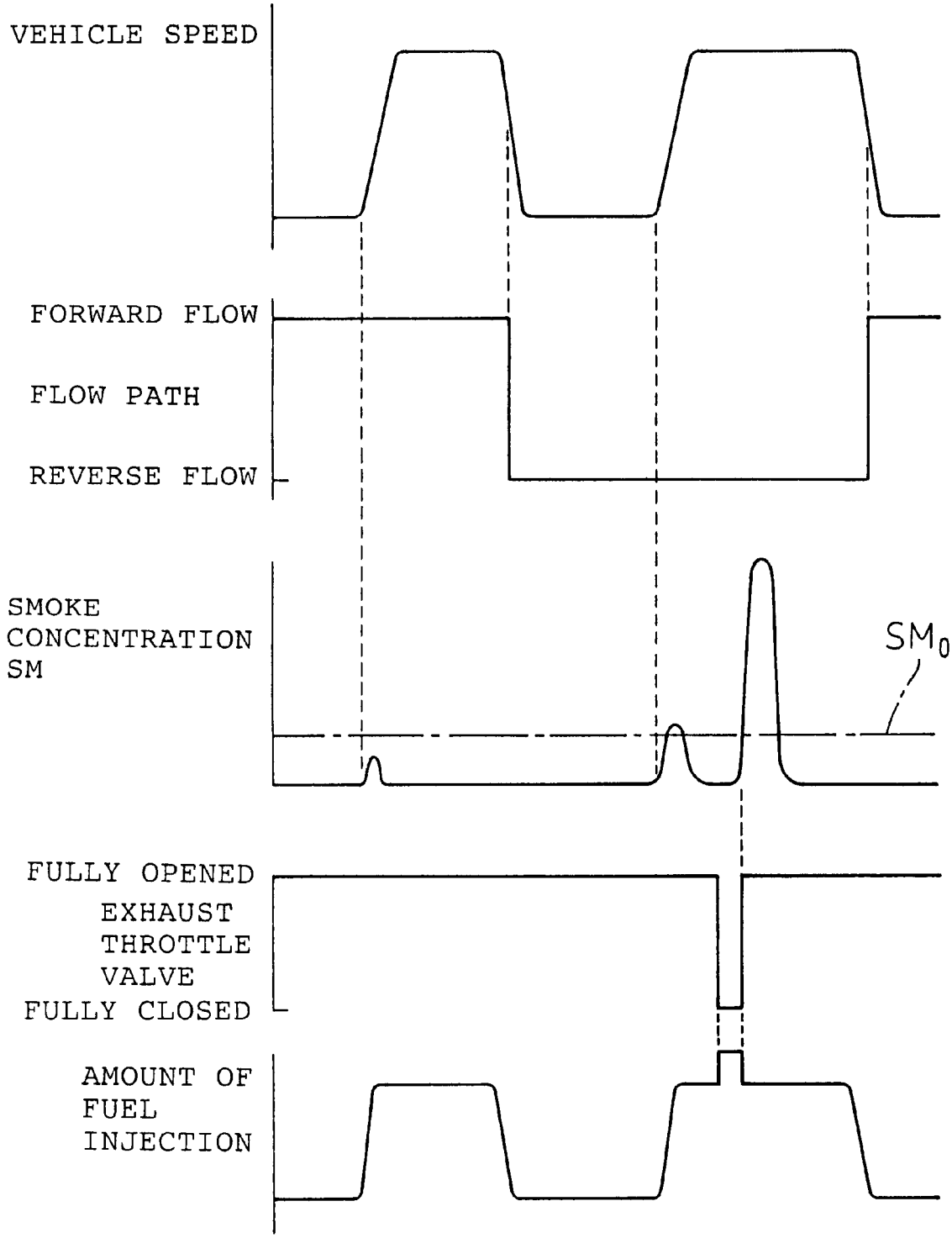
FIG. 37 is a time chart of the change of the opening degree of the exhaust throttle valve.

In this embodiment, as shown in FIG. 37, the forward flow is switched to the reverse flow or the reverse flow to the forward flow at each deceleration operation. On the other hand, at the time of acceleration operation, the flow velocity of the exhaust gas increases, so part of the masses of particulate on the surface of the partition walls 54 of the exhaust gas outflow side and inside the fine holes is separated and discharged from the particulate filter 22. Therefore, when masses of particulate deposit on the surface of the partition walls 54 of the exhaust gas outflow side and inside the fine holes, as shown in FIG. 37, the concentration of smoke SM becomes higher at each acceleration operation. In this case, the concentration of smoke SM becomes higher the greater the amount of masses of particulate deposited.

Therefore, in this embodiment, when the concentration of smoke SM exceeds a predetermined limit value $SM_0$, after the acceleration operation is completed and before the direction of flow of the exhaust gas flowing through the particulate filter 22 becomes the reverse direction, that is, when $SM>SM_0$ at the time of reverse flow, before switching from reverse flow to forward flow, the exhaust throttle valve 45 is temporarily fully closed and the amount of injected flow is increased while the exhaust throttle valve 45 is closed.

Figure 38:
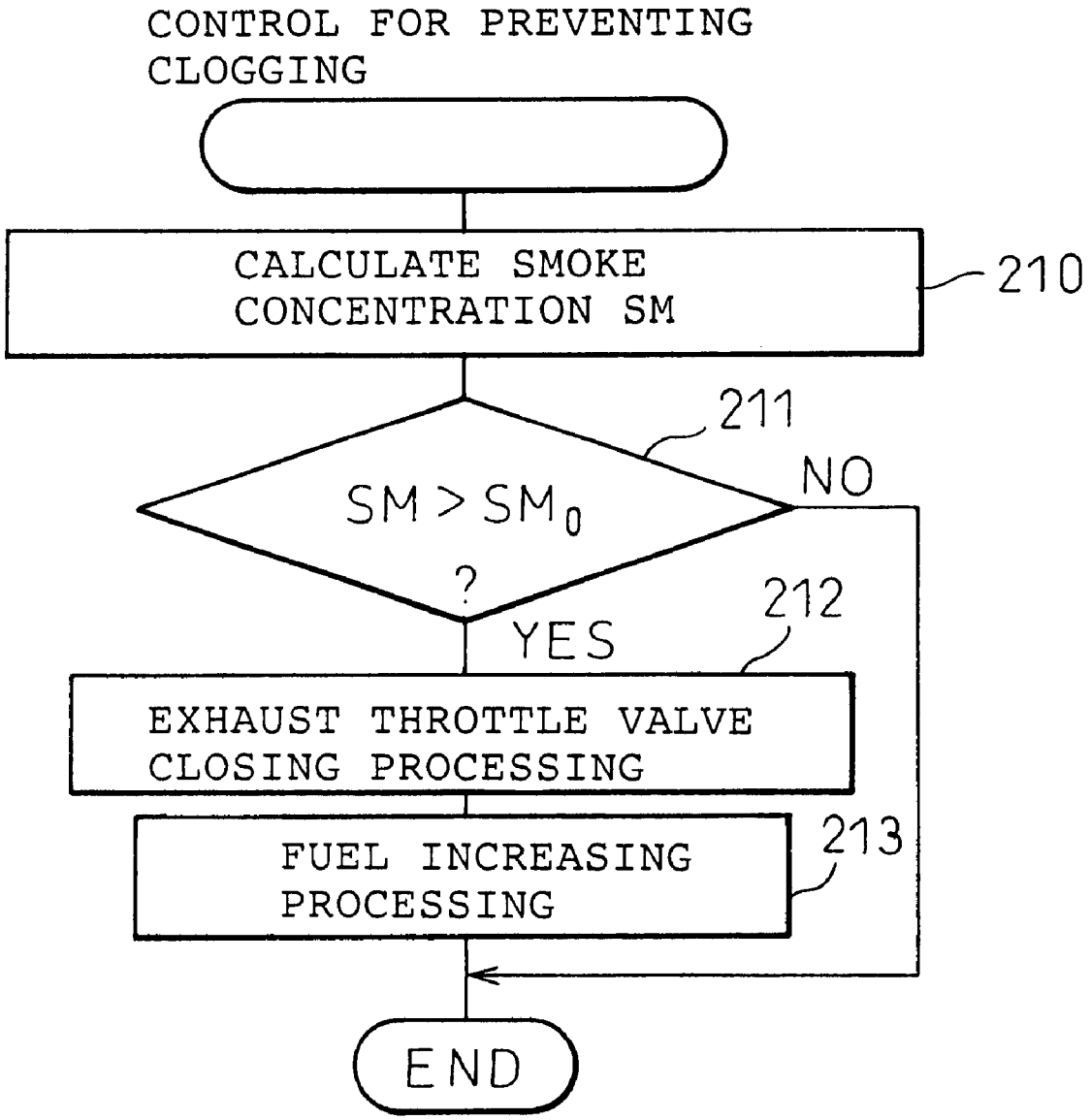
FIG. 38 is a flow chart for control for prevention of clogging.

FIG. 38 shows the routine for control for preventing clogging for working this embodiment.

Referring to FIG. 38, first, at step 210, the concentration of smoke SM in the exhaust gas is detected by the smoke concentration sensor 80. Next, at step 211, it is determined if the concentration of smoke SM has exceeded a limit value $SM_0$. When $SM>SM_0$, the routine proceeds to step 212, where the exhaust throttle valve 45 is temporarily fully closed, then at step 213, the amount of injected fuel is increased while the exhaust throttle valve 45 is closed.

In each of the embodiments described above, it is possible to carry an $NO_x$ absorbent or the active oxygen release agent/$NO_x$ absorbent on the particulate filter 22. Further, the present invention can also be applied to the case where only a precious metal such as platinum Pt is carried on the layer of the carrier formed on the two surfaces of the particulate filter 22. In this case, however, the solid line showing the amount G of particulate removable by oxidation shifts somewhat to the right compared with the solid line shown in FIG. 5. In this case, active oxygen is released from the $NO_2$ or $SO_3$ held on the surface of the platinum Pt.

Further, it is also possible to use as the active oxygen release agent a catalyst able to absorb and hold $NO_2$ or $SO_3$and release active oxygen from this absorbed $NO_2$ or $SO_3$.

Note that the present invention can also be applied to an exhaust gas purification apparatus designed to arrange an oxidation catalyst in the exhaust passage upstream of the particulate filter, convert the NO in the exhaust gas to $NO_2$ by this oxidation catalyst, cause the $NO_2$ and the particulate deposited on the particulate filter to react, and use this $NO_2$ to oxidize the particulate.

According to the present invention, it is possible to separate and discharge the masses of particulate deposited on a particulate filter from the particulate filter.

LIST OF REFERENCE NUMERALS

1 engine body
5 combustion chamber
6 fuel injector
12 surge tank
14 turottle valve
17 throttle valve
19 exhaust manifold
22 particulate filter
25 EGR control valve
45 exhaust throttle valve

What is claimed is:

1. An exhaust gas purification device of an internal combustion engine in which a particulate filter for removing by oxidation particulate in an exhaust gas discharged from a combustion chamber is arranged in an engine exhaust passage and in which a flow velocity instantaneous increasing means is provided for increasing the flow velocity of exhaust gas flowing through the particulate filter for just an instant in a pulse-like manner when the particulate deposited on the particulate filter should be separated from the particulate filter and discharged outside of the particulate filter, and estimating means for estimating the amount of particulate deposited at two sides of a partition wall.

2. An exhaust gas purification device as set forth in claim 1, wherein the timing for increasing the flow velocity of the exhaust gas flowing through the inside of the particulate filter for just an instant in a pulse-like manner is determined based on the amount of deposited particulate estimated by the estimating means.

3. An exhaust gas purification device as set forth in claim 1, wherein a flow path switching valve able to switch the direction of flow of the exhaust gas flowing through the inside of the particulate filter to a reverse direction is arranged in the engine exhaust passage.

4. An exhaust gas purification device as set forth in claim 3, wherein said flow velocity instantaneous increasing means is comprised of an exhaust control valve arranged inside the engine exhaust passage, the particulate filter is provided with the partition wall within which the exhaust gas flows, and the exhaust throttle valve is instantaneously opened to increase the flow velocity of the exhaust gas flowing through the inside of the particulate filter for just an instant in a pulse-like manner when the particulate estimated to have deposited at either side of the partition wall by the estimating means exceeds a predetermined limit value and when one side of the partition wall where the particulate has deposited more than the limit value is the outflow side of the exhaust gas or becomes the outflow side of the exhaust gas.

5. An exhaust gas purification device as set forth in claim 3, wherein the flow velocity instantaneous increasing means is comprised of an exhaust throttle valve arranged in the engine exhaust passage, the exhaust throttle valve is instantaneously opened so as to increase the flow velocity of the exhaust gas flowing through the inside of the particulate filter for just an instant in a pulse-like manner, and the flow path switching valve is used to switch the direction of the exhaust gas through the inside of the particulate filter in the reverse direction immediately before instantaneously opening or when instantaneously opening the exhaust throttle valve.

6. An exhaust gas purification device as set forth in claim 5, wherein the exhaust throttle valve is closed from the fully opened state temporarily immediately before it is instantaneously opened.

7. An exhaust gas purification device as set forth in claim 6, wherein the exhaust throttle valve is temporarily closed from the fully opened state, then again instantaneously fully opened at the time of deceleration operation of the vehicle.

8. An exhaust gas purification device as set forth in claim 6, wherein the exhaust throttle valve is temporarily closed from the fully opened state, then again instantaneously fully opened cyclically every constant time interval.

9. An exhaust gas purification device as set forth in claim 1, wherein the particulate filter can remove by oxidation any particulate in exhaust gas flowing into the particulate filter without emitting a luminous flame when the amount of particulate discharged from the combustion chamber per unit time is smaller than the amount of particulate removable by oxidation on the particulate filter which can be removed by oxidation per unit time without emitting a luminous flame and at least one of the amount of discharged particulate or the amount of particulate removable by oxidation is controlled so that the amount of discharged particulate becomes smaller than the amount of particulate removable by oxidation at the time of an operating state of the engine where the amount of discharged particulate can become smaller than the amount of particulate removable by oxidation.

10. An exhaust gas purification device as set forth in claim 9, wherein a precious metal catalyst is carried on the particulate filter.

11. An exhaust gas purification device as set forth in claim 10, wherein an active oxygen release agent for taking in oxygen and holding oxygen when there is excess oxygen in the surroundings and releasing the held oxygen in the form of active oxygen when the concentration of oxygen in the surroundings falls is carried on the particulate filter, the active oxygen is made to be released from the active oxygen release agent when particulate deposits on the particulate filter, and the released active oxygen is used to oxidize the particulate deposited on the particulate filter.

12. An exhaust gas purification device as set forth in claim 11, wherein the active oxygen release agent is comprised of an alkali metal, an alkali earth metal, a rare earth, or a transition metal.

13. An exhaust gas purification device as set forth in claim 12, wherein the alkali metal and alkali earth metal are comprised of metals higher in tendency toward ionization than calcium.

14. An exhaust gas purification device of an internal combustion engine in which a particulate filter for removing by oxidation particulate in an exhaust gas discharged from a combustion chamber is arranged in an engine exhaust passage and in which a flow velocity instantaneous increasing means is provided for increasing the flow velocity of exhaust gas flowing through the particulate filter for just an instant in a pulse-like manner when the particulate deposited on the particulate filter should be separated from the particulate filter and discharged outside of the particulate filter, wherein the particulate filter includes the function of removing by oxidation any particulate in exhaust gas flowing into the particulate filter without emitting a luminous flame when the amount of particulate discharged from the combustion chamber per unit time is smaller than the amount of particulate removable by oxidation on the particulate filter which can be removed by oxidation per unit time without emitting a luminous flame and of absorbing a $NO_x$ in the exhaust gas when an air-fuel ratio of the exhaust gas flowing into the particulate filter is lean and releasing the absorbed $NO_x$ when an air-fuel ratio of the exhaust gas flowing into the particulate filter becomes a stoichiometric air-fuel ratio and at least one of the amount of discharged particulate or the amount of particulate removable by oxidation is controlled so that the amount of discharged particulate becomes smaller than the amount of particulate removable by oxidation at the time of an operating state of the engine where the amount of discharged particulate can become smaller than the amount of particulate removable by oxidation.

15. An exhaust gas purification device as set forth in claim 14, wherein an active oxygen release agent for taking in oxygen and holding oxygen when there is excess oxygen in the surroundings and releasing the held oxygen in the form of active oxygen when the concentration of oxygen in the surroundings falls is carried on the particulate filter, the active oxygen is made to be released from the active oxygen release agent when particulate deposits on the particulate filter, and the released active oxygen is used to oxidize the particulate deposited on the particulate filter.

16. An exhaust gas purification device as set forth in claim 14, wherein at least one of an alkali metal, an alkali earth metal, a rare earth or a transition metal, and a precious metal catalyst are carried on the particulate filter.

17. An exhaust gas purification device as set forth in claim 16, wherein the alkali metal and alkali earth metal are comprised of metals higher in tendency toward ionization than calcium.

18. An exhaust gas purification device as set forth in claim 14, wherein combustion is normally performed under a lean air-fuel ratio and the air-fuel ratio is temporarily made the stoichiometric air-fuel ratio or rich when the absorbed $NO_x$ inside the particulate filter should be released.

19. An exhaust gas purification device as set forth in claim 18, wherein said flow velocity instantaneous increasing means is comprised of an exhaust throttle valve arranged inside the engine exhaust passage, when the particulate deposited on the particulate filter should be separated from the particulate filter and discharged to the outside of the particulate filter, the exhaust throttle valve is temporarily closed from the fully opened state, then again instantaneously fully opened, and the air-fuel ratio is made rich when the exhaust throttle valve is temporarily closed so as to release the $NO_x$ from the particulate filter.

20. An exhaust gas purification device as set forth in claim 14, wherein a flow path switching valve able to switch the direction of flow of the exhaust gas flowing through the inside of the particulate filter to a reverse direction is arranged in the engine exhaust passage.

21. An exhaust gas purification device as set forth in claim 20, wherein said flow velocity instantaneous increasing means is comprised of an exhaust control valve arranged inside the engine exhaust passage, the particulate filter is provided with a partition wall within which the exhaust gas flows, estimating means for estimating the amount of particulate deposited at the two sides of the partition wall is provided, and the exhaust throttle valve is instantaneously opened to increase the flow velocity of the exhaust gas flowing through the inside of the particulate filter for just an instant in a pulse-like manner when the particulate estimated to have deposited at either side of the partition wall by the estimating means exceeds a predetermined limit value and when one side of the partition wall where the particulate has deposited more than the limit value is the outflow side of the exhaust gas or becomes the outflow side of the exhaust gas.

22. An exhaust gas purification device as set forth in claim 20, wherein the flow velocity instantaneous increasing means is comprised of an exhaust throttle valve arranged in the engine exhaust passage, the exhaust throttle valve is instantaneously opened so as to increase the flow velocity of the exhaust gas flowing through the inside of the particulate filter for just an instant in a pulse-like manner, and the flow path the switching valve is used to switch the direction of the exhaust gas through the inside of the particulate filter in the reverse direction immediately before instantaneously opening or when instantaneously opening the exhaust throttle valve.

23. An exhaust gas purification device as set forth in claim 22, wherein the exhaust throttle valve is closed from the fully opened state temporarily immediately before it is instantaneously opened.

24. An exhaust gas purification device as set forth in claim 23, wherein the exhaust throttle valve is temporarily closed from the fully opened state, then again instantaneously fully opened at the time of deceleration operation of the vehicle.

25. An exhaust gas purification device as set forth in claim 23, wherein the exhaust throttle valve is temporarily closed from the fully opened state, then again instantaneously fully opened cyclically every constant time interval.

26. An exhaust gas purification device as set forth in claim 14, wherein the particulate filter can remove by oxidation any particulate in exhaust gas flowing into the particulate filter without emitting a luminous flame when the amount of particulate discharged from the combustion chamber per unit time is smaller than the amount of particulate removable by oxidation on the particulate filter which can be removed by oxidation per unit time without emitting a luminous flame and at least one of the amount of discharged particulate or the amount of particulate removable by oxidation is controlled so that the amount of discharged particulate becomes smaller than the amount of particulate removable by oxidation at the time of an operating state of the engine where the amount of discharged particulate can become smaller than the amount of particulate removable by oxidation.

27. An exhaust gas purification device as set forth in claim 26, wherein a precious metal catalyst is carried on the particulate filter.

28. An exhaust gas purification device as set forth in claim 27, wherein an active oxygen release agent for taking in oxygen and holding oxygen when there is excess oxygen in the surroundings and releasing the held oxygen in the form of active oxygen when the concentration of oxygen in the surroundings falls is carried on the particulate filter, the active oxygen is made to be released from the active oxygen release agent when particulate deposits on the particulate filter, and the released active oxygen is used to oxidize the particulate deposited on the particulate filter.

29. An exhaust gas purification device as set forth in claim 28, wherein the active oxygen release agent is comprised of an alkali metal, an alkali earth metal, a rare earth, or a transition metal.

30. An exhaust gas purification device as set forth in claim 29, wherein the alkali metal and alkali earth metal are comprised of metals higher in tendency toward ionization than calcium.

* * * * *